US009899136B2

(12) United States Patent
Lee et al.

(10) Patent No.: US 9,899,136 B2
(45) Date of Patent: Feb. 20, 2018

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Sa Yong Lee, Suwon-si (KR); Myung Sam Kang, Suwon-si (KR); Tae Hong Min, Suwon-si (KR); Seon Ha Kang, Suwon-si (KR); Mi Sun Hwang, Suwon-si (KR); Il Jong Seo, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/395,075

(22) Filed: Dec. 30, 2016

(65) Prior Publication Data

US 2017/0330674 A1 Nov. 16, 2017

(30) Foreign Application Priority Data

May 13, 2016 (KR) ..... 10-2016-0058822

(51) Int. Cl.
*H01F 5/00* (2006.01)
*H01F 27/255* (2006.01)
(Continued)

(52) U.S. Cl.
CPC ..... *H01F 27/255* (2013.01); *H01F 5/00* (2013.01); *H01F 27/2804* (2013.01);
(Continued)

(58) Field of Classification Search
CPC ..... H01F 5/00; H01F 27/00–27/36
(Continued)

(56) References Cited

U.S. PATENT DOCUMENTS 6,996,892 B1 2/2006 Dening et al.
9,460,841 B2 * 10/2016 Fontana ..... H01F 17/0013
(Continued)

FOREIGN PATENT DOCUMENTS

JP S61-124117 A 6/1986
JP 2002-359470 12/2002
(Continued)

OTHER PUBLICATIONS

Korean Office Action issued in Korean Patent Application No. 10-2016-0058822, dated Jun. 21, 2017, with English Translation.
(Continued)

*Primary Examiner* — Tuyen Nguyen
(74) *Attorney, Agent, or Firm* — McDermott Will & Emery LLP

(57) ABSTRACT

A coil component includes a body portion, a coil portion, and an electrode portion. The body portion includes a magnetic material, the coil portion is disposed in the body portion, and the electrode portion is disposed on the body portion and electrically connected to the coil portion. The coil portion includes a first coil layer in which a plurality of conductors having a planar spiral shape are stacked, a second coil layer in which a plurality of conductors having a planar spiral shape are stacked, and a first bump disposed between the first and second coil layers to electrically connect the first and second coil layers to each other. The first coil layer and the second coil layer are electrically connected to each other through the first bump to form a single coil having coil turns adjacent to each other in horizontal and vertical directions.

29 Claims, 42 Drawing Sheets

(51) Int. Cl.

| | |
|---|---|
| ***H01F 27/28*** | (2006.01) |
| ***H01F 27/29*** | (2006.01) |
| ***H01F 41/04*** | (2006.01) |
| ***H01F 41/10*** | (2006.01) |
| ***H01F 41/12*** | (2006.01) |

(52) U.S. Cl.
CPC ..... *H01F 27/29* (2013.01); *H01F 41/046* (2013.01); *H01F 41/10* (2013.01); *H01F 41/122* (2013.01); *H01F 2027/2809* (2013.01)

(58) Field of Classification Search
USPC ..... 336/65, 83, 200, 206–208, 232
See application file for complete search history.

(56) References Cited

U.S. PATENT DOCUMENTS

| | | | | |
|---|---|---|---|---|
| 2002/0079135 | A1 | 6/2002 | Yazaki et al. | |
| 2004/0164835 | A1 | 8/2004 | Shoji | |
| 2011/0074535 | A1 | 3/2011 | Banno | |
| 2013/0120095 | A1 | 5/2013 | Weatherspoon et al. | |
| 2013/0222101 | A1 | 8/2013 | Ito et al. | |
| 2014/0009254 | A1* | 1/2014 | Ohkubo | H01F 27/2804 336/192 |
| 2014/0292466 | A1* | 10/2014 | Watanabe | H01F 27/29 336/192 |
| 2015/0048918 | A1 | 2/2015 | Park et al. | |

FOREIGN PATENT DOCUMENTS

| | | | |
|---|---|---|---|
| JP | 2004-228306 | A | 8/2004 |
| JP | 2004-253684 | A | 9/2004 |
| JP | 2006278480 | A | 10/2006 |
| JP | 2006-332147 | A | 12/2006 |
| JP | 2007-227730 | A | 9/2007 |
| JP | 2009-10268 | A | 1/2009 |
| JP | 2009-117546 | A | 5/2009 |
| JP | 2011-077157 | A | 4/2011 |
| JP | 2012-089700 | A | 5/2012 |
| JP | 2013-098554 | A | 5/2013 |
| JP | 2013-125818 | A | 6/2013 |
| JP | 2013-191863 | A | 9/2013 |
| JP | 2015170843 | A | 9/2015 |
| KR | 10-2013-0049207 | | 5/2013 |
| KR | 10-2015-0019588 | | 2/2015 |

OTHER PUBLICATIONS

Notice of Office Action issued in corresponding Japanese Patent Application No. 2016-253310, dated Oct. 10, 2017 (With full English Translation).

* cited by examiner

III–III'

COIL COMPONENT AND METHOD OF MANUFACTURING THE SAME

CROSS-REFERENCE TO RELATED APPLICATION(S)

This application claims benefit of priority to Korean Patent Application No. 10-2016-0058822 filed on May 13, 2016 in the Korean Intellectual Property Office, the disclosure of which is incorporated herein by reference in its entirety.

BACKGROUND

1. Field

The present disclosure relates to a coil component and a method of manufacturing the same.

2. Description of Related Art

In accordance with the miniaturization and thinning of electronic devices such as digital televisions (TV), mobile phones, laptop computers, and the like, the miniaturization and thinning of coil components used in such electronic devices have been demanded. In order to satisfy such demand, research into and development of various wound coil components, thin film coil components and stacked coil components have been actively conducted.

A main issue concerning the miniaturization and the thinning of coil components is whether miniaturized and thinned components can provide characteristics equal to characteristics of existing coil components in spite of the miniaturization and the thinning. In order to satisfy the demand for miniaturized and thinned components with such characteristics, a core may need to be provided that is filled with a magnetic material, and that has a sufficient size and low direct current (DC) resistance $R_{dc}$. To this end, a coil pattern is fabricated using a technology capable of increasing an aspect ratio of a pattern and a cross-sectional area of a coil, for example anisotropic plating technology.

Meanwhile, in manufacturing a coil component using anisotropic plating technology, the risk of occurrence of defects resulting from a decrease in uniformity of plating growth, the risk of occurrence of short-circuits between coils, and the like, have increased due to an increase in an aspect ratio. In addition, a support member used in order to apply the anisotropic plating technology should have a predetermined thickness in order to maintain the rigidity thereof. Therefore, a thickness of a magnetic material covering the coil is inevitably reduced, such that there may be a limitation in implementing high magnetic permeability (Ls).

SUMMARY

An aspect of the present disclosure may provide a new coil component in which a thickness of a magnetic material covering a coil may be sufficiently secured while a pattern having a high aspect ratio (AR) may be implemented, and a method of manufacturing the same.

According to an aspect of the present disclosure, a coil component may be provided, in which a plurality of coil layers in which a plurality of conductors having a planar spiral shape are stacked are formed, and are electrically connected to each other through a bump to form a single coil having coil turns adjacent to teach other in horizontal and vertical directions, without using a support member used in order to apply anisotropic plating technology.

According to an aspect of the present disclosure, a coil component may include a body portion including a magnetic material, a coil portion disposed in the body portion, and an electrode portion disposed on the body portion and electrically connected to the coil portion. The coil portion includes: a first coil layer in which a plurality of conductors having a planar spiral shape are stacked, a second coil layer in which a plurality of conductors having a planar spiral shape are stacked, and a first bump disposed between the first and second coil layers to electrically connect the first and second coil layers to each other. The first coil layer and the second coil layer are electrically connected to each other through the first bump to form a single coil having coil turns adjacent to each other in horizontal and vertical directions.

According to another aspect of the present disclosure, a method of manufacturing a coil component may include forming a coil portion in a body portion including a magnetic material, and forming an electrode portion on the body portion, the electrode portion being electrically connected to the coil portion. The forming of the coil portion includes: preparing a substrate including a support member and one or more metal layers disposed on opposing surfaces of the support member; forming insulating layers on the metal layers on each of the opposing surfaces of the support member; forming patterns in the insulating layers, the patterns having a planar spiral shape; forming first plating layers on the metal layers exposed through the patterns formed in the insulating layers and having the planar spiral shape on each of the opposing surfaces of the support member; forming resin layers on the first plating layers, respectively; forming vias in the resin layers, the vias being connected to the first plating layers; forming a bump in at least one of the vias; separating at least one of the metal layers from the support member; electrically connecting the respective first plating layers to each other through the bump by contacting the resin layers to each other and stacking the resin layers so that the respective vias are connected to each other; removing the metal layers remaining on the respective insulating layers; and forming second plating layers, respectively, on the first plating layers exposed due to the removal of the metal layers. The respective first plating layers connected to each other through the bump and the respective second plating layers formed on the respective first plating layers are electrically connected to each other to form a single coil having coil turns adjacent to each other in horizontal and vertical directions.

According to another aspect of the present disclosure, a coil component may include a body portion including a magnetic material, a coil portion disposed in the body portion, and an electrode portion disposed on the body portion and electrically connected to the coil portion. The coil portion includes: a first coil layer in which first and second conductors are stacked in a stacking direction, wherein each of the first and second conductors of the first coil layer has a planar spiral shape and an aspect ratio of 0.8 to 1.5; and a second coil layer in which first and second conductors are stacked in the stacking direction, wherein each of the first and second conductors of the second coil layer has a planar spiral shape and an aspect ratio of 0.8 to 1.5. The first and second coil layers are stacked in the stacking direction.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
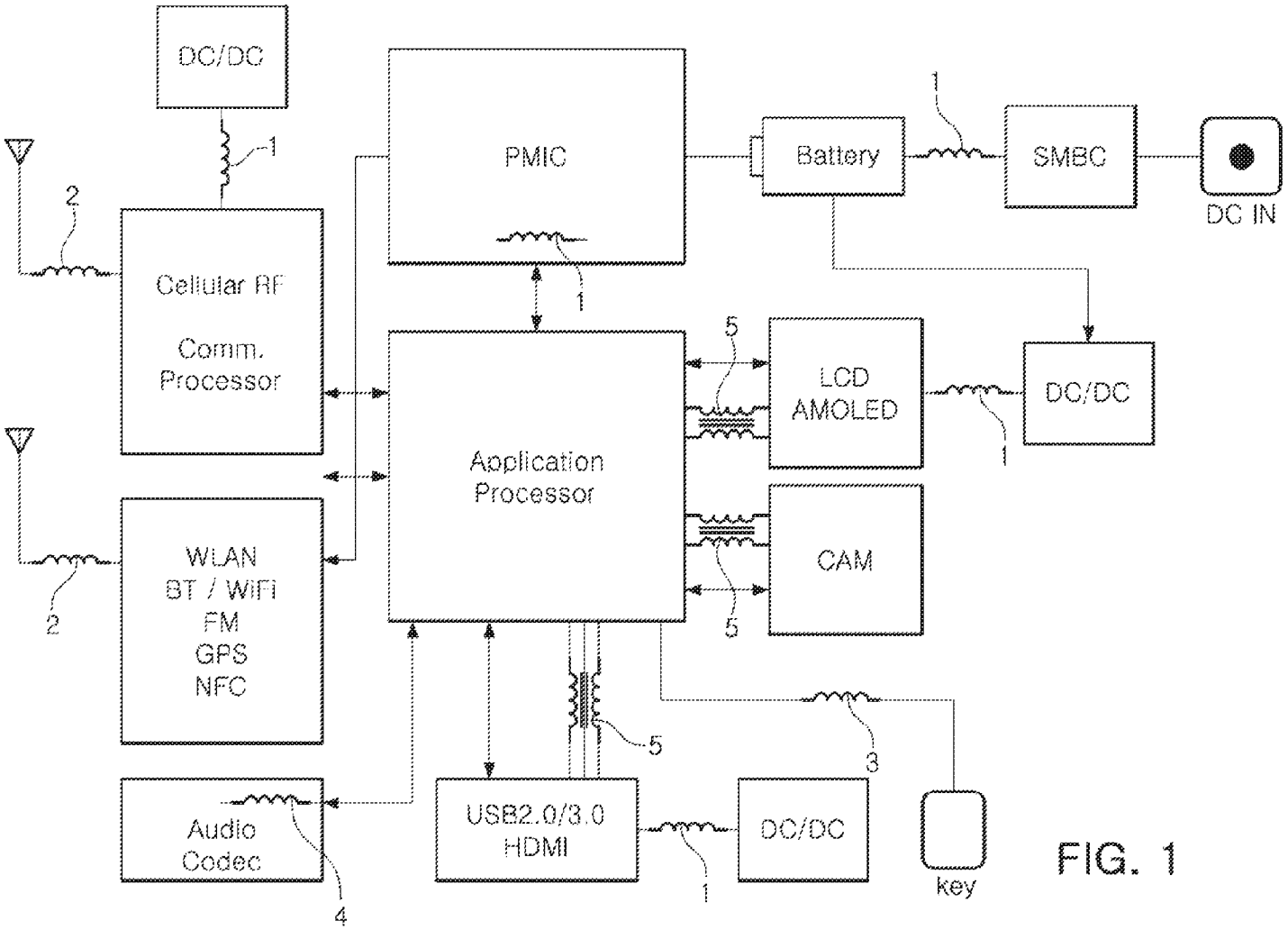
FIG. 1 is a schematic view illustrating various exemplary coil components used in electronic devices.

Hereinafter, exemplary embodiments will be described in more detail with reference to the accompanying drawings. In the drawings, shapes, sizes, and the like, of components may be exaggerated for clarity.

Meanwhile, in the present disclosure, the meaning of an "electrical connection" of one component to another component includes a case in which one component is physically connected to another component and a case in which one component is not physically connected to another component. It can be understood that when an element is referred to with "first" and "second", the element is not limited thereby. The terms may be used only to distinguish one element from other elements, and may not limit the sequence or importance of the elements. In some cases, a first element may be referred to as a second element without departing from the scope of the claims set forth herein. Similarly, a second element may also be referred to as a first element.

In addition, the term "example" used in the present disclosure does not mean the same exemplary embodiment, but is provided in order to emphasize and describe different unique features. However, aspects of one example may be implemented to be combined with features of other examples. For example, one element described in a particular exemplary embodiment, even if it is not described in another exemplary embodiment, may be understood as being amendable to being combined with the other exemplary embodiment unless an opposite or contradictory description is provided herein.

In addition, terms used in the present disclosure are used only in order to describe an example rather than limit the scope of the present disclosure. In this case, singular forms include plural forms unless interpreted otherwise in context.

Electronic Device

FIG. 1 is a schematic view illustrating various exemplary coil components used in electronic devices.

Referring to the drawing, it may be appreciated that various kinds of electronic components are used in electronic devices. For example, an application processor, a direct current (DC) to DC converter, a communications processor, a wireless local area network (WLAN), Bluetooth (BT), wireless fidelity (WiFi), frequency modulation (FM), global positioning system (GPS), or near field communications (NFC) transceiver, a power management integrated circuit (PMIC), a battery, a SMBC, a liquid crystal display (LCD) or active matrix organic light emitting diode (AMOLED) display, an audio codec, a universal serial bus (USB) 2.0/3.0 interface, a high definition multimedia interface (HDMI), a CAM, and the like, may be used. In this case, various kinds of coil components may be appropriately used in interconnections between these electronic components depending on their intended purposes in order to remove noise, or the like. For example, a power inductor 1, high frequency (HF) inductors 2, a general bead 3, a bead 4 for a high frequency (GHz) application, common mode filters 5, and the like, may be used.

In detail, the power inductor 1 may be used to store electricity in magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise from power and signal lines or remove a high frequency ripple. Further, the bead 4 for high frequency (GHz) applications may be used to remove high frequency noise from a signal line and a power line related to audio. Further, the common mode filter 5 may be used to pass a current therethrough in a differential mode and remove only common mode noise.

An electronic device may typically be a smartphone, but is not limited thereto. The electronic device may also be, for example, a personal digital assistant, a digital video camera, a digital still camera, a network system, a computer, a monitor, a television, a video games console, or a smartwatch. The electronic device may also be various other types of electronic devices well-known to those skilled in the art, in addition to the devices described above.

Coil Component

Hereinafter, a coil component according to the present disclosure will be described, and a structure of an inductor, particularly, a power inductor, will be described by way of example for convenience. However, the coil component according to the present disclosure may also be applied to other coil component types used for various purposes.

Meanwhile, hereinafter, a side portion refers to directions in a first direction or a second direction for convenience, an upper portion refers to a direction in a third direction for convenience, and a lower portion refers to a direction opposite to the third direction for convenience. In addition, the phrase "positioned at the side portion, the upper portion, or the lower portion" is used to reference cases in which a target component is positioned in a corresponding direction but does not directly contact a reference component, as well as to reference cases in which the target component directly contacts the reference component in the corresponding direction.

However, these directions have been defined for convenience of explanation, and the scope of the present disclosure is not limited by the directions defined as above.

Figure 2:
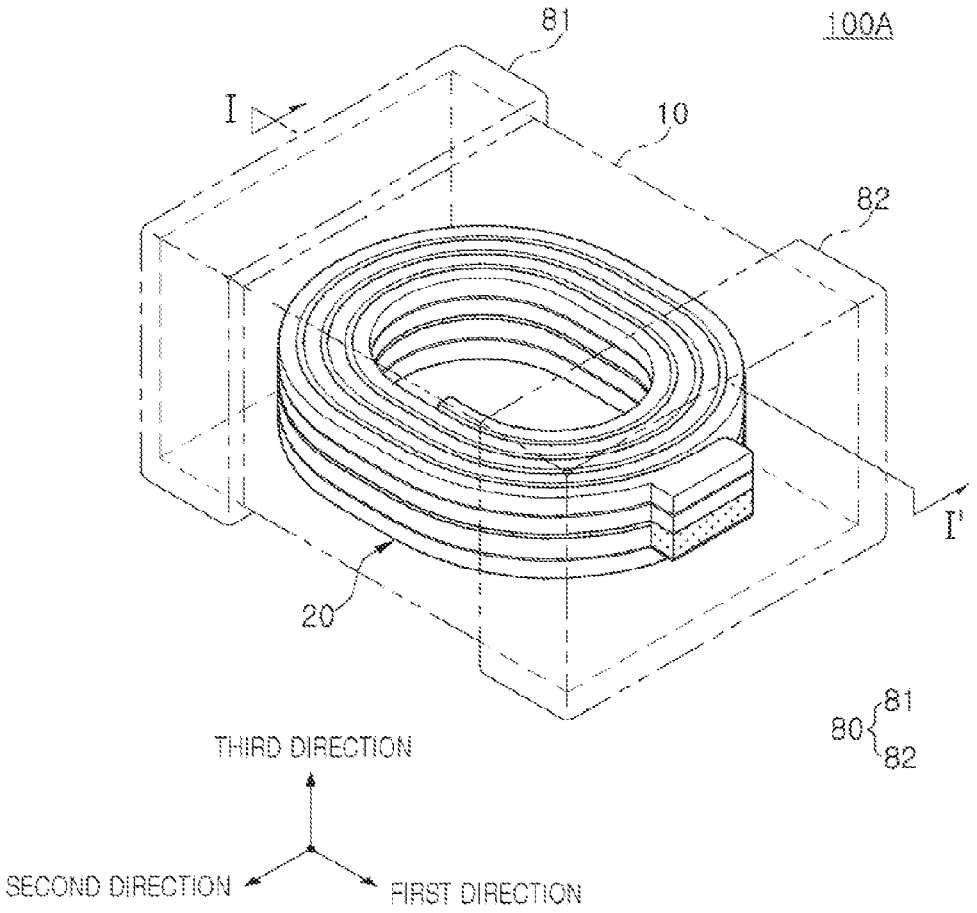
FIG. 2 is a schematic perspective view illustrating an example of a coil component.

FIG. 2 is a schematic perspective view illustrating an example of a coil component 100A.

Figure 3:
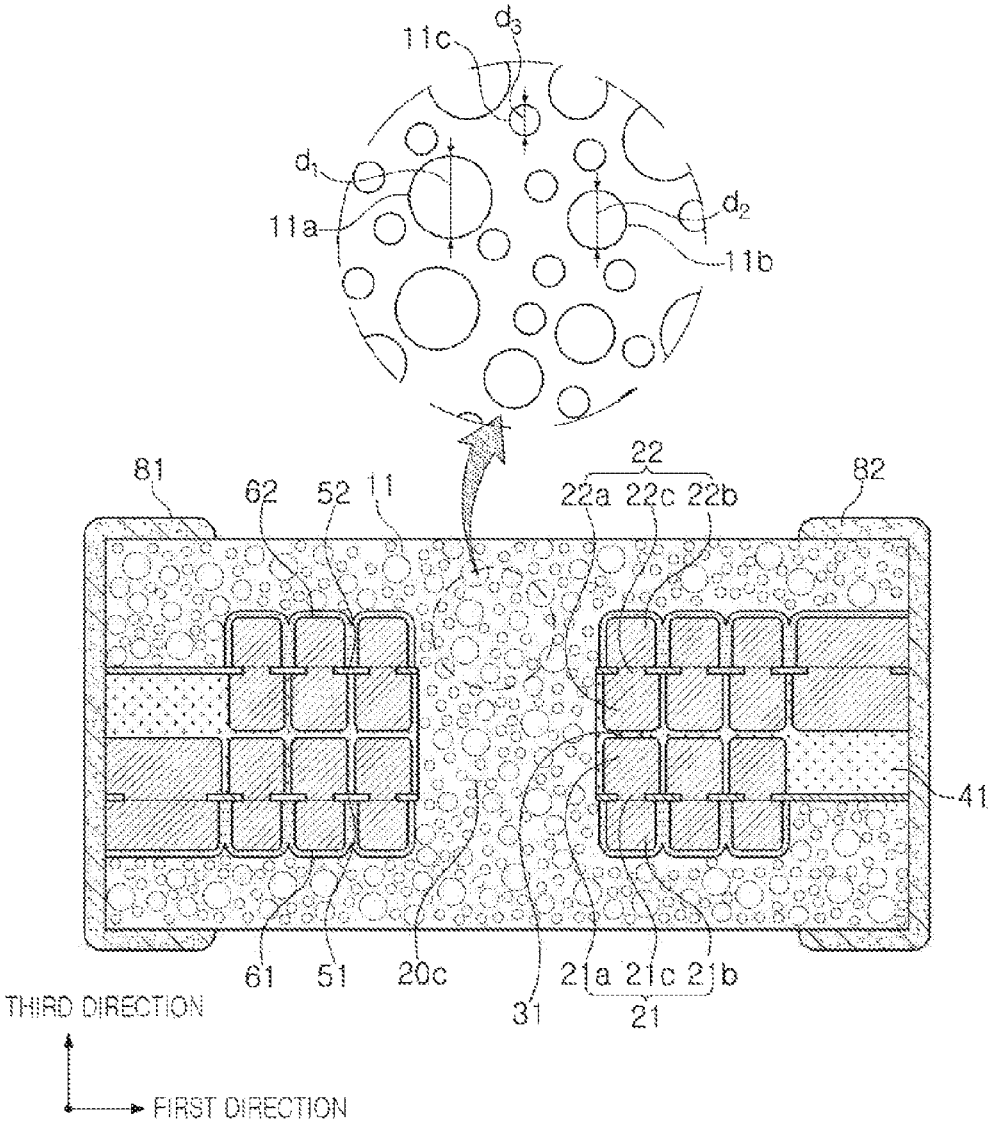
FIG. 3 is a schematic cross-sectional view of the coil component of FIG. 2 taken along line I-I'.

FIG. 3 is a schematic cross-sectional view of the coil component 100A taken along line I-I' of FIG. 2.

Referring to the drawings, the coil component 100A according to an exemplary embodiment may include a body portion 10, a coil portion 20 disposed in the body portion 10, and an electrode portion 80 disposed on the body portion 10 and electrically connected to the coil portion 20.

The body portion 10 may form an exterior of the coil component 100A, and may have first and second surfaces opposing each other in a first direction, third and fourth surfaces opposing each other in a second direction, and fifth and sixth surfaces opposing each other in a third direction. The body portion 10 may have a hexahedral shape. However, a shape of the body portion 10 is not limited thereto. The body portion 10 may include a magnetic material 11. The magnetic material 11 included in the body portion 10 may cover an upper portion and a lower portion of the coil portion 20, and fill a through-hole formed in a central portion of the coil portion 20 to improve operational characteristics (e.g., inductance, resistance, or the like) of the coil component 100A.

The magnetic material 1 is not limited, as long as it has magnetic properties, and may be, for example, Fe alloys such as a pure iron powder, an Fe—Si-based alloy powder, an Fe—Si—Al-based alloy powder, an Fe—Ni-based alloy powder, an Fe—Ni—Mo-based alloy powder, an Fe—Ni—Mo—Cu-based alloy powder, an Fe—Co-based alloy powder, an Fe—Ni—Co-based alloy powder, an Fe—Cr-based alloy powder, an Fe—Cr—Si-based alloy powder, an Fe—Ni—Cr-based alloy powder, an Fe—Cr—Al-based Fe alloy power, or the like, amorphous alloys such as an Fe-based amorphous alloy, a Co-based amorphous alloy, or the like, spinel type ferrites such as an Mg—Zn-based ferrite, an Mn—Zn-based ferrite, an Mn—Mg-based ferrite, a Cu—Zn-based ferrite, an Mg—Mn—Sr-based ferrite, an Ni—Zn-based ferrite, or the like, hexagonal ferrites such as a Ba—Zn-based ferrite, a Ba—Mg-based ferrite, a Ba—Ni-based ferrite, a Ba—Co-based ferrite, a Ba—Ni—Co-based ferrite, or the like, or garnet ferrites such as a Y-based ferrite, or the like.

The magnetic material 11 may include metal magnetic powder particles 11*a*, 11*b*, and 11*c*, and a resin. The metal magnetic powder particles 11*a*, 11*b*, and 11*c* may include iron (Fe), chromium (Cr), or silicon (Si) as main components. For example, the metal magnetic powder particles 11*a*, 11*b*, and 11*c* may include iron (Fe)-nickel (Ni), iron (Fe), iron (Fe)-chromium (Cr)-silicon (Si), or the like, but are not limited thereto. The resin may include epoxy, polyimide, a liquid crystal polymer (LCP), or the like, or a mixture thereof, but is not limited thereto. The metal magnetic powder particles 11*a*, 11*b*, and 11*c* may have average particle sizes $d_1$, $d_2$, and $d_3$, respectively. In this case, the metal magnetic powder particles 11*a*, 11*b*, and 11*c* having different sizes may be used and compressed together be fully filled in a magnetic resin composite, thereby increasing a packing factor. As a result, characteristics of the coil component 100A may be improved.

The purpose of the coil portion 20 may be to implement operational characteristics of the coil component 100A, and the coil component 100A may perform various functions in the electronic device through the operational characteristics implemented by a coil segment of the coil portion 20. For example, the coil component 100A may be the power inductor, as described above. In this case, the coil may serve to store electricity in magnetic field form to maintain an output voltage, thereby stabilizing power. The coil portion 20 may include a plurality of coil layers 21 and 22, and the plurality of coil layers 21 and 22 may be electrically connected to each other to form a single coil of which the turns are increased in horizontal and vertical directions. The respective coil layers 21 and 22 may have a form in which a plurality of conductors 21*a*, 21*b*, and 21*c*, and 22*a*, 22*b*, and 22*c* having a planar spiral shape are stacked. For example, the respective coil layers 21 and 22 may be formed by forming patterns in a planar spiral shape, where the patterns have a cross-sectional shape that is substantially dumbbell shaped.

The coil portion 20 may include a first coil layer 21 in which first to third conductors 21*a*, 21*b*, and 21*c* having a planar spiral shape are stacked, a second coil layer 22 in which first to third conductors 22*a*, 22*b*, and 22*c* having a planar spiral shape are stacked, a first bump 31 disposed between the first and second coil layers 21 and 22 to electrically connect the first and second coil layers 21 and 22 to each other, a first resin layer 41 in which the first conductor 21*a* of the first coil layer 21 and the first conductor 22*a* of the second coil layer 22 are embedded, a first insulating layer 51 disposed between portions of the first and second conductors 21*a* and 21*b* of the first coil layer 21, a second insulating layer 52 disposed between portions of the first and second conductors 22*a* and 22*b* of the second coil layer 22, a first insulating film 61 covering a surface of the second conductor 21*b* of the first coil layer 21, and a second insulating film 62 covering a surface of the second conductor 22*b* of the second coil layer 22. The first bump 31 may penetrate through the first resin layer 41 between the first conductor 21*a* of the first coil layer 21 and the first conductor 22*a* of the second coil layer 22, the third conductor 21*c* of the first coil layer 21 may penetrate through the first insulating layer 51, and the third conductor 22*c* of the second coil layer 22 may penetrate through the second insulating layer 52.

The first and second coil layers 21 and 22 may include the first conductors 21*a* and 22*a*, the second conductors 21*b* and 22*b*, and the third conductors 21*c* and 22*c* disposed between the first conductors 21*a* and 22*a* and the second conductors 21*b* and 22*b* to connect the first conductors 21*a* and 22*a* and the second conductors 21*b* and 22*b* to each other, respectively. Each of the first to third conductors 21*a*, 22*a*, 21*b*, 22*b*, 21*c*, and 22*c* may have the planar spiral shape. Line widths of the first and second conductors 21*a*, 21*b*, 22*a*, and 22*b* may be wider than those of the third conductors 21*c* and 22*c*. For example, a cross-sectional shape of each of the first and second coil layers 21 and 22 in which the first to third conductors 21*a*, 22*a*, 21*b*, 22*b*, 21*c*, and 22*c* are stacked may be substantially dumbbell shaped, but is not limited thereto. Materials of the first to third conductors 21*a*, 22*a*, 21*b*, 22*b*, 21*c*, and 22*c* may be a conductive material such as copper (Cu), aluminum (Al), silver (Ag), tin (Sn), gold (Au), nickel (Ni), lead (Pb), titanium (Ti) or alloys thereof, but are not limited thereto. Each of the first and second coil layers 21 and 22 in which the first to third conductors 21*a*, 22*a*, 21*b*, 22*b*, 21*c*, and 22*c* are connected to each other may have two or more coil turns in a planar direction, that is, a horizontal direction in the orientation shown in FIG. 3.

The first conductors 21*a* and 22*a* and the third conductors 21*c* and 22*c* may be formed by the same process. Therefore, the first conductors 21*a* and 22*a* and the third conductors 21*c* and 22*c* may include the same material, and a boundary may not be present between the first conductors 21*a* and 22*a* and the third conductors 21*c* and 22*c*. The second conductors 21*b* and 22*b* and the third conductors 21*c* and 22*c* may be formed by separate processes. Therefore, the second conductors 21*b* and 22*b* and the third conductors 21*c* and 22*c* may include the same material, but a boundary may be present between the second conductors 21*b* and 22*b* and the third conductors 21*c* and 22*c*. The first and third conductors 21*a* and 21*c* of the first coil layer 21 may be formed on one side of the first insulating layer 51 by applying anisotropic plating, and the second conductor 21*b* of the first coil layer 21 may be formed on the other side of the first insulating layer 51 by applying anisotropic plating. The first and third conductors 22*a* and 22*c* of the second coil layer 22 may be formed on one side of the second insulating layer 52 by applying anisotropic plating, and the second conductor 22*b* of the second coil layer 22 may be formed on the other side of the second insulating layer 52 by applying anisotropic plating. As described above, the first and second coil layers 21 and 22 may be formed on both sides of the insulating layers 51 and 52, respectively, by applying the anisotropic plating, such that the first and second coil layers 21 and 22 may have the cross-sectional shape having a high aspect ratio (AR), such as the substantially dumbbell shape, without a defect such as a short-circuit, or the like. In this case, a pattern formed by anisotropic plating in any one direction may have an aspect ratio (AR) of approximately 0.8 to 1.5.

The first bump 31 may be disposed between the first and second coil layers 21 and 22 to electrically connect the first and second coil layers 21 and 22 to each other. The first bump 31 may be formed by electroplating, paste printing, or the like, and a material of the first bump 31 may be, for example, tin (Sn)/copper (Cu), tin (Sn)-silver (Ag)/copper (Cu), copper (Cu) coated with silver (Ag)/tin (Sn), copper (Cu)/tin (Sn)-bismuth (Bi), or the like, but is not limited thereto. The first bump 31 may include an intermetallic compound (IMC). The intermetallic compound (IMC) may be formed in a high temperature vacuum pressing process among processes of manufacturing the coil component 100A. The intermetallic compound (IMC) may increase interlayer connection strength and decrease conduction resistance to enable a smooth flow of electrons. The first and second coil layers 21 and 22 may be electrically connected to each other through the first bump 31, thereby forming a single coil having a large number of turns wound in horizontal and vertical directions with respect to each other.

The first resin layer 41 may embed the first conductor 21*a* of the first coil layer 21 and the first conductor 22*a* of the second coil layer 22 therein. The first resin layer 41 may be formed by integrating a resin layer embedding the first conductor 21*a* of the first coil layer 21 therein and a resin layer embedding the first conductor 22*a* of the second coil layer 22 therein with each other by matching stacking. A boundary between these resin layers may or may not be apparent. A known insulating material may be used as a material of the first resin layer 41, and a photoimageable dielectric (PID) may additionally or alternatively be used as the material of the first resin layer 41, if necessary. However, the material of the first resin layer 41 is not limited thereto. The first bump 31 may penetrate through the first resin layer 41 between the first conductor 21*a* of the first coil layer 21 and the first conductor 22*a* of the second coil layer 22. In this case, when the photoimageable dielectric (PID) is used as the material of the first resin layer 41, a via for forming the first bump 31 may be formed by a known exposure and development method, such as a photolithography method. Therefore, the via may be more thinly and finely formed, such that a thickness of a coil through which a current flows may be constant. A magnetic film, for example, a curable insulating material containing a magnetic filler may also be used as the material of the first resin layer 41, if necessary. In this case, magnetic density of the coil component 100A may be increased. In a case in which the curable insulating material containing the magnetic filler is used, a via for forming the first bump 31 may be formed using laser drilling, or the like.

The first and second insulating layers 51 and 52 may be disposed between the first and second conductors 21*a* and 21*b* of the first coil layer 21 and between the first and second conductors 22*a* and 22*b* of the second coil layer 22, respectively. The first and second coil layers 21 and 22, in which the plurality of conductors 21*a*, 22*a*, 21*b*, 22*b*, 21*c*, and 22*c* having the planar spiral shape are stacked, may be formed on both sides of the first and second insulating layers 51 and 52, respectively, by applying anisotropic plating technology. Therefore, the first and second coil layers 21 and 22 may be implemented to have the cross-sectional shape having a high aspect ratio (AR), such as the substantially dumbbell shape, without a defect such as a short-circuit, or the like, occurring. A known insulating material may be used as materials of the first and second insulating layers 51 and 52. Particularly, a photoimageable dielectric (PID) may be used as the materials of the first and second insulating layers 51 and 52. However, the materials of the first and second insulating layers 51 and 52 are not limited thereto. The third conductors 21*c* and 22*c* of the first and second coil layers 21 and 22 may penetrate through the first and second insulating layers 51 and 52, respectively. In a case in which the photoimageable dielectric (PID) is used as the materials of the first and second insulating layers 51 and 52, patterns having a planar spiral shape for forming the third conductors 21*c* and 22*c* of the first and second coil layers 21 and 22 may be formed by a known exposure and development method, such as a photolithography method. Therefore, the patterns may be more easily and accurately formed.

The first resin layer 41 may have a thickness greater than those of the first and second insulating layers 51 and 52. That is, the first and second insulating layers 51 and 52 may have a very reduced thickness. In addition, since an insulating thickness between patterns of each of the first and second coil layers 21 and 22 is easily adjusted, thicknesses of the first resin layer 41, the first insulating layer 51, and the second insulating layer 52 may be significantly reduced. Therefore, an overall thickness of the coil portion 20 may be reduced. As a result, a thickness of the magnetic material 11 covering the upper portion and the lower portion of the coil portion 20 may be increased (e.g., without increasing an overall size of the coil component 100A), such that magnetic permeability of the coil component 100A may be improved.

The first and second insulating films 61 and 62 may cover the surface of the second conductor 21*b* of the first coil layer 21 and the surface of the second conductor 22*b* of the second coil layer 22, respectively. The first and second insulating films 61 and 62 may be formed, if necessary, in order to insulate between patterns of the second conductors 21*b* and 22*b* of the first and second coil layers 21 and 22, have fluidity, fill electrodes of 5 μm to 10 μm, and be formed by insulation coating using a polymer-based insulating material having insulation properties, for example perylene, or the like.

The electrode portion 80 may serve to electrically connect the coil component 100A and an electronic device to each other when the coil component 100A is mounted in the electronic device. The electrode portion 80 may include a first electrode 81 and a second electrode 82 disposed on the body portion 10 so as to be spaced apart from each other. The first and second electrodes 81 and 82 may cover, respectively, the first and second surfaces of the body portion 10 opposing each other in the first direction, and may be extended to the third to sixth surfaces of the body portion 10 connected to the first and second surfaces of the body portion 10. The first and second electrodes 81 and 82 may be electrically connected to first and second lead terminals (not denoted by reference numerals) of the coil portion 20 on the first and second surfaces of the body portion 10, respectively. However, disposition forms of the first and second electrodes 81 and 82 are not limited thereto. The first and second electrodes 81 and 82 may include, for example, conductive resin layers and conductor layers formed on the conductive resin layers, respectively. The conductive resin layer may include one or more conductive metals selected from the group consisting of copper (Cu), nickel (Ni), and silver (Ag), and a thermosetting resin. The conductor layer may include one or more selected from the group consisting of nickel (Ni), copper (Cu), and tin (Sn). For example, a nickel (Ni) layer and a tin (Sn) layer may be sequentially formed in the conductor layer. However, the conductive resin layer and the conductor layer are not limited thereto.

FIGS. 4 through 11 are schematic views illustrating an exemplary process of manufacturing the coil component 100A of FIG. 2.

Figure 4:
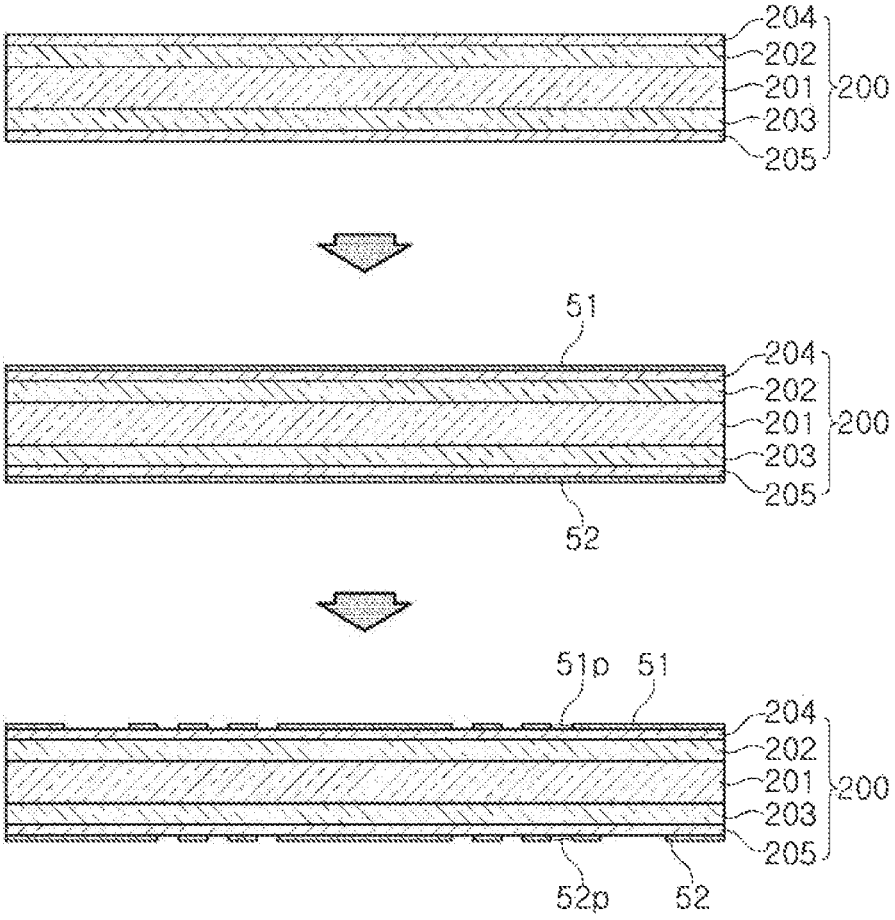
FIGS. 4 through 11 are schematic views illustrating an exemplary process of manufacturing the coil component of FIG. 2.

Referring to FIG. 4, first, a substrate 200 may be prepared. The substrate 200 may include a support member 201, first metal layers 202 and 203 disposed on two opposing surfaces of the support member 201, and second metal layers 204 and 205 disposed on the first metal layers 202 and 203, respectively. In some cases, the first and second metal layers 202, 203, 204, and 205 may be formed on only one surface of the support member 201, and/or only the second metal layers 204 and 205 may be disposed on both opposing surfaces of the support member 201. The support member 201 may be an insulating substrate formed of an insulating resin. The insulating resin may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, for example, prepreg, Ajinomoto Build up Film (ABF), FR-4, Bismaleimide Triazine (BT), or the like. The first and second metal layers 202, 203, 204, and 205 may generally be thin copper foils, but are not limited thereto. That is, the first and second metal layer 202, 203, 204, and 205 may include other metals. As a non-restrictive example, the substrate 200 may be a copper clad laminate (CCL). Next, the first and second insulating layers 51 and 52 may be formed, respectively, on the second metal layers 204 and 205 disposed on opposing sides of the substrate 200. The first and second insulating layers 51 and 52 may be formed by a method of laminating the above-mentioned insulating material such as the photoimageable dielectric (PID) at a predetermined thickness such as about 10 μm to 20 μm. Next, patterns 51P and 52P having a planar spiral shape may be formed in the first and second insulating layers 51 and 52, respectively. In a case in which the materials of the first and second insulating layers 51 and 52 are the photoimageable dielectric (PID), the patterns 51P and 52P having the planar spiral shape may be formed by a known photolithography method, that is, processes such as exposure, development, drying, and the like. When the patterns 51P and 52P having the planar spiral shape are formed, the second metal layers 204 and 205 disposed on opposing sides of the substrate 200 may be externally exposed so as to be used as seed layers in a plating process, the subsequent process.

Figure 5:
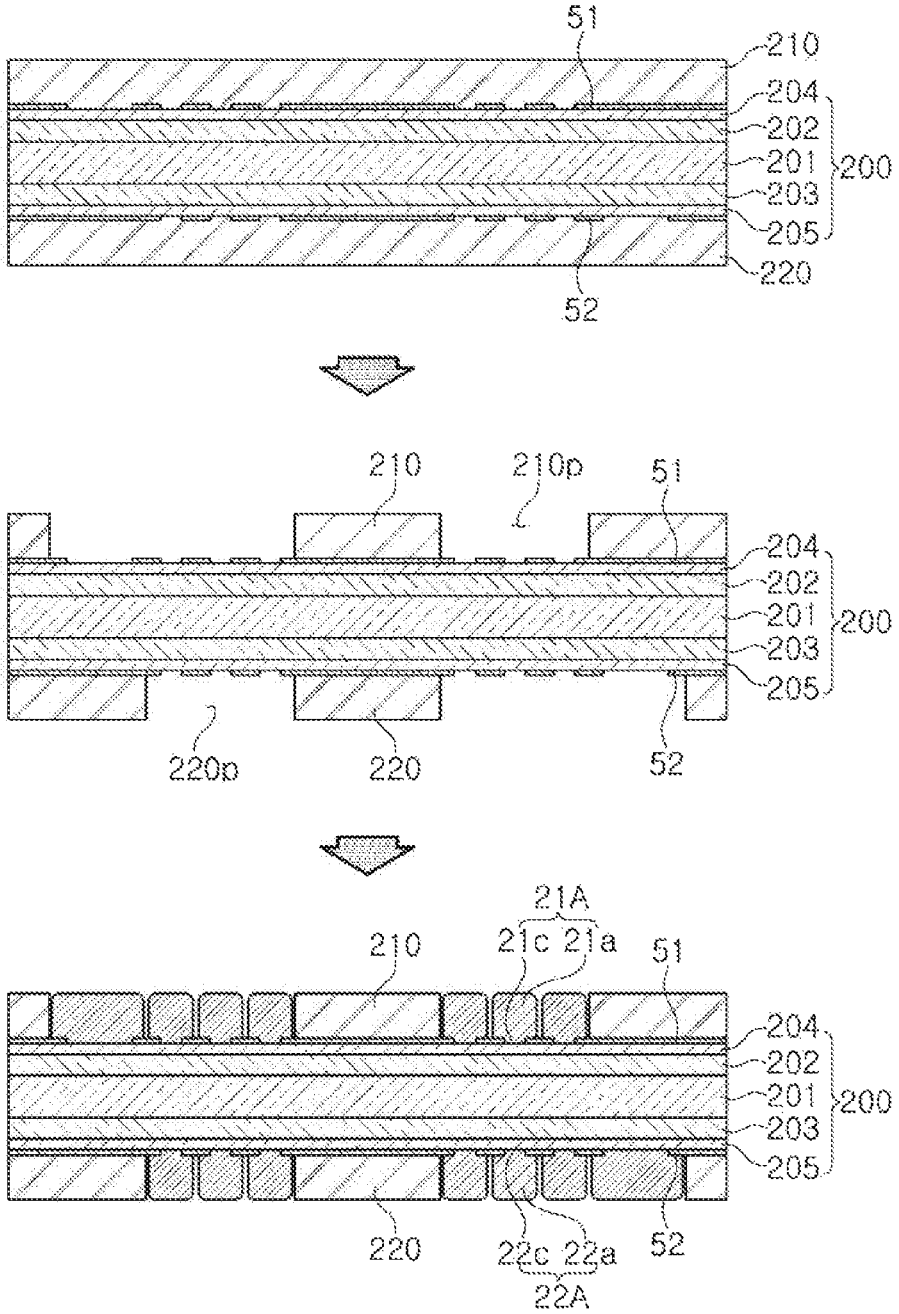

Referring to FIG. 5, dry films 210 and 220 may be formed on the first and second insulating layers 51 and 52, respectively. A method of forming the dry films 210 and 220 is also not particularly limited. For example, the dry films 210 and 220 may be formed by laminating materials of the dry films 210 and 220 having a predetermined thickness such as about 80 μm to 150 μm by a known method. Next, dams 210P and 220P for performing a plating process may be formed in the dry films 210 and 220, respectively, by a known photolithography method. The dams 210P and 220P may be, for example, for anisotropic plating, but are not limited thereto. Next, first plating layers 21A and 22A may be formed, respectively, on the second metal layers 204 and 205 exposed through the patterns formed on the first and second insulating layers 51 and 52 and having the planar spiral shape and disposed on both opposing sides of the substrate 200. The first plating layers 21A and 22A may be formed by a known plating method such as anisotropic electroplating using the exposed second metal layers 204 and 205 as seed layers. The first plating layers 21A and 22A may include the third conductors 21*c* and 22*c* filling the patterns formed in the first and second insulating layers 51 and 52 and having the planar spiral shape and the first conductors 21*a* and 22*a* formed on the third conductors 21*c* and 22*c*, respectively, and a boundary may not be particularly present between the first conductors 21*a* and 22*a* and the third conductors 21*c* and 22*c*. Line widths of the first conductors 21*a* and 22*a* of the first plating layers 21A and 22A may be approximately 80 μm to 120 μm, thicknesses of the first conductors 21*a* and 22*a* of the first plating layers 21A and 22A may be approximately 80 μm to 120 μm, intervals between lines of the first conductors 21*a* and 22*a* of the first plating layers 21A and 22A may be approximately 2 μm to 5 μm, and aspect ratios (ARs) of patterns of the first conductors 21*a* and 22*a* of the first plating layers 21A and 22A (measured as ratios of the height, measured in the third direction, divided by the width, measured in the first direction) may be about 0.8 to 1.5, but are not limited thereto.

Figure 6:
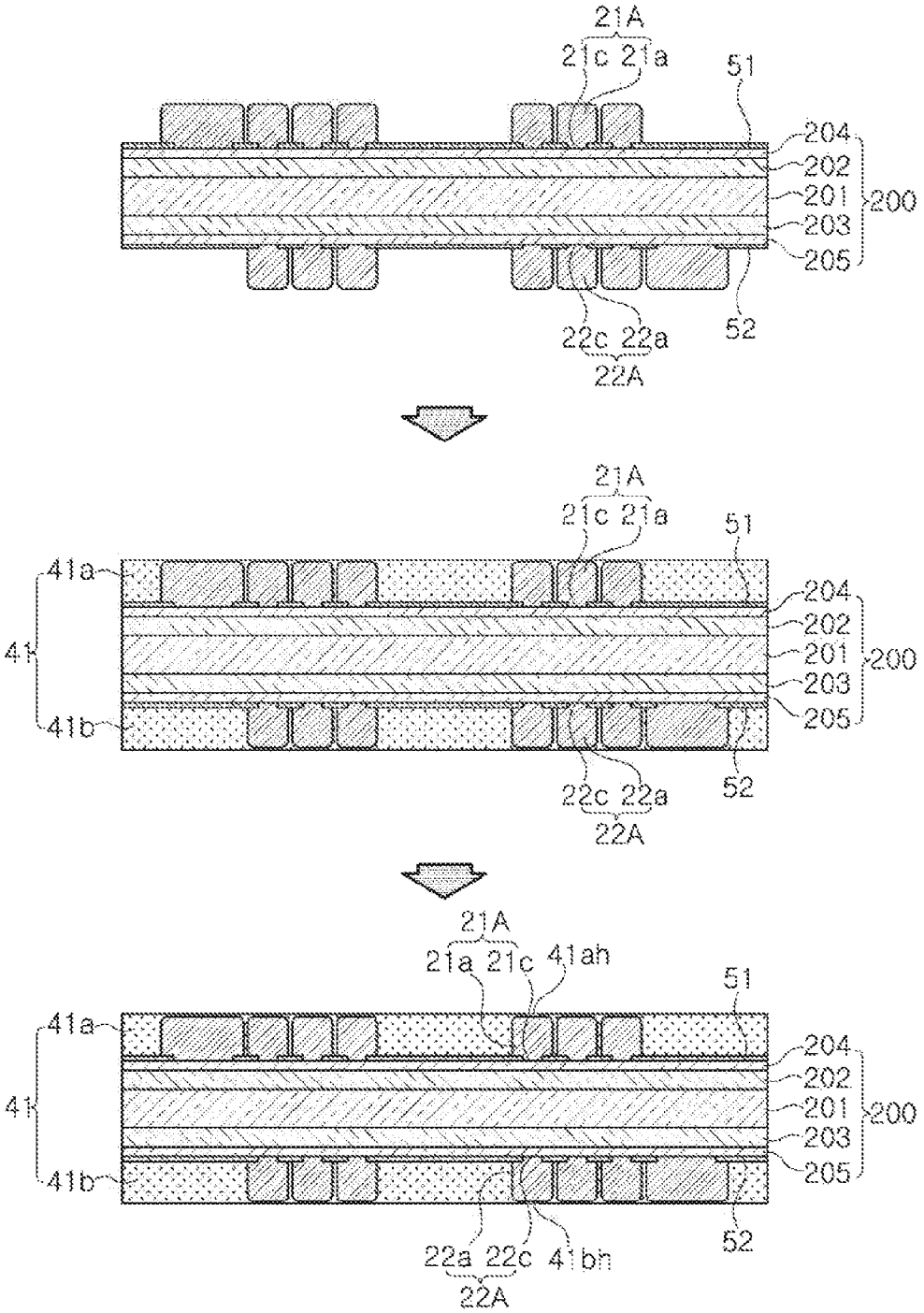

Referring to FIG. 6, the dry films 210 and 220 may be stripped. The dry films 210 and 220 may be stripped by a known etching method, but the present disclosure is not limited thereto. In this case, if necessary, insulating films (not illustrated) may be formed on surfaces of the first conductors 21*a* and 22*a* of the first plating layers 21A and 22A by insulation coating to prevent non-filling between patterns. Next, resin layers 41*a* and 41*b* may be formed on the first plating layers 21A and 22A, respectively. The resin layers 41*a* and 41*b* may embed the first conductors 21*a* and 22*a* of the first plating layers 21A and 22A, respectively, therein such that the first conductors 21*a* and 22*a* are fully encased in the resin layers. The resin layers 41*a* and 41*b* may also be formed by a method of laminating an insulating material such as a photoimageable dielectric (PID) at a predetermined thickness such as about 80 μm to 150 μm. Alternatively, the resin layers 41*a* and 41*b* may also be formed by a method of laminating a magnetic film having a predetermined thickness such as about 80 μm to 150 μm, for example, a curable film containing a magnetic filler. Next, vias 41*ah* and 41*bh* connected to (or extending to) the first plating layers 21A and 22A may be formed in the resin layers 41*a* and 41*b*, respectively. The vias 41*ah* and 41*bh* may be formed by a known photolithography method in a case in which the resin layers 41*a* and 41*b* include the photoimageable dielectric (PID), and be formed by a known laser drilling method, or the like, in a case in which the resin layers 41*a* and 41*b* include a curable insulating material.

Figure 7:
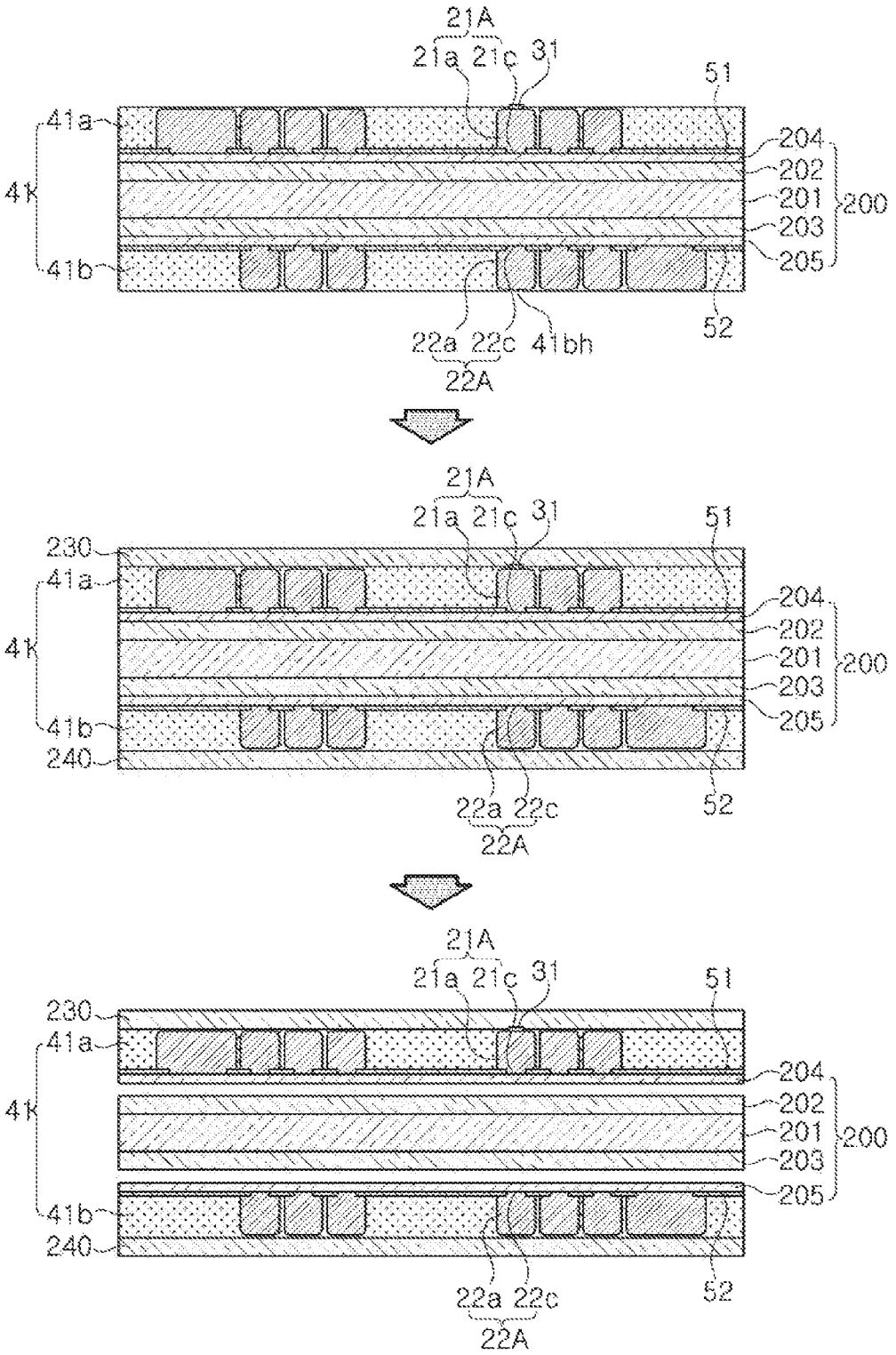

Referring to FIG. 7, the first bump 31 may be formed in at least one of the vias 41*ah* and 41*bh* formed in the resin layers 41*a* and 41*b*. The first bump 31 may be formed by a known method such as electroplating, paste printing, or the like. Meanwhile, the first bump 31 may protrude from a surface of the resin layer 41*a* or 41*b*, and a thickness of the first bump 31 protruding from the surface of the resin layer 41*a* or 41*b* may be approximately 5 μm to 10 μm. Next, black masks 230 and 240 may be formed on the resin layers 41*a* and 41*b*, respectively, in order to protect the first bump 31. The black masks 230 and 240 may also be formed by a known lamination method. Next, the second metal layers 204 and 205 may be separated from the support member 201. A method of separating the second metal layers 204 and 205 from the support member 201 is not particularly limited. For example, the second metal layers 204 and 205 may be separated from the support member 201 by separating the first and second metal layers 202, 203, 204, and 205 disposed on both sides of the support member 201 from each other by a known method.

Figure 8:
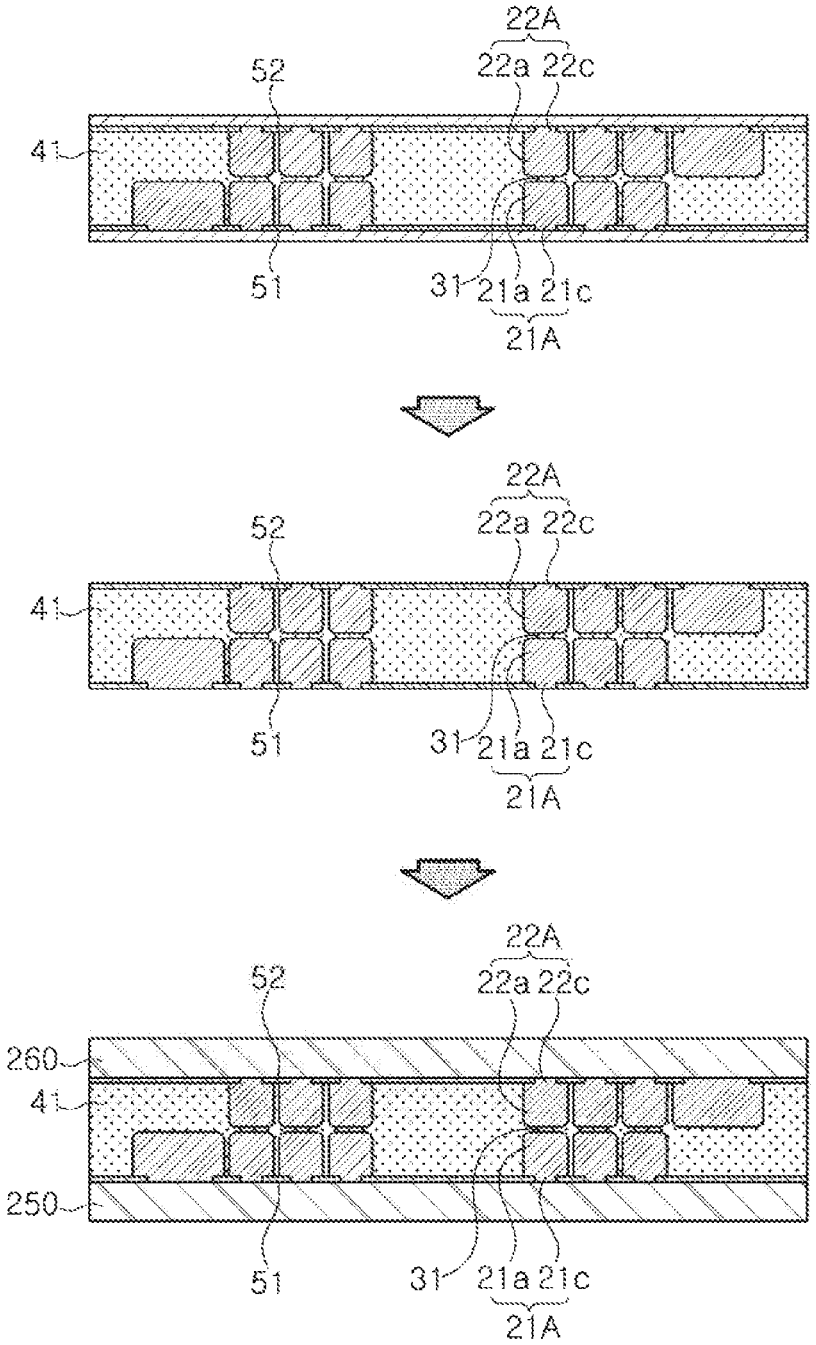

Referring to FIG. 8, the black masks 230 and 240 can be removed such that the respective resin layers 41*a* and 41*b* may be matched with each other and stacked so that the vias 41*ah* and 41*bh* formed in the respective resin layers 41*a* and 41*b* are connected to each other. In this case, the first bump 31 formed in any one of the vias 41*ah* and 41*bh* may also be disposed in the other of the vias 41*ah* and 41*bh*, such that the respective first plating layers 21A and 22A may be electrically connected to each other through the first bump 31. The respective resin layers 41*a* and 41*b* may adhere to each other by high-temperature compression to form the first resin layer 41. In this case, the intermetallic compound (IMC) may be formed between the first bump 31 and the first plating layers 21A and 22A. As a result, interlayer connection strength may be increased, and conduction resistance may be reduced, thereby enabling a smooth flow of electrons. Next, the second metal layers 204 and 205 remaining on the first and second insulating layers 51 and 52 may be removed. As a method of removing the second metal layers 204 and 205, a known etching method may be used. Next, dry films 250 and 260 may be formed on portions from which the second metal layers 204 and 205 have been removed. The dry films 250 and 260 may be formed by laminating materials of the dry films 250 and 260 at a predetermined thickness such as 80 μm to 150 μm.

Figure 9:
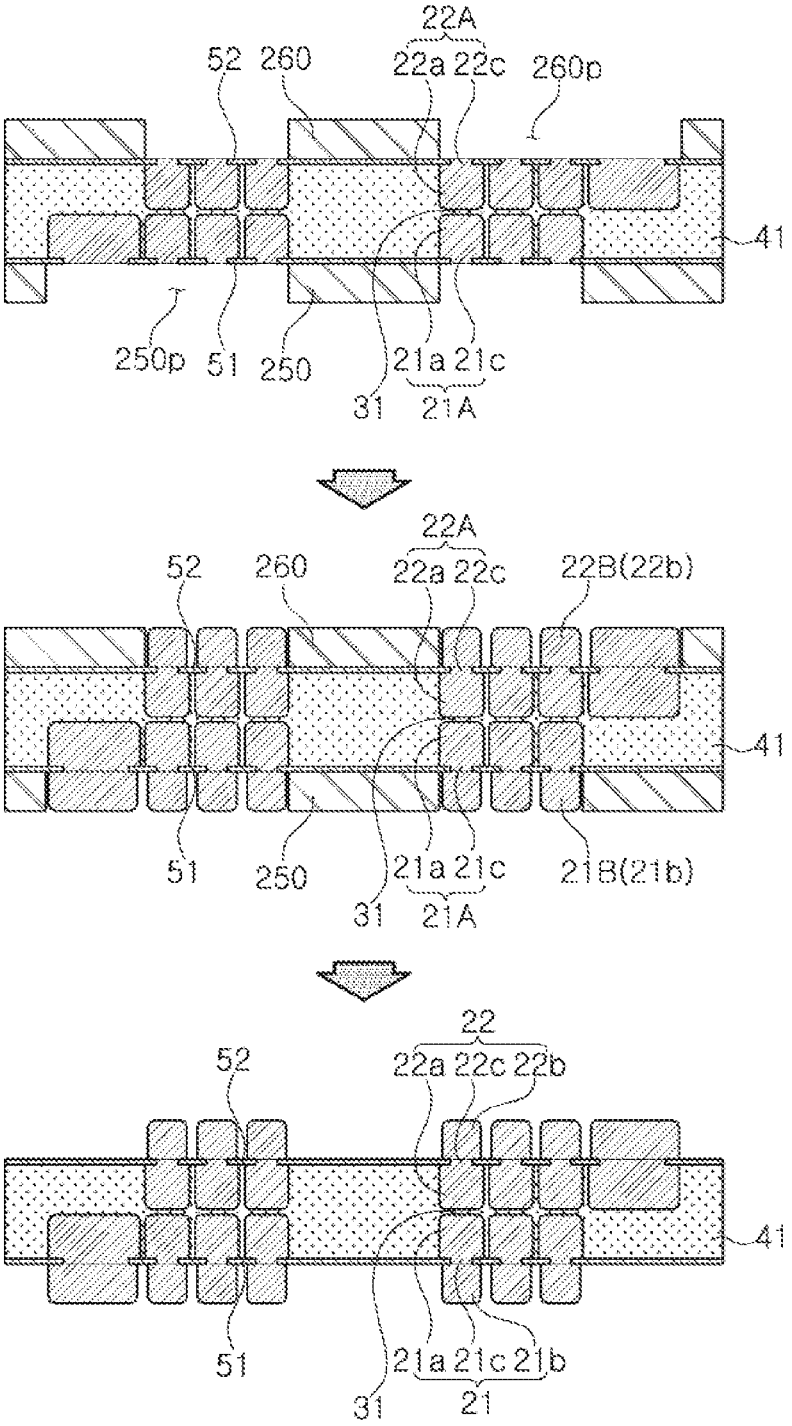

Referring to FIG. 9, dams 250P and 260P for a plating process, the subsequent process, may be formed in the dry films 250 and 260, respectively, by a known photolithography method. The dams 250P and 260P may be, for example, for anisotropic plating, but are not limited thereto. Next, second plating layers 21B and 22B may be formed, respectively, on the third conductors 21*c* and 22*c* of the first plating layers 21A and 22A exposed through the dams 250P and 260P. The second plating layers 21B and 22B may be formed by a known plating method such as anisotropic electroplating using the exposed third conductors 21*c* and 22*c* of the first plating layers 21A and 22A as seed layers. The second plating layers 21B and 22B may include the second conductors 21*b* and 22*b*, respectively, and a boundary may also be present between the second conductors 21*b* and 22*b* and the third conductors 21*c* and 22*c*. Line widths of the second conductors 21*b* and 22*b* of the second plating layers 21B and 22B may be approximately 80 μm to 120 μm, thicknesses of the second conductors 21*b* and 22*b* of the second plating layers 21B and 22B may be approximately 80 μm to 120 μm, intervals between lines of the second conductors 21*b* and 22*b* of the second plating layers 21B and 22B may be approximately 2 μm to 5 μm, and aspect ratios of patterns of the second conductors 21*b* and 22*b* of the second plating layers 21B and 22B (measured as ratios of the height, measured in the third direction, divided by the width, measured in the first direction) may be about 0.8 to 1.5, but are not limited thereto. The first and second plating layers 21A, 22A, 21B, and 22B may be connected to each other to form the first and second coil layers 21 and 22, respectively. The first and second coil layers 21 and 22 may be electrically connected to each other through the first bump 31, thereby forming a single coil having a large number of turns wound in the horizontal and vertical directions with respect to each other. Next, the dry films 250 and 260 may be stripped. The dry films 250 and 260 may be stripped by a known etching method, but the present disclosure is not limited thereto. In this case, if necessary, insulating films (not illustrated) may be formed on surfaces of the second conductors 21*b* and 22*b* of the second plating layers 21B and 22B by insulation coating to prevent non-filling between patterns.

Figure 10:
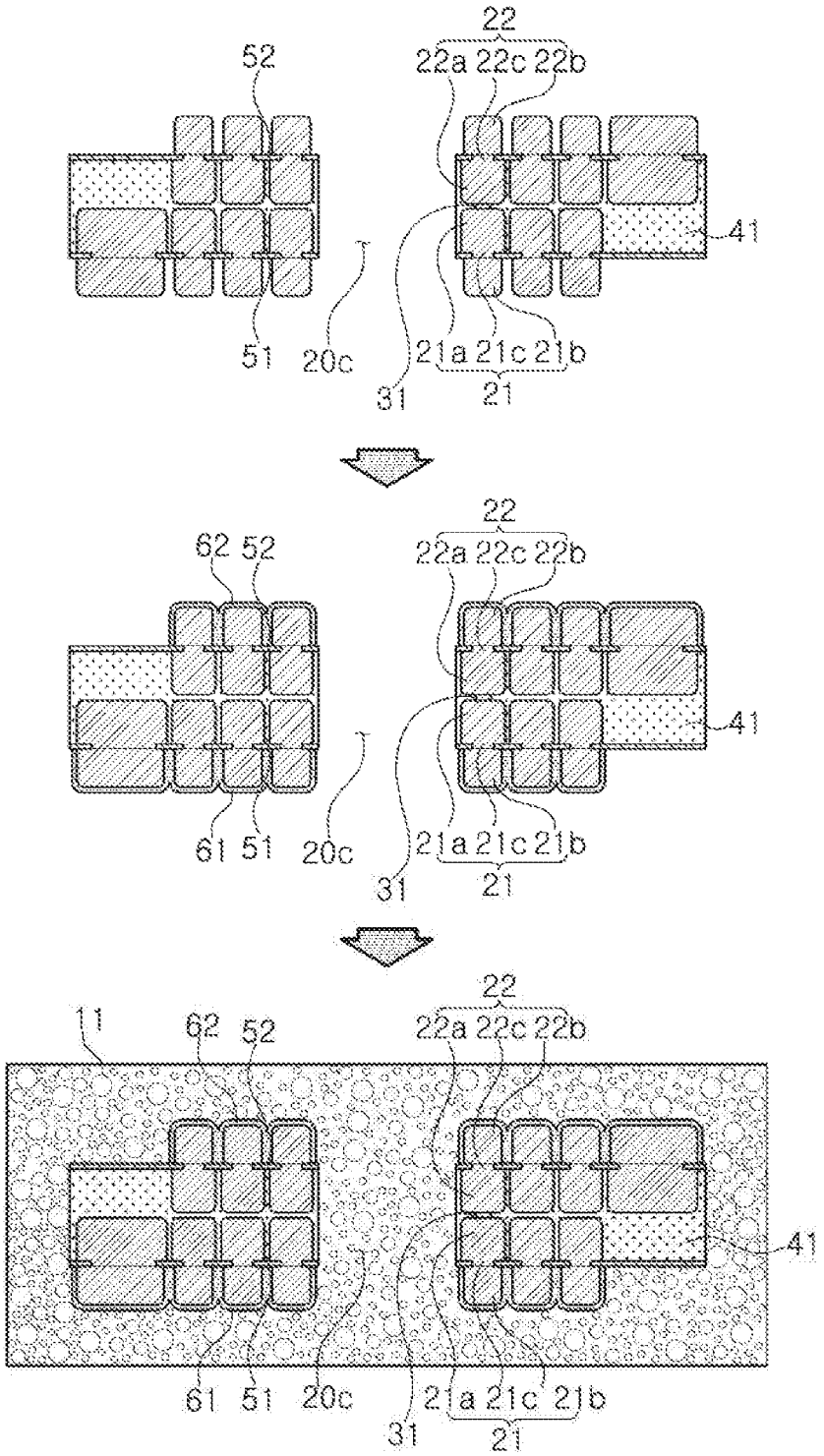

Referring to FIG. 10, a through-hole penetrating through central portions of the first resin layer 41, the first insulating layer 51, and the second insulating layer 52 may be formed. A region in which the through-hole is formed may be a core region 20*c* of the coil portion 20. The through-hole may be formed by a photolithography method, a laser drilling method, a mechanical drilling method, an etching method, or the like. Next, the first and second insulating films 61 and 62 covering, respectively, surfaces of the second conductors 21*b* and 22*b* of the first and second coil layers 21 and 22 may be formed. The first and second insulating films 61 and 62 may be formed by a known insulation coating method. The coil portion 20 may be formed through a series of processes. Next, the magnetic material 11 may cover the upper portion and the lower portion of the coil portion 20 and fill the through-hole formed in the central portion. A method in which the magnetic material 11 covers the upper portion and the lower portion of the coil portion 20 and fills the through-hole may be a method of laminating a plurality of magnetic sheets on the upper portion and the lower portion of the coil portion 20, but is not limited thereto. The body portion 10 may be formed through a series of processes.

Figure 11:
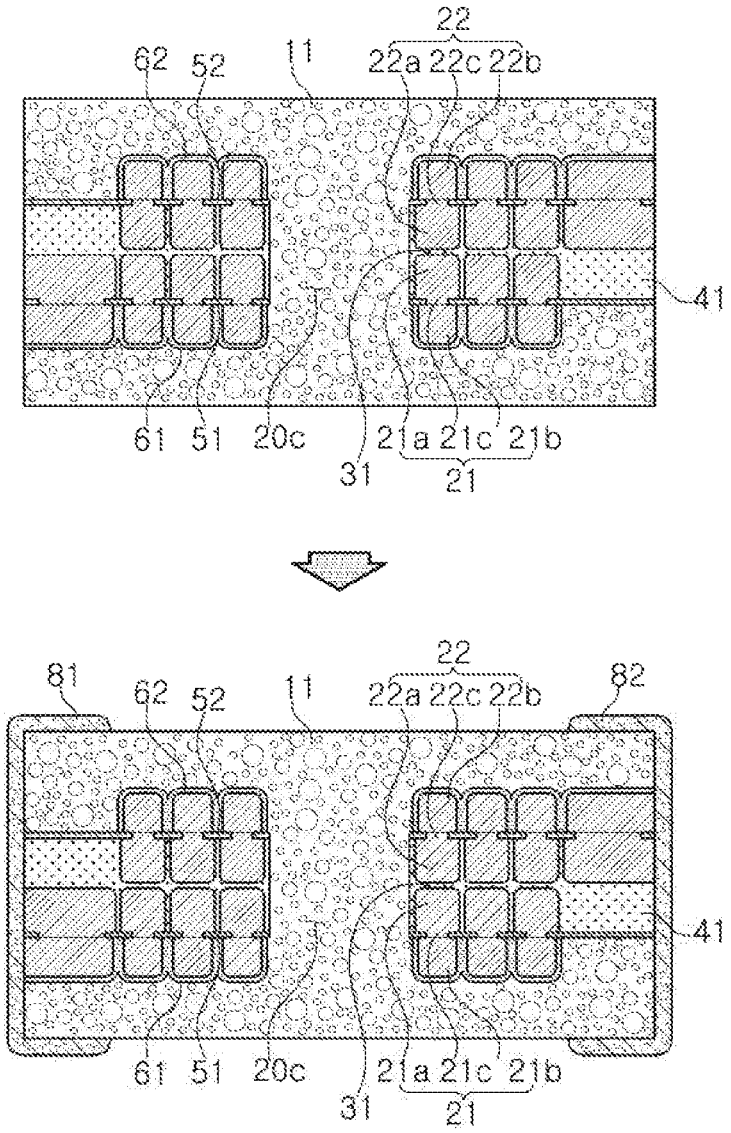

Referring to FIG. 11, the body portion 10 may be diced to have a desired size and polished. The first and second lead terminals (not denoted by reference numerals) of the coil portion 20 may be exposed, respectively, to the first and second surfaces of the body portion 10 opposing each other in the first direction by dicing and polishing the body portion 10. Next, the first and second electrodes 81 and 82 covering at least the first and second surfaces of the body portion 10 so as to be connected, respectively, to the first and second lead terminals (not denoted by reference numerals) of the coil portion 20 may be formed. The first and second electrodes 81 and 82 may be formed by, for example, a method of forming conductive resin layers and then forming conductor layers on the conductive resin layers. The conductive resin layer may be formed using paste printing. The conductor layer may be formed using a known plating method, or the like. However, the conductive resin layer and the conductor layer are not limited thereto. The electrode portion 80 may be formed through a series of processes.

Meanwhile, processes of manufacturing the coil component according to the exemplary embodiment are not necessarily limited to the abovementioned sequence. That is, a process described second may be first performed and a process described first may be performed as the second process, if necessary.

Figure 12:
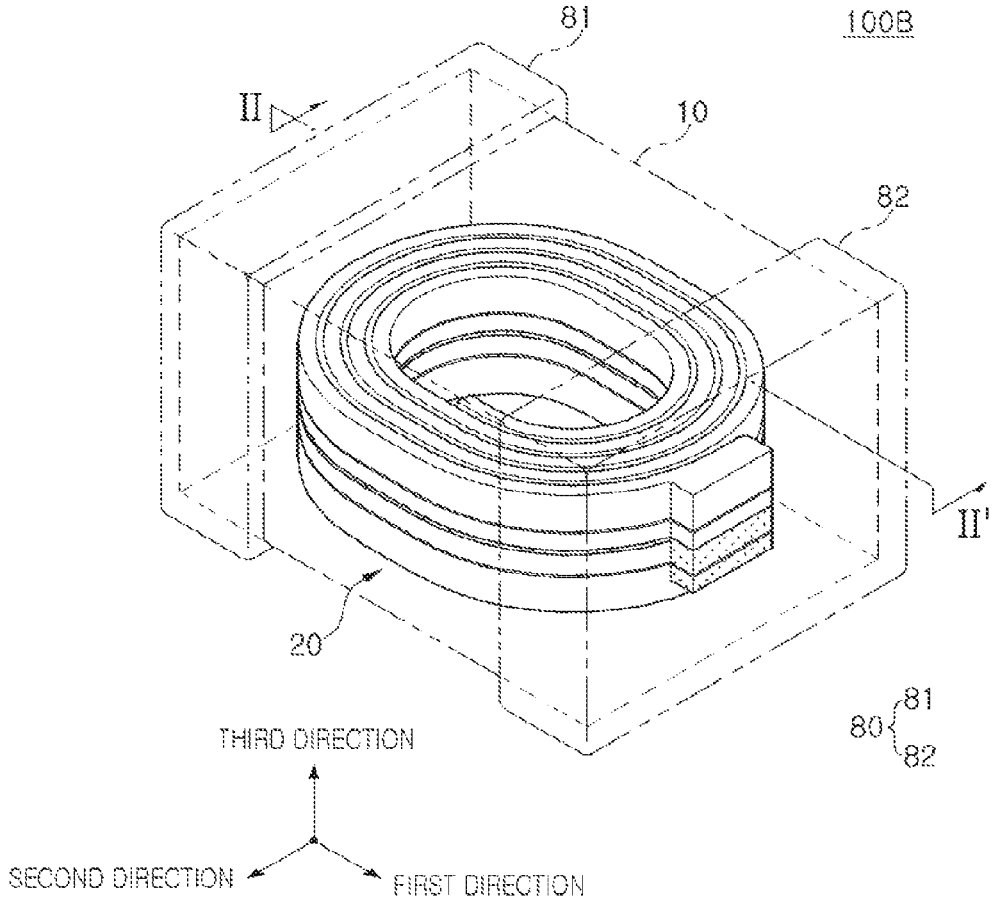
FIG. 12 is a schematic perspective view illustrating another example of a coil component.

FIG. 12 is a schematic perspective view illustrating another example of a coil component 100B.

Figure 13:
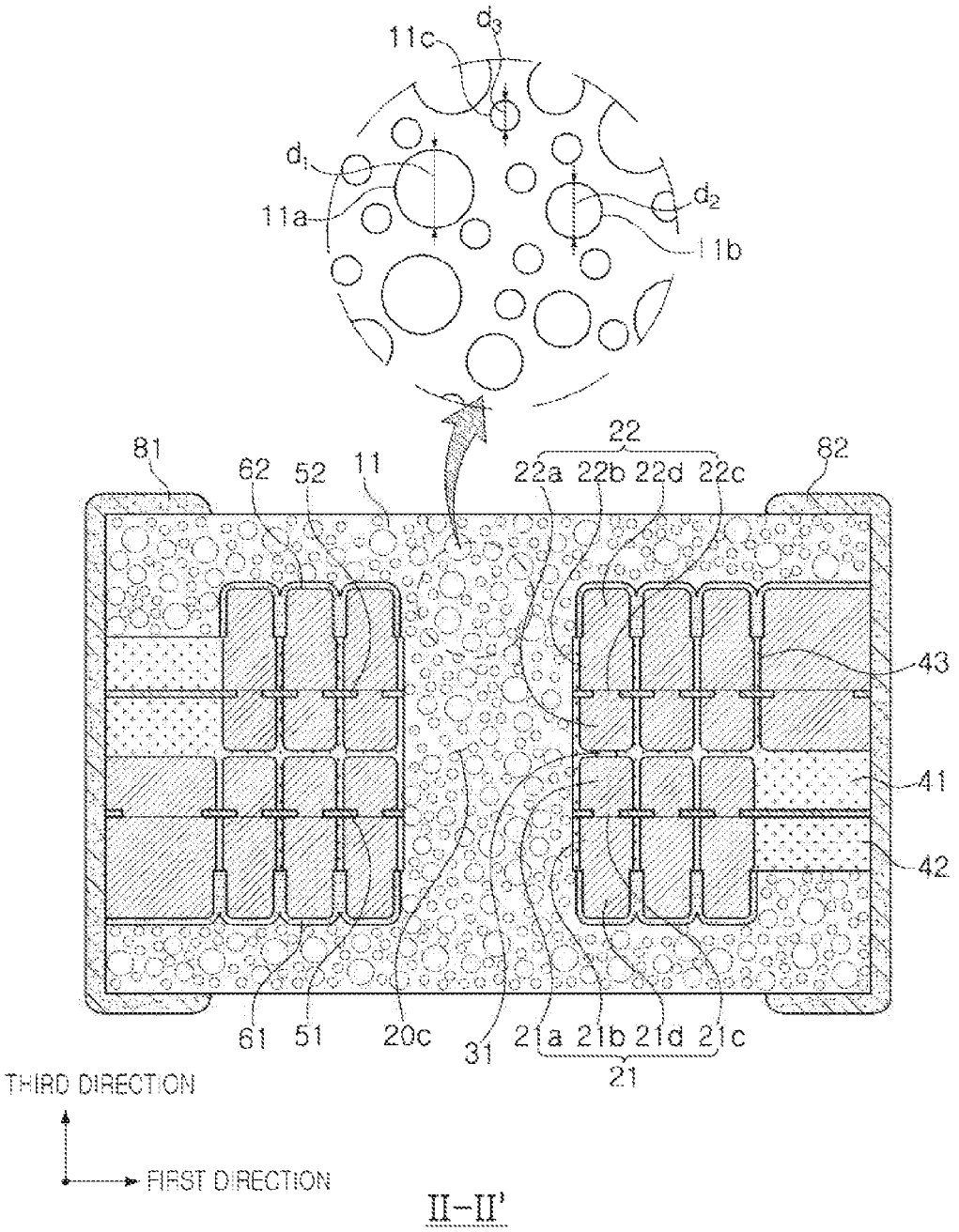
FIG. 13 is a schematic cross-sectional view of the coil component of FIG. 12 taken along line II-II'.

FIG. 13 is a schematic cross-sectional view of the coil component 100B taken along line II-II' of FIG. 12.

Hereinafter, a coil component 100B according to another exemplary embodiment in the present disclosure will be described, but descriptions of contents overlapping the contents described above will be omitted and contents different from the contents described above will mainly be described.

Referring to the drawings, in the coil component 100B according to another exemplary embodiment, a first coil layer 21 and a second coil layer 22 of a coil portion 20 may further include, respectively, fourth conductors 21*d* and 22*d* disposed on second conductors 21*b* and 22*b* and directly connected to the second conductors 21*b* and 22*b*. In addition, the coil portion 20 may further include a second resin layer 42 in which the second conductor 21*b* of the first coil layer 21 is embedded, a third resin layer 43 in which the second conductor 22*b* of the second coil layer 22 is embedded, a first insulating layer 51 disposed between a first resin layer 41 and the second resin layer 42, and a second insulating layer 52 disposed between the first resin layer 41 and the third resin layer 43. First and second insulating films 61 and 62 may cover a surface of the fourth conductor 21*d* of the first coil layer 21 and a surface of the fourth conductor 22*d* of the second coil layer 22, respectively.

The first and second coil layers 21 and 22 may further include the fourth conductors 21*d* and 22*d*, respectively, and thus, have a high aspect ratio (AR). Materials of the fourth conductors 21*d* and 22*d* may be a conductive material such as copper (Cu), aluminum (Al), silver (Ag), tin (Sn), gold (Au), nickel (Ni), lead (Pb), titanium (Ti), or alloys thereof, but are not limited thereto. That is, in the coil component 100B according to the other exemplary embodiment, the first and second coil layers 21 and 22 may have forms in which first to fourth conductors 21*a*, 21*b*, 21*c*, 21*d*, 22*a*, 22*b*, 22*c*, and 22*d* having a planar spiral shape are stacked, respectively. The fourth conductors 21*d* and 22*d* of the first and second coil layers 21 and 22 and the second conductors 21*b* and 22*b* of the first and second coil layers 21 and 22 may be formed by separate processes. Therefore, even in a case in which the second conductors 21*b* and 22*b* and the fourth conductors 21*d* and 22*d* include the same material, a boundary may be present between the second conductors 21*b* and 22*b* and the fourth conductors 21*d* and 22*d*.

The second and third resin layers 42 and 43 may embed the second conductor 21*b* of the first coil layer 21 and the second conductor 22*b* of the second coil layer 22, respectively, therein. The second and third resin layers 42 and 43 may have thicknesses (measured in the third direction) that are at least as large as thicknesses of the second conductor 21*b* of the first coil layer 21 and the second conductor 22*b* of the second coil layer 22, respectively. A known insulating material may be used as a material of each of the second and third resin layers 42 and 43, and a photoimageable dielectric (PID) may be used as the material of each of the second and third resin layers 42 and 43, if necessary. However, the material of each of the second and third resin layers 42 and 43 is not limited thereto. A magnetic film, for example, a curable insulating material containing a magnetic filler may also be used as the material of each of the second and third resin layers 42 and 43, if necessary. In this case, magnetic density of the coil component 100B may be increased. The second and third resin layers 42 and 43 may have a thickness greater than those of the first and second insulating layers 51 and 52.

FIGS. 14 through 23 are schematic views illustrating an exemplary process of manufacturing the coil component of FIG. 12.

Hereinafter, a method of manufacturing a coil component according to another exemplary embodiment in the present disclosure will be described, but descriptions of contents overlapping the contents described above will be omitted and contents different from the contents described above will be mainly described.

Figure 14:
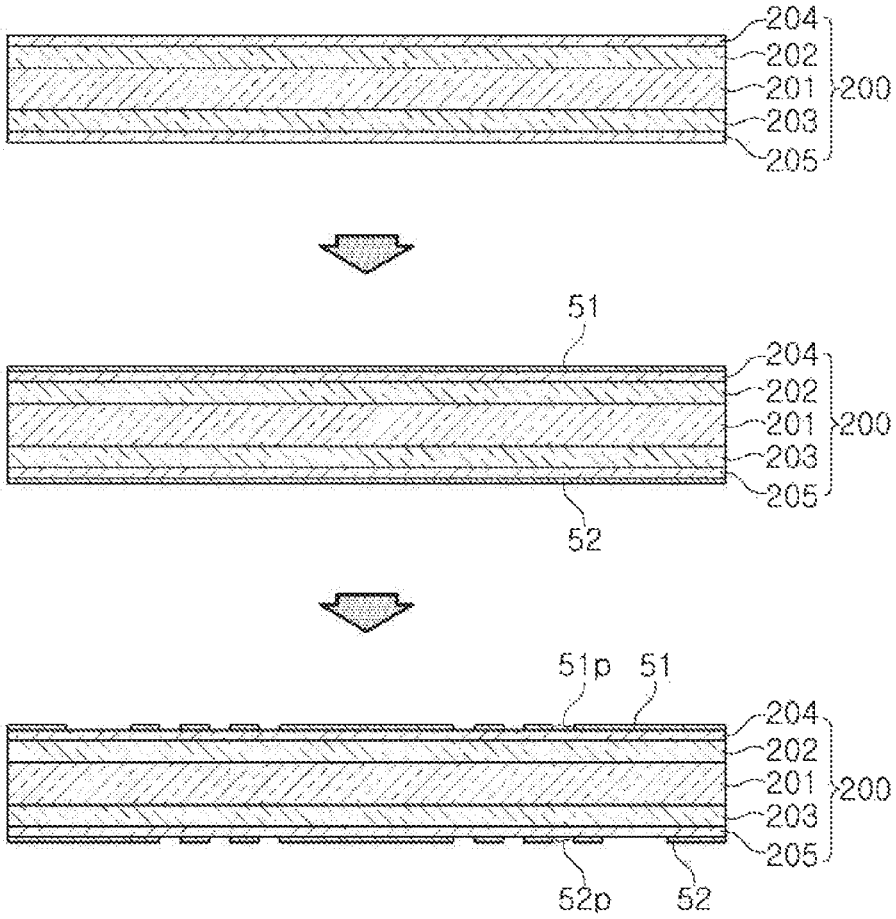
FIGS. 14 through 23 are schematic views illustrating an exemplary process of manufacturing the coil component of FIG. 12.

Referring to FIG. 14, a substrate 200 may be first prepared. Next, the first and second insulating layers 51 and 52 may be formed, respectively, on second metal layers 204 and 205 disposed on both sides of the substrate 200. Next, patterns 51P and 52P having a planar spiral shape may be formed on the first and second insulating layers 51 and 52, respectively.

Figure 15:
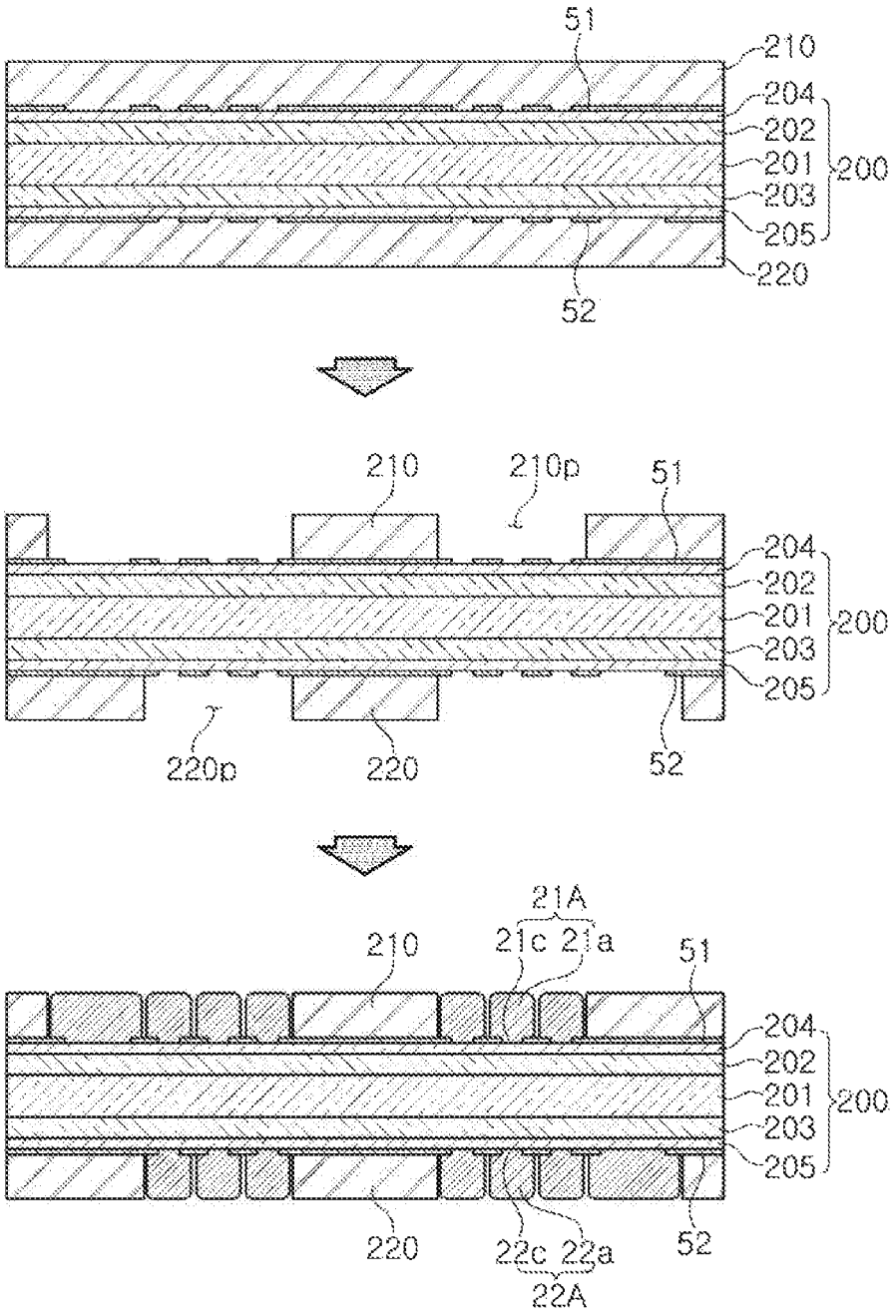

Referring to FIG. 15, dry films 210 and 220 may be formed on the first and second insulating layers 51 and 52, respectively. Next, dams 210P and 220P for a plating process, the subsequent process, may be formed in the dry films 210 and 220, respectively, by a known photolithography method. Next, first plating layers 21A and 22A may be formed, respectively, on the second metal layers 204 and 205 exposed through the patterns formed on the first and second insulating layers 51 and 52 and having the planar spiral shape and disposed on both sides of the substrate 200.

Figure 16:
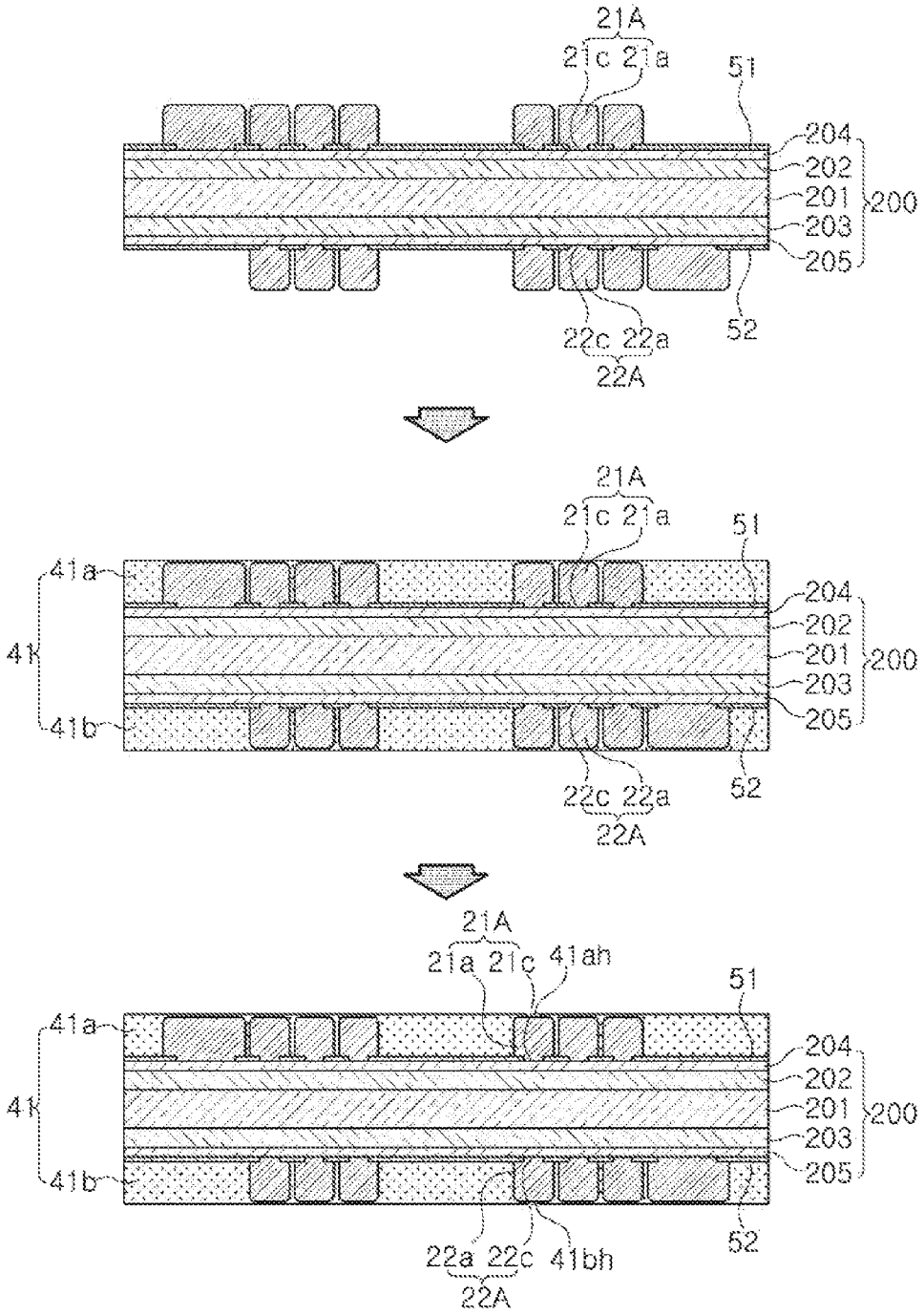

Referring to FIG. 16, the dry films 210 and 220 may be stripped. Next, resin layers 41*a* and 41*b* may be formed on the first plating layers 21A and 22A, respectively. Next, vias 41*ah* and 41*bh* connected to the first plating layers 21A and 22A may be formed in the resin layers 41*a* and 41*b*, respectively.

Figure 17:
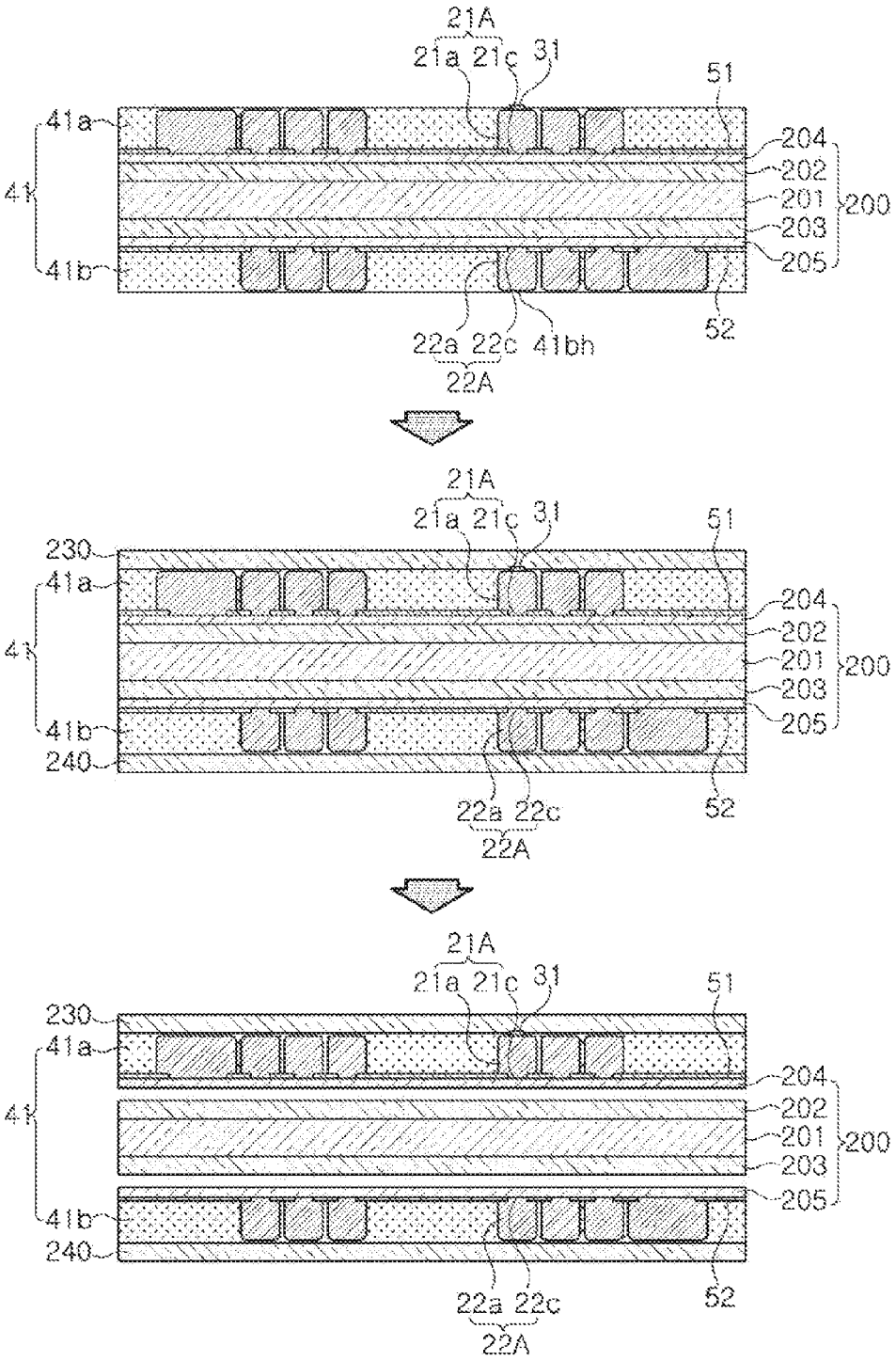

Referring to FIG. 17, a first bump 31 may be formed in at least one of the vias 41*ah* and 41*bh* formed in the resin layers 41*a* and 41*b*. Next, black masks 230 and 240 may be formed on the resin layers 41*a* and 41*b*, respectively, in order to protect the first bump 31. Next, the second metal layers 204 and 205 may be separated from the support member 201.

Figure 18:
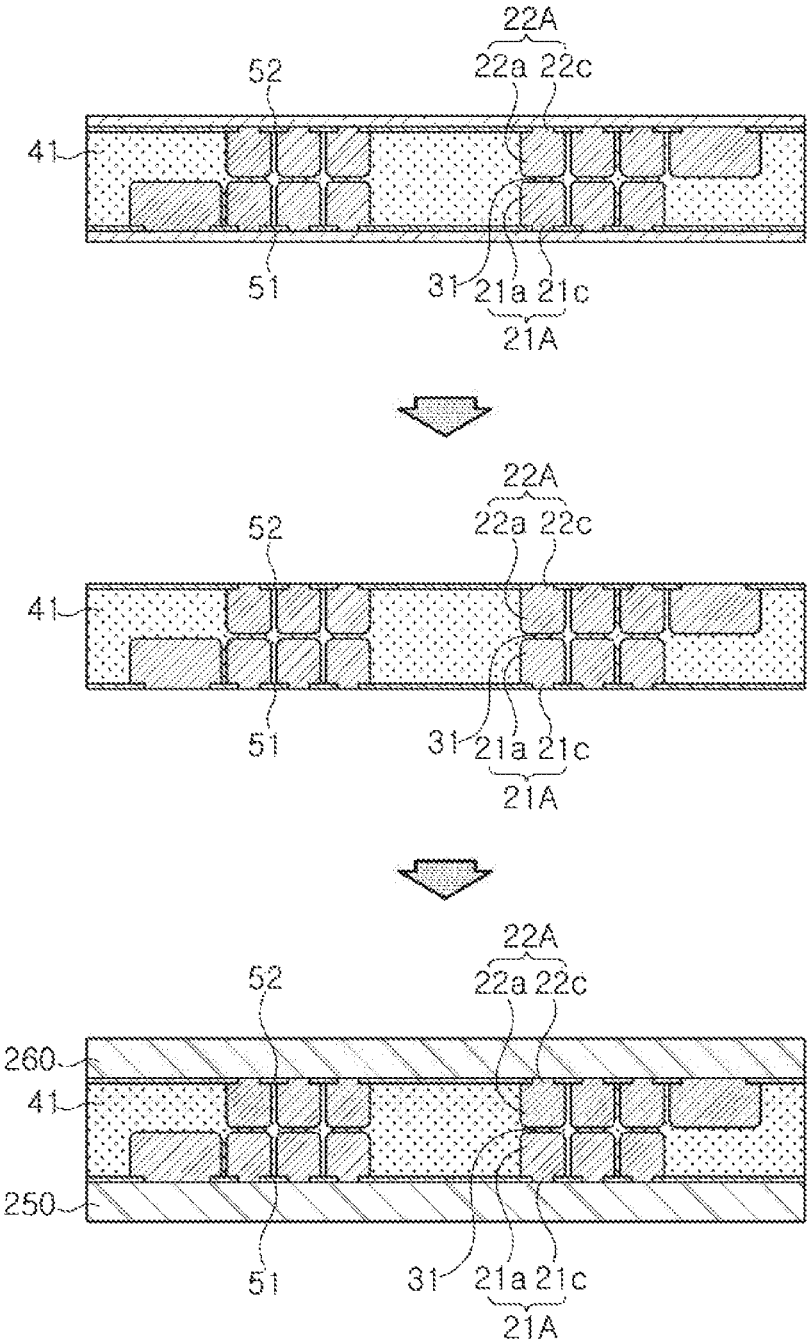

Referring to FIG. 18, the respective resin layers 41*a* and 41*b* may be matched with each other and stacked so that the vias 41*ah* and 41*bh* formed in the respective resin layers 41*a* and 41*b* are connected to each other. Next, the second metal layers 204 and 205 remaining on the first and second insulating layers 51 and 52 may be removed. Next, dry films 250 and 260 may be formed on portions from which the second metal layers 204 and 205 have been removed.

Figure 19:
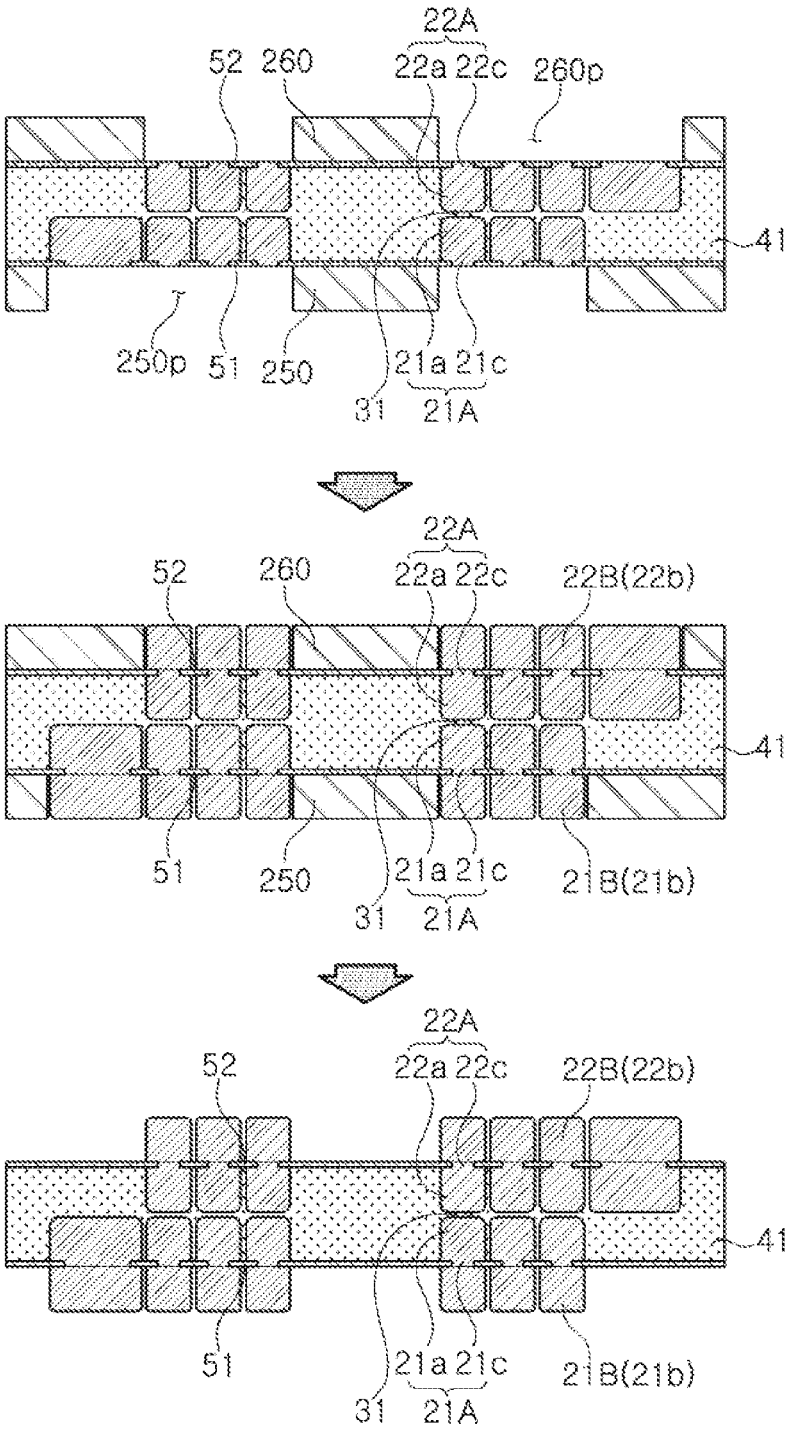

Referring to FIG. 19, dams 250P and 260P for a plating process, the subsequent process, may be formed in the dry films 250 and 260, respectively, by a known photolithography method. Next, second plating layers 21B and 22B may be formed, respectively, on the third conductors 21*c* and 22*c* of the first plating layers 21A and 22A exposed through the dams 250P and 260P. Next, the dry films 250 and 260 may be stripped.

Figure 20:
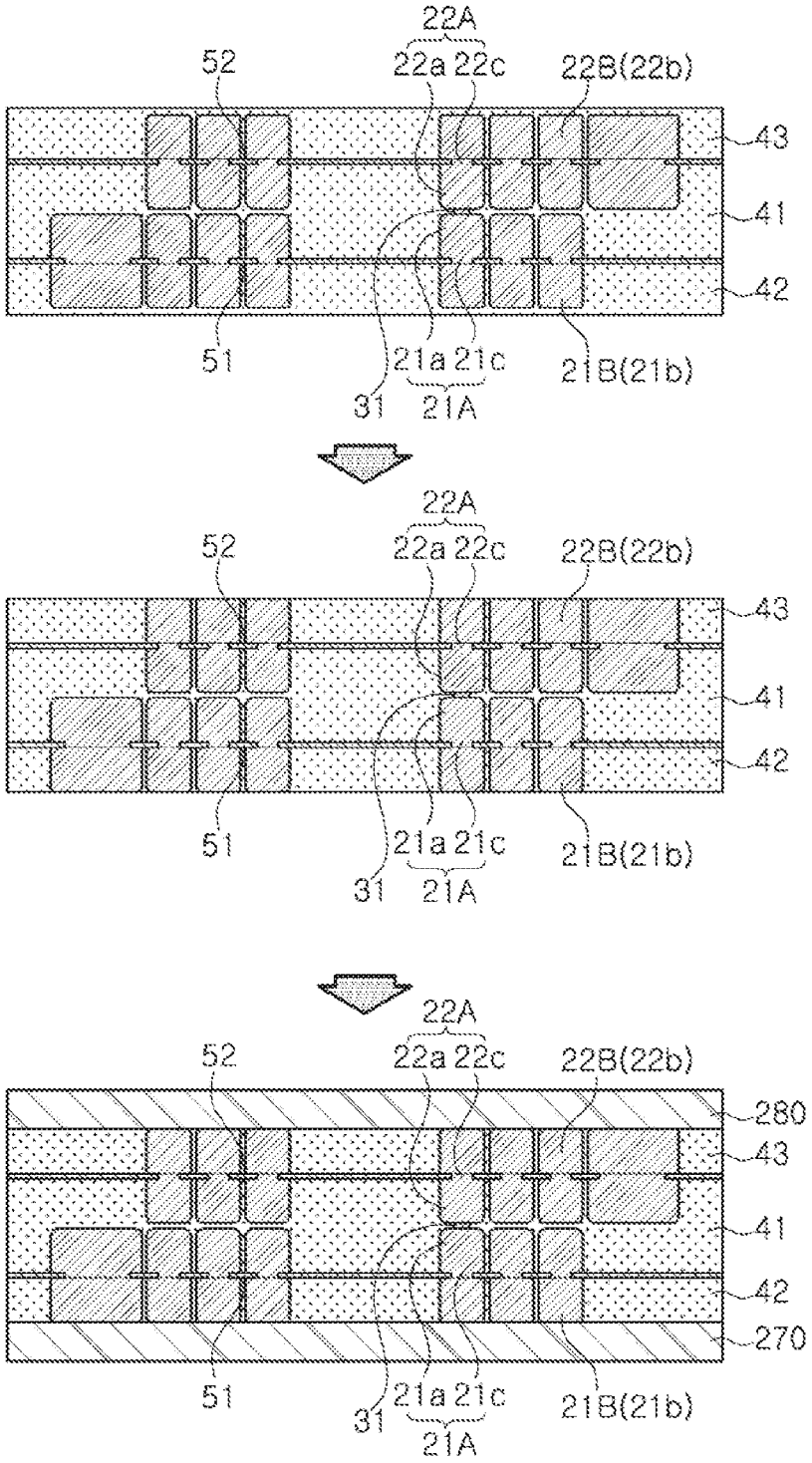

Referring to FIG. 20, the second and third resin layers 42 and 43 embedding the second conductors 21*b* and 22*b* of the first and second coil layers 21 and 22, respectively, therein may be formed on the first and second insulating layers 51 and 52, respectively. The second and third resin layers 42 and 43 may be formed by a method of laminating an insulating material such as a photoimageable dielectric (PID) at a predetermined thickness such as about 80 μm to 150 μm. Alternatively, the second and third resin layers 42 and 43 may also be formed by a method of laminating a magnetic film having a predetermined thickness such as about 80 μm to 150 μm, for example, a curable film containing a magnetic filler. Next, surfaces of the second and third resin layers 42 and 43 may be planarized by a known method to expose the second conductors 21*b* and 22*b* of the second plating layers 21B and 22B. Next, dry films 270 and 280 may be formed on the second and third resin layers 42 and 43, respectively. A method of forming the dry films 270 and 280 is also not particularly limited. For example, the dry films 270 and 280 may be formed by laminating materials of the dry films 270 and 280 having a predetermined thickness such as about 80 μm to 150 μm by a known method.

Figure 21:
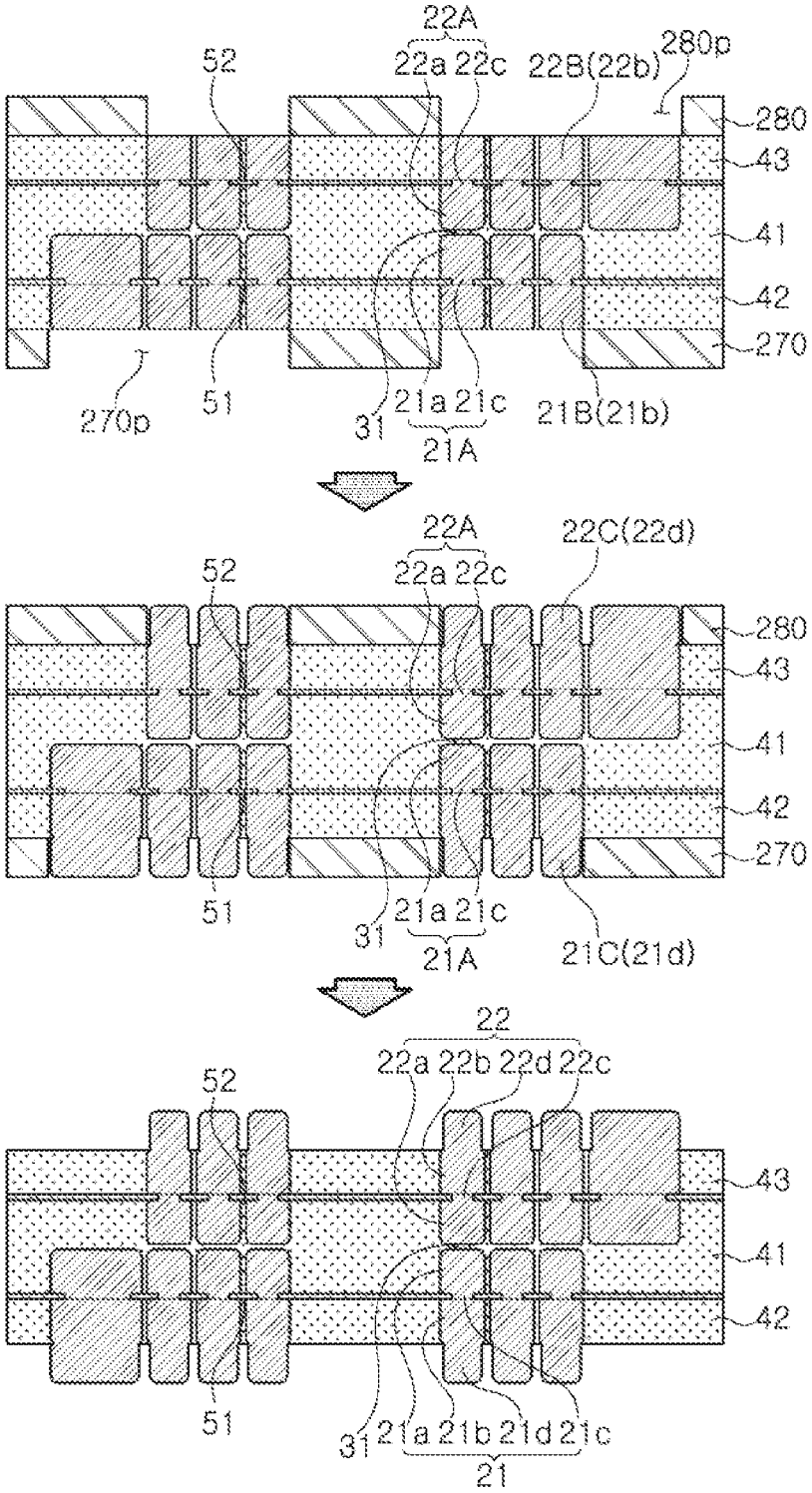

Referring to FIG. 21, dams 270P and 280P for a plating process, the subsequent process, may be formed in the dry films 270 and 280, respectively, by a known photolithography method. The dams 270P and 280P may be formed by, for example, anisotropic plating, but are not limited thereto. Next, third plating layers 21C and 22C may be formed on the exposed second conductors 21*b* and 22*b* of the second plating layers 21B and 22B, respectively, by a known plating method such as anisotropic electroplating using the exposed second conductors 21*b* and 22*b* as seed layers. The third plating layers 21C and 22C may include the fourth conductors 21*d* and 22*d*, respectively. Line widths of the fourth conductors 21*d* and 22*d* of the third plating layers 21C and 22C may be approximately 80 μm to 120 μm, thicknesses of the fourth conductors 21*d* and 22*d* of the third plating layers 21C and 22C may be approximately 80 μm to 120 μm, intervals between lines of the fourth conductors 21*d* and 22*d* of the third plating layers 21C and 22C may be approximately 2 μm to 5 μm, and aspect ratios (measured as ratios of the height, measured in the third direction, divided by the width, measured in the first direction) of patterns of the fourth conductors 21*d* and 22*d* of the third plating layers 21C and 22C may be about 0.8 to 1.5, but are not limited thereto. The first to third plating layers 21A, 22A, 21B, 22B, 21C, and 22C may be connected to each other to form the first and second coil layers 21 and 22, respectively. Next, the dry films 270 and 280 may be stripped. The dry films 270 and 280 may be stripped by a known etching method, but the present disclosure is not limited thereto.

Figure 22:
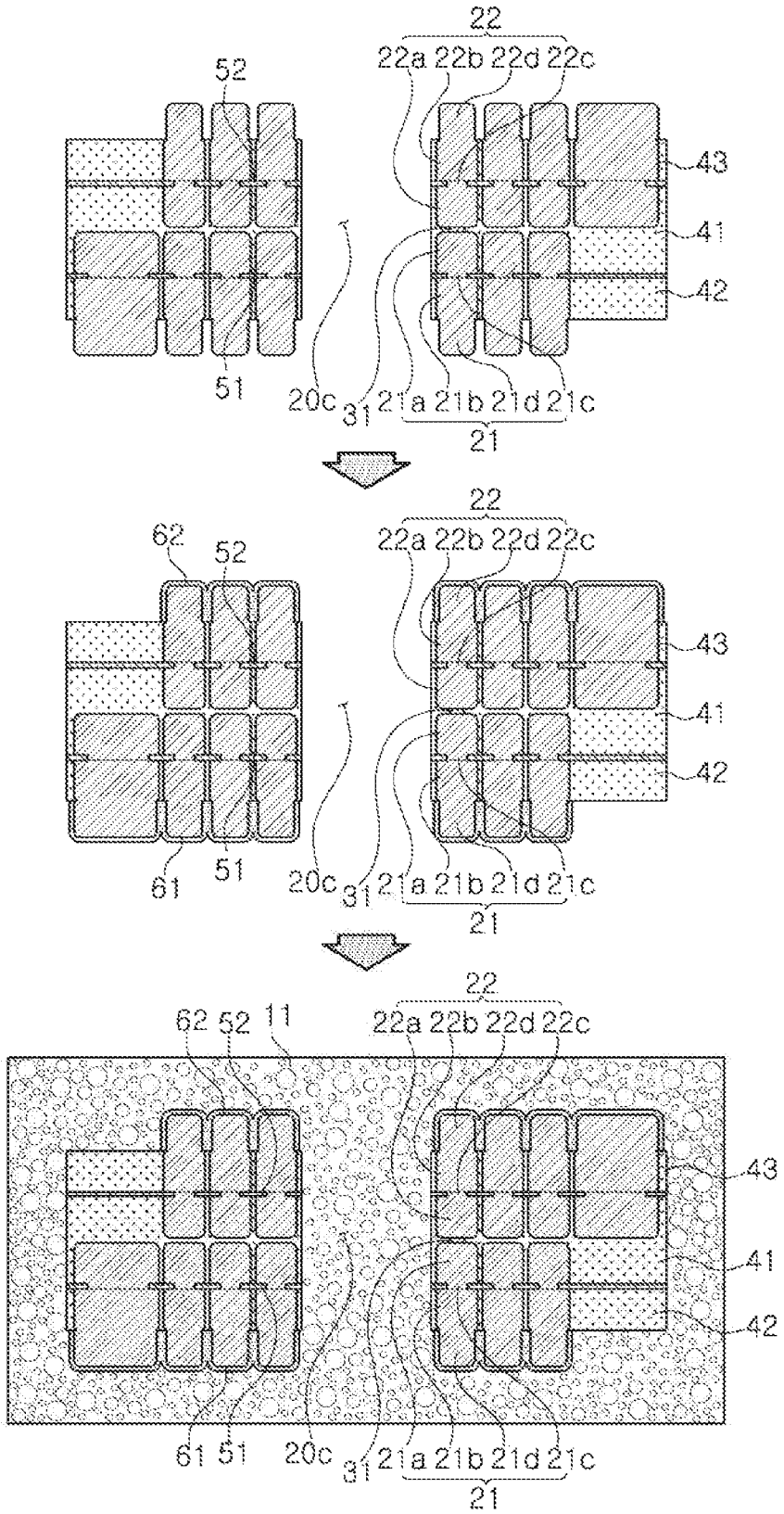

Referring to FIG. 22, a through-hole penetrating through central portions of the first to third resin layers 41 to 43 and the first and second insulating layers 51 and 52 may be formed. A region in which the through-hole is formed may be a core region 20*c* of the coil portion 20. Next, the first and second insulating films 61 and 62 covering, respectively, surfaces of the fourth conductors 21*d* and 22*d* of the first and second coil layers 21 and 22 may be formed. Next, the magnetic material 11 may cover the upper portion and the lower portion of the coil portion 20 and fill the through-hole formed in the central portion.

Figure 23:
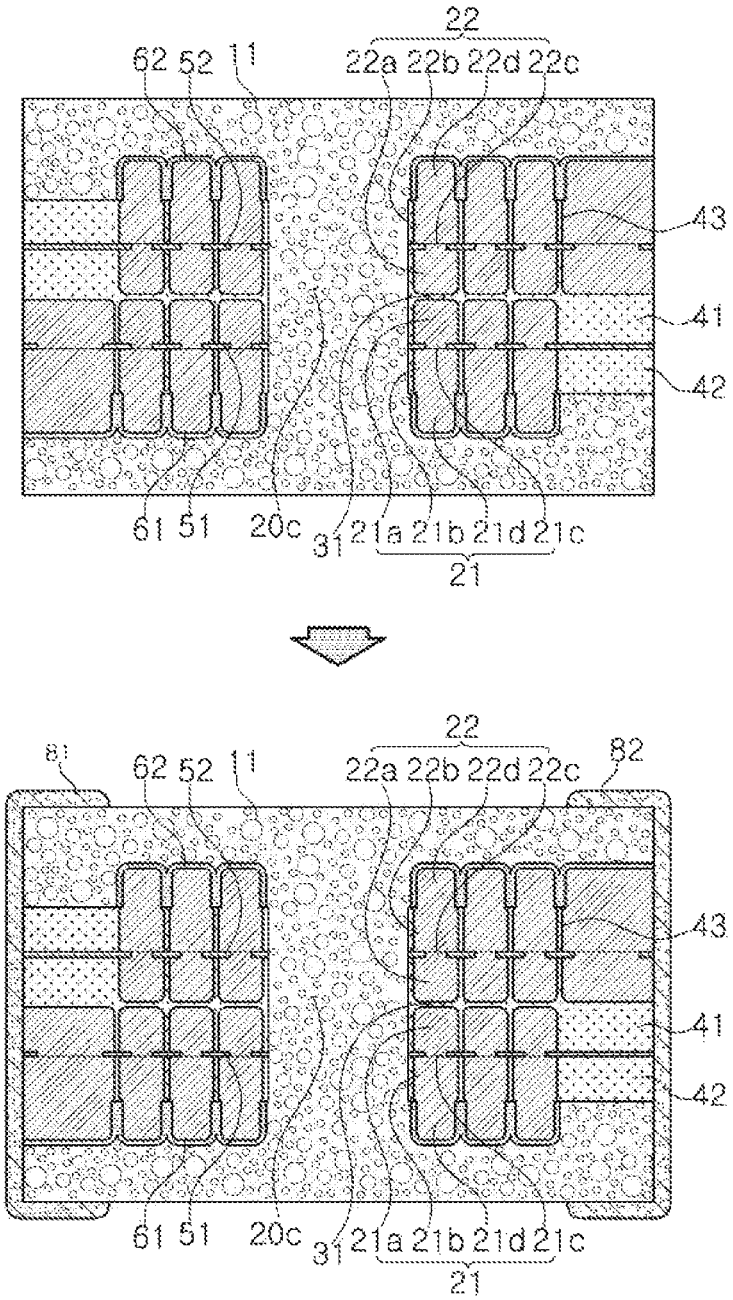

Referring to FIG. 23, the body portion 10 may be diced at a desired size and polished. Next, the first and second electrodes 81 and 82 covering at least the first and second surfaces of the body portion 10 so as to be connected, respectively, to the first and second lead terminals (not denoted by reference numerals) of the coil portion 20 may be formed. The electrode portion 80 may be formed through a series of processes.

Figure 24:
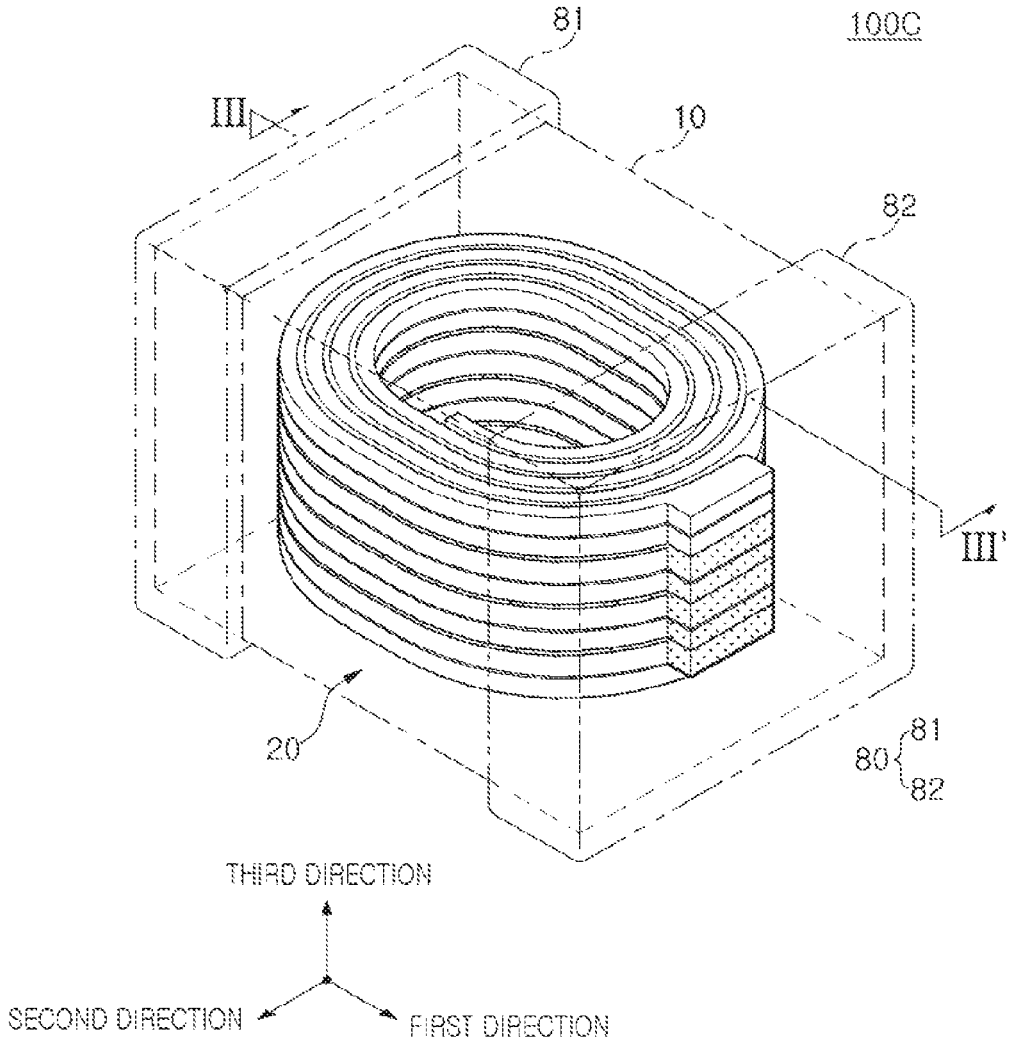
FIG. 24 is a schematic perspective view illustrating another example of a coil component.

FIG. 24 is a schematic perspective view illustrating another example of a coil component.

Figure 25:
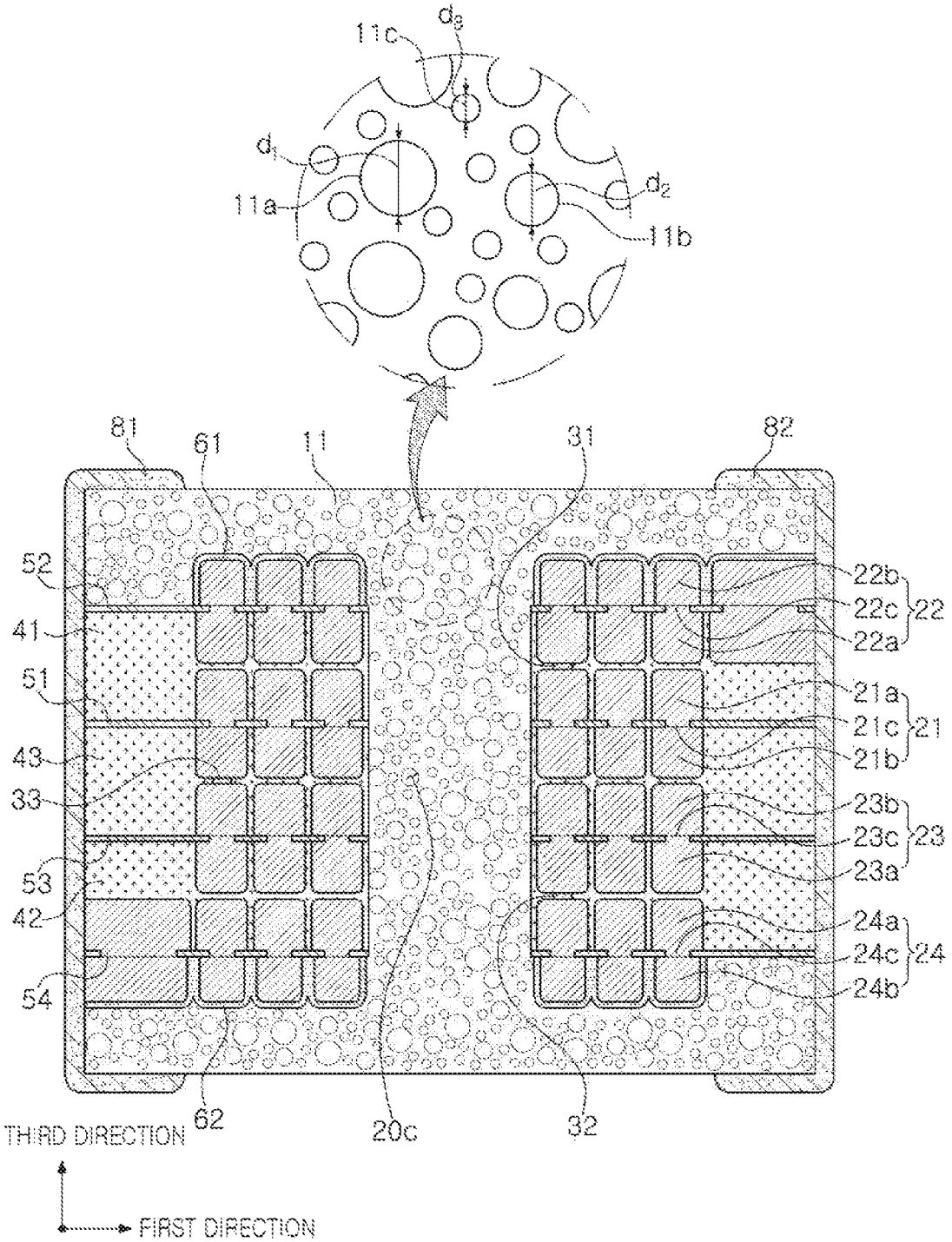
FIG. 25 is a schematic cross-sectional view of the coil component of FIG. 24 taken along line III-III'.

FIG. 25 is a schematic cross-sectional view of the coil component taken along line of FIG. 24.

Hereinafter, a coil component according to another exemplary embodiment in the present disclosure will be described, but descriptions of contents overlapping the contents described above will be omitted and contents different from the contents described above will be mainly described.

Referring to the drawings, in the coil component 100C according to the other exemplary embodiment, a coil portion 20 may further include a third coil layer 23 in which first to third conductors 23*a*, 23*b*, and 23*c* each having a planar spiral shape are stacked, a fourth coil layer 24 in which first to third conductors 24*a*, 24*b*, and 24*c* each having a planar spiral shape are stacked, a second bump 32 disposed between the third and fourth coil layers 23 and 24 to electrically connect the third and fourth coil layers 23 and 24 to each other, and a third bump 33 disposed between the first and third coil layers 21 and 23 to electrically connect the first and third coil layers 21 and 23 to each other. In addition, the coil portion 20 may further include a second resin layer 42 in which the first conductor 23*a* of the third coil layer 23 and the first conductor 24*a* of the fourth coil layer 24 are embedded, a third resin layer 43 in which the second conductor 21*b* of the first coil layer 21 and the second conductor 23*b* of the third coil layer 23 are embedded, a third insulating layer 53 disposed between the first and second conductors 23*a* and 23*b* of the third coil layer 23, and a fourth insulating layer 54 disposed between the first and second conductors 24*a* and 24*b* of the fourth coil layer 24. First and second insulating films 61 and 62 may cover a surface of the second conductor 21*b* of the first coil layer 21 and a surface of the second conductor 24*b* of the fourth coil layer 24, respectively.

The third and fourth coil layers 23 and 24 may also have a form in which the first to third conductors 23*a*, 24*a*, 23*b*, 24*b*, 23*c*, and 24*c* having a planar spiral shape are stacked, similar to the first and second coil layers 21 and 22, and detailed contents of the third and fourth coil layers 23 and 24 may be the same as those of the first and second coil layers 21 and 22. The first to fourth coil layers 21 to 24 may be electrically connected to each other through the first to third bumps 31 to 33, thereby forming a single coil of which turns are increased in the horizontal and vertical directions. The coil may include more coil layers 21 to 24, such that greater inductance may be implemented.

The second and third bumps 32 and 33 may also be formed by electroplating, paste printing, or the like, similar to the first bump 31, and materials of the second and third bumps 32 and 33 may be, for example, tin (Sn)/copper (Cu), tin (Sn)-sliver (Ag)/copper (Cu), copper (Cu) coated with silver (Ag)/tin (Sn), copper (Cu)/tin (Sn)-bismuth (Bi), or the like, but is not limited thereto. The second and third bumps 32 and 33 may also include an intermetallic compound (IMC). The intermetallic compound (IMC) may be formed in a high temperature vacuum pressing process among processes of manufacturing the coil component 100C. The intermetallic compound (IMC) may increase interlayer connection strength and decrease conduction resistance to enable a smooth flow of electrons. The second bump 32 may penetrate through the second resin layer 42 between the first conductor 23*a* of the third coil layer 23 and the first conductor 24*a* of the fourth coil layer 24, and the third bump 33 may penetrate through the third resin layer 43 between the second conductor 21*b* of the first coil layer 21 and the second conductor 23*b* of the third coil layer 23.

A known insulating material may be used as a material of each of the second and third resin layers 42 and 43, and a photoimageable dielectric (PID) may be used as the material of each of the second and third resin layers 42 and 43, if necessary. However, the material of each of the second and third resin layers 42 and 43 is not limited thereto. A magnetic film, for example, a curable insulating material containing a magnetic filler may also be used as the material of each of the second and third resin layers 42 and 43, if necessary. In this case, magnetic density of the coil component 100C may be increased. The second and third resin layers 42 and 43 may have a thickness greater than those of the first to fourth insulating layers 51 to 54.

The third and fourth coil layers 23 and 24 in which the plurality of conductors 23*a*, 23*b*, 23*c*, 24*a*, 24*b*, and 24*c* having the planar spiral shape are stacked may be formed on both sides of the third and fourth insulating layers 53 and 54, respectively, by applying anisotropic plating technology. Therefore, the third and fourth coil layers 23 and 24 may be implemented to have a cross-sectional shape having a high aspect ratio (AR), such as a substantially dumbbell shape, without a defect such as a short-circuit, or the like. A known insulating material may be used as materials of the third and fourth insulating layers 53 and 54. Particularly, a photoimageable dielectric (PID) may be used as the materials of the third and fourth insulating layers 53 and 54. However, the materials of the third and fourth insulating layers 53 and 54 are not limited thereto. The third conductors 23*c* and 24*c* of the third and fourth coil layers 23 and 24 may penetrate through the third and fourth insulating layers 53 and 54, respectively. In a case in which the photoimageable dielectric (PID) is used as the materials of the third and fourth insulating layers 53 and 54, patterns having a planar spiral shape for forming the third conductors 23*c* and 24*c* of the third and fourth coil layers 23 and 24 may be formed by a known exposure and development method, that is, a photolithography method. Therefore, the patterns may be more easily and accurately formed. The third conductor 23*c* of the third coil layer 23 may penetrate through the third insulating layer 53, and the third conductor 23*d* of the fourth coil layer 24 may penetrate through the fourth insulating layer 54.

FIGS. 26 through 41 are schematic views illustrating an exemplary process of manufacturing the coil component of FIG. 24.

Hereinafter, a method of manufacturing a coil component according to another exemplary embodiment in the present disclosure will be described, but descriptions of contents overlapping the contents described above will be omitted and contents different from the contents described above will mainly be described.

Figure 26:
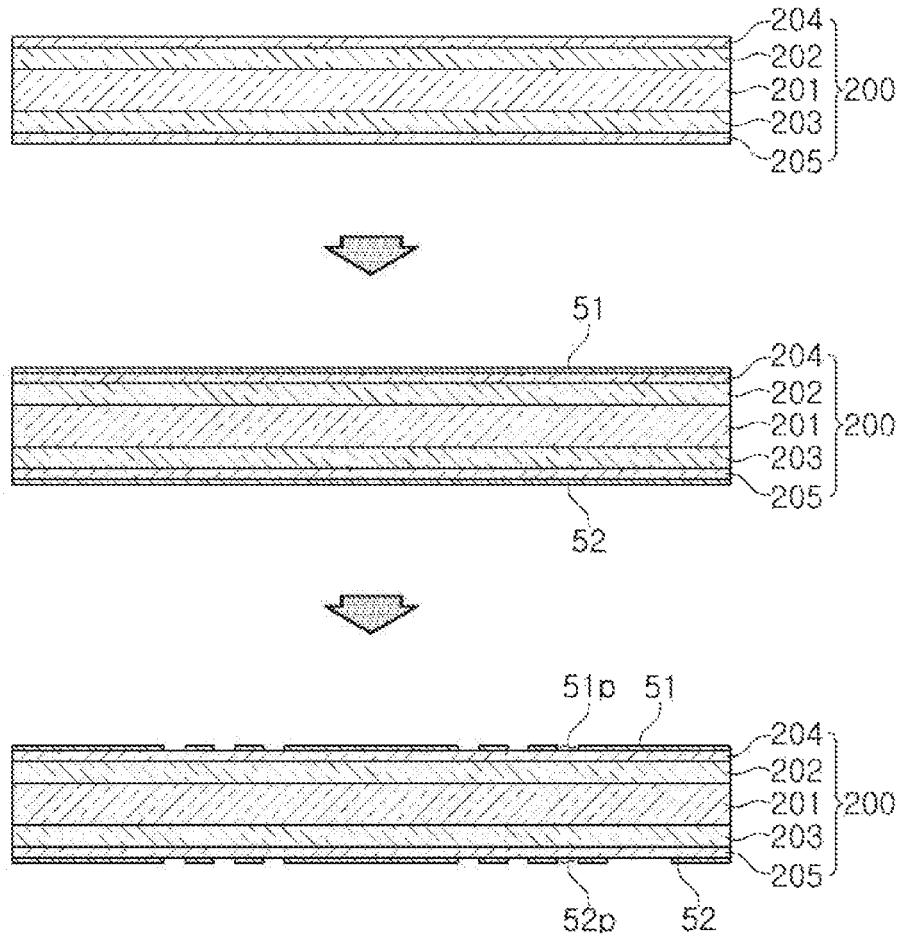
FIGS. 26 through 41 are schematic views illustrating an exemplary process of manufacturing the coil component of FIG. 24.

Referring to FIG. 26, a substrate 200 may first be prepared. Next, the first and second insulating layers 51 and 52 may be formed, respectively, on second metal layers 204 and 205 disposed on both sides of the substrate 200. Next, patterns 51P and 52P having a planar spiral shape may be formed on the first and second insulating layers 51 and 52, respectively.

Figure 27:
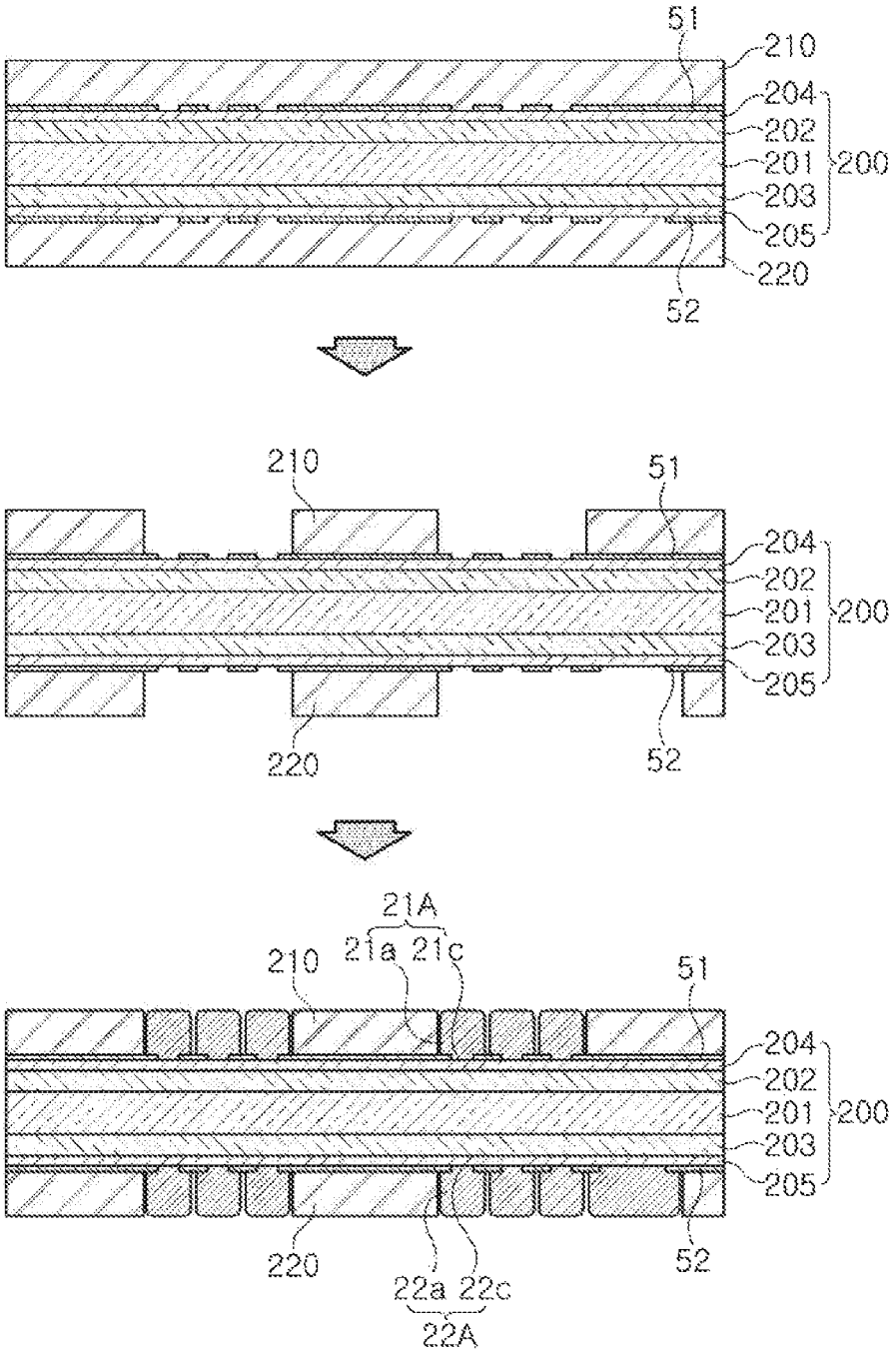

Referring to FIG. 27, dry films 210 and 220 may be formed on the first and second insulating layers 51 and 52, respectively. Next, dams 210P and 220P for a plating process, the subsequent process, may be formed in the dry films 210 and 220, respectively, using a known photolithography method. Next, first plating layers 21A and 22A may be formed, respectively, on the second metal layers 204 and 205 exposed through the patterns formed on the first and second insulating layers 51 and 52 and having the planar spiral shape and disposed on both sides of the substrate 200.

Figure 28:
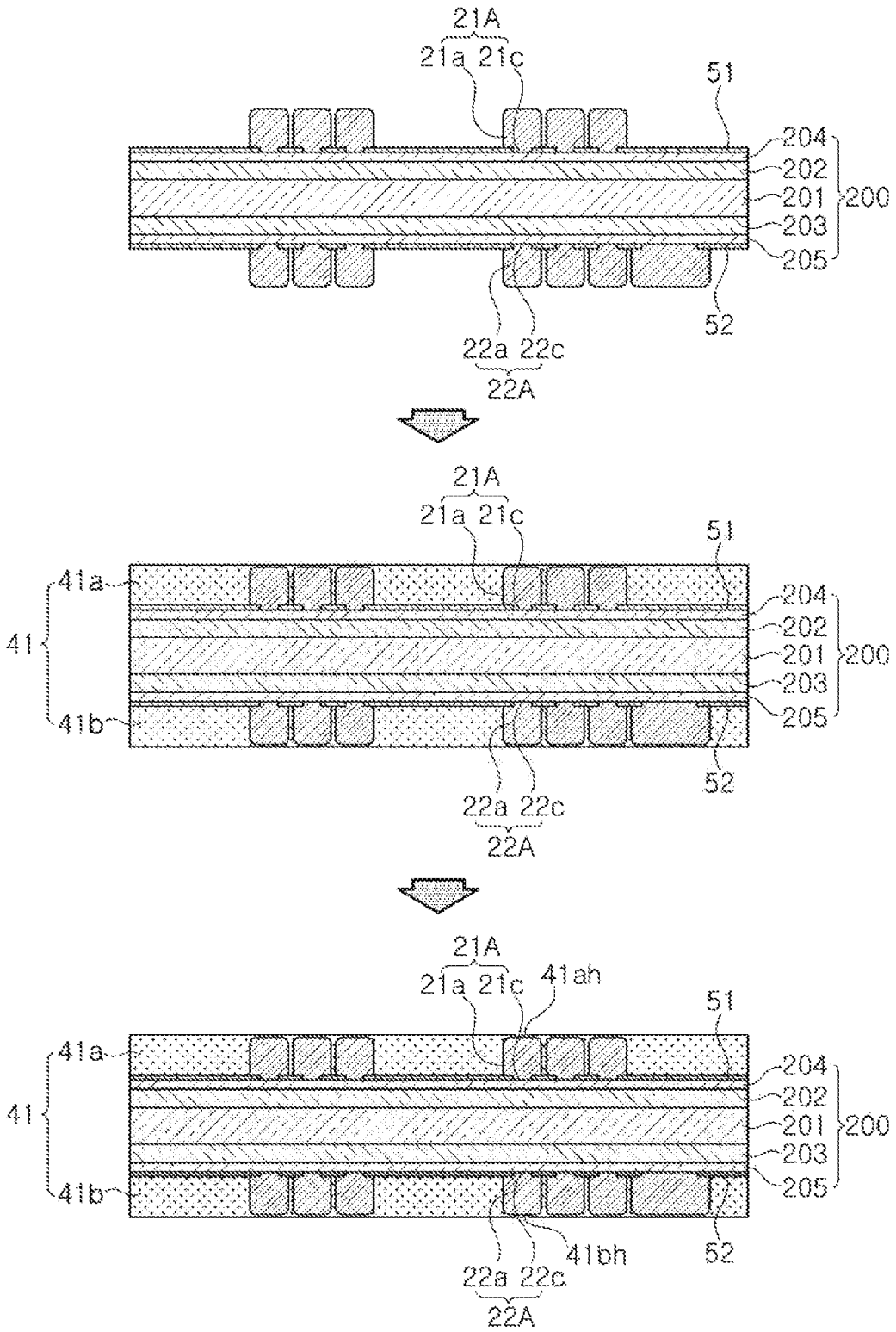

Referring to FIG. 28, the dry films 210 and 220 may be stripped. Next, resin layers 41*a* and 41*b* may be formed on the first plating layers 21A and 22A, respectively. Next, vias 41*ah* and 41*bh* connected to the first plating layers 21A and 22A may be formed in the resin layers 41*a* and 41*b*, respectively.

Figure 29:
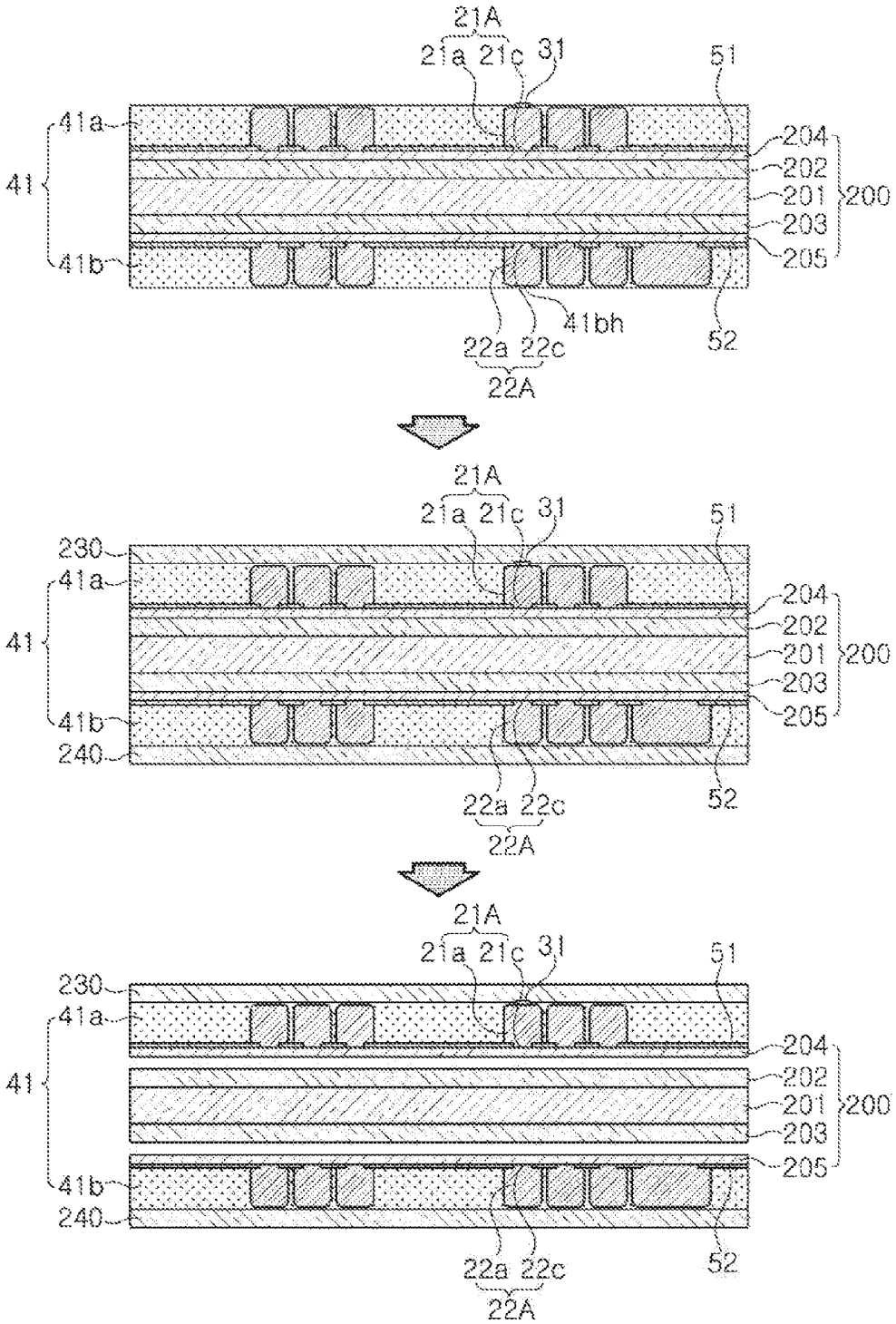

Referring to FIG. 29, a first bump 31 may be formed in at least one of the vias 41*ah* and 41*bh* formed in the resin layers 41*a* and 41*b*. Next, black masks 230 and 240 may be formed on the resin layers 41*a* and 41*b*, respectively, in order to protect the first bump 31. Next, the second metal layers 204 and 205 may be separated from the support member 201.

Figure 30:
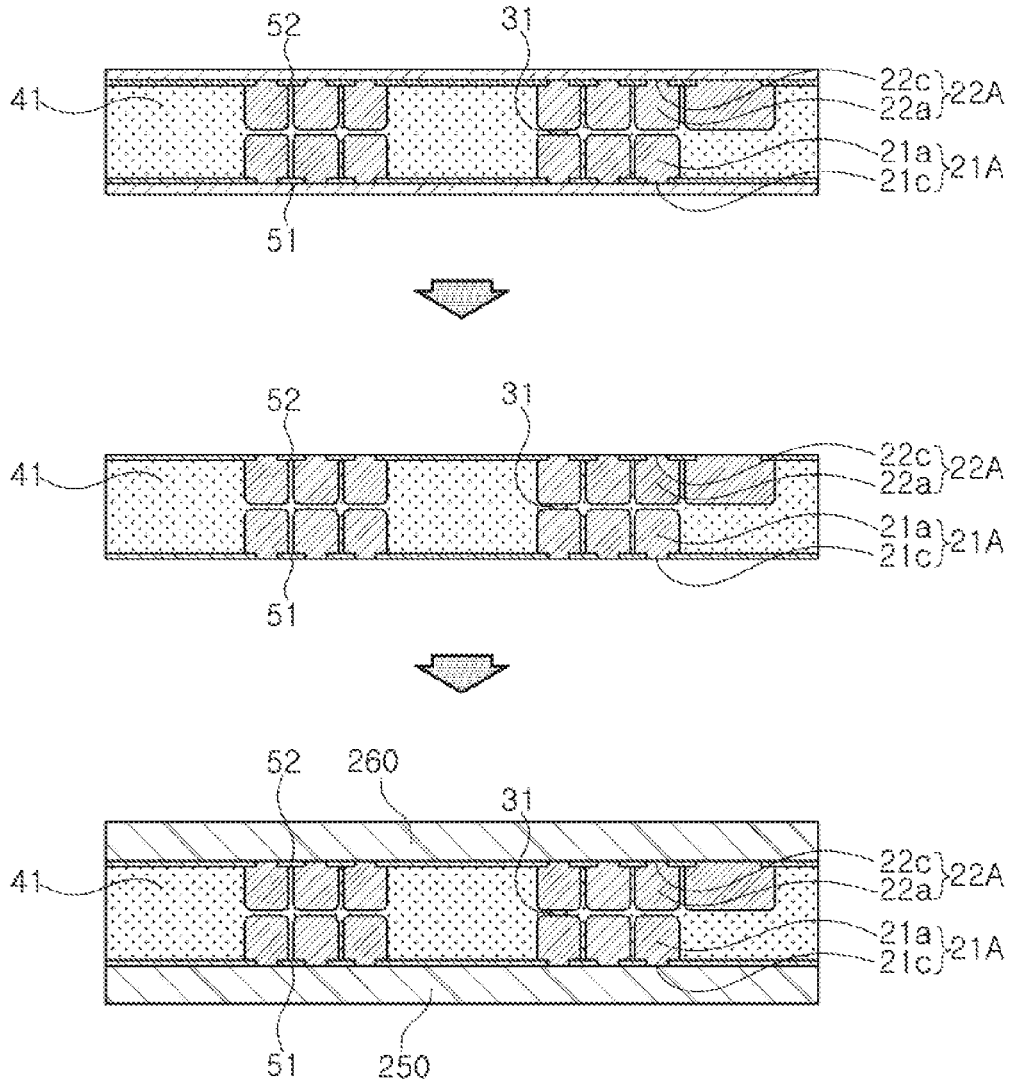

Referring to FIG. 30, the respective resin layers 41*a* and 41*b* may be matched with each other and stacked so that the vias 41*ah* and 41*bh* formed in the respective resin layers 41*a* and 41*b* are connected to each other. Next, the second metal layers 204 and 205 remaining on the first and second insulating layers 51 and 52 may be removed. Next, dry films 250 and 260 may be formed on portions from which the second metal layers 204 and 205 have been removed.

Figure 31:
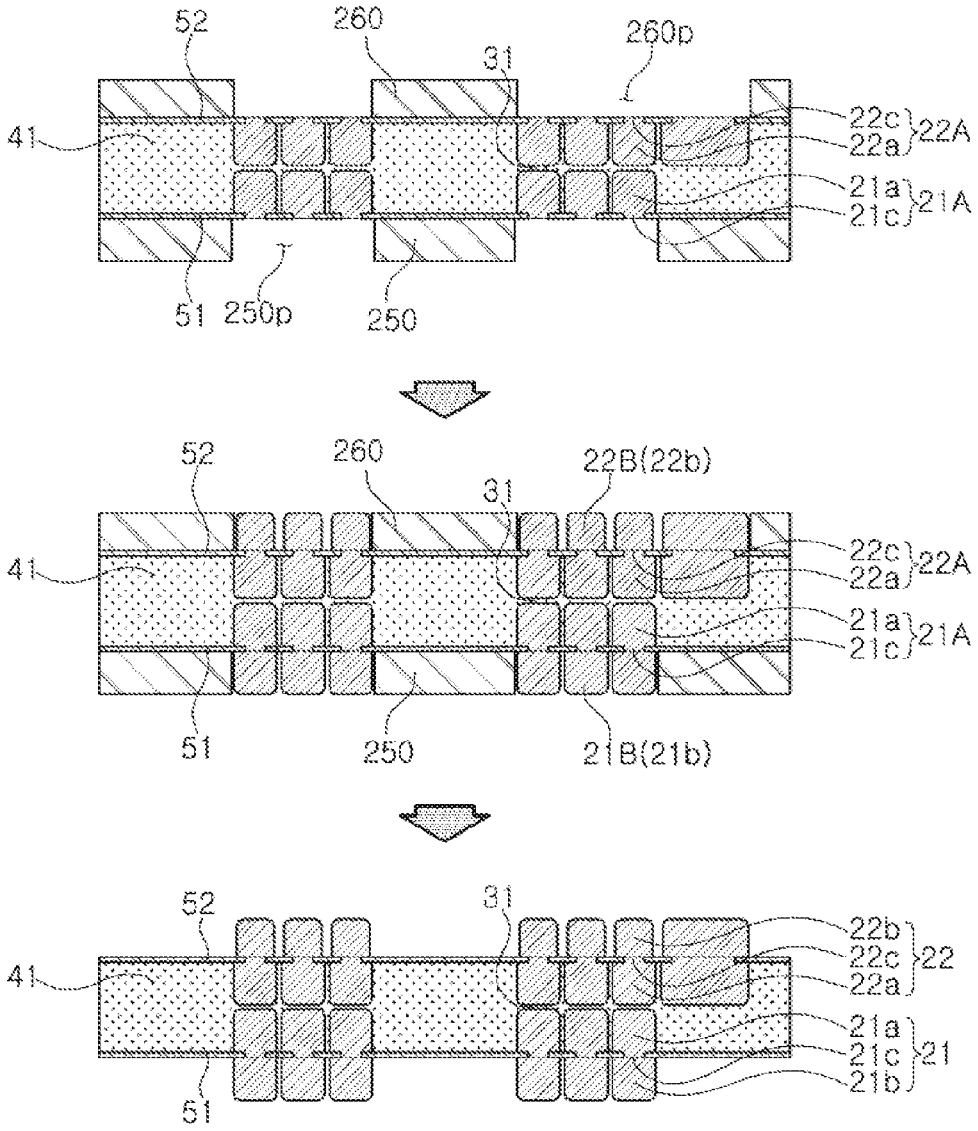

Referring to FIG. 31, dams 250P and 260P for a plating process, the subsequent process, may be formed in the dry films 250 and 260, respectively, by a known photolithography method. Next, second plating layers 21B and 22B may be formed, respectively, on the third conductors 21*c* and 22*c* of the first plating layers 21A and 22A exposed through the dams 250P and 260P. Next, the dry films 250 and 260 may be stripped.

Figure 32:
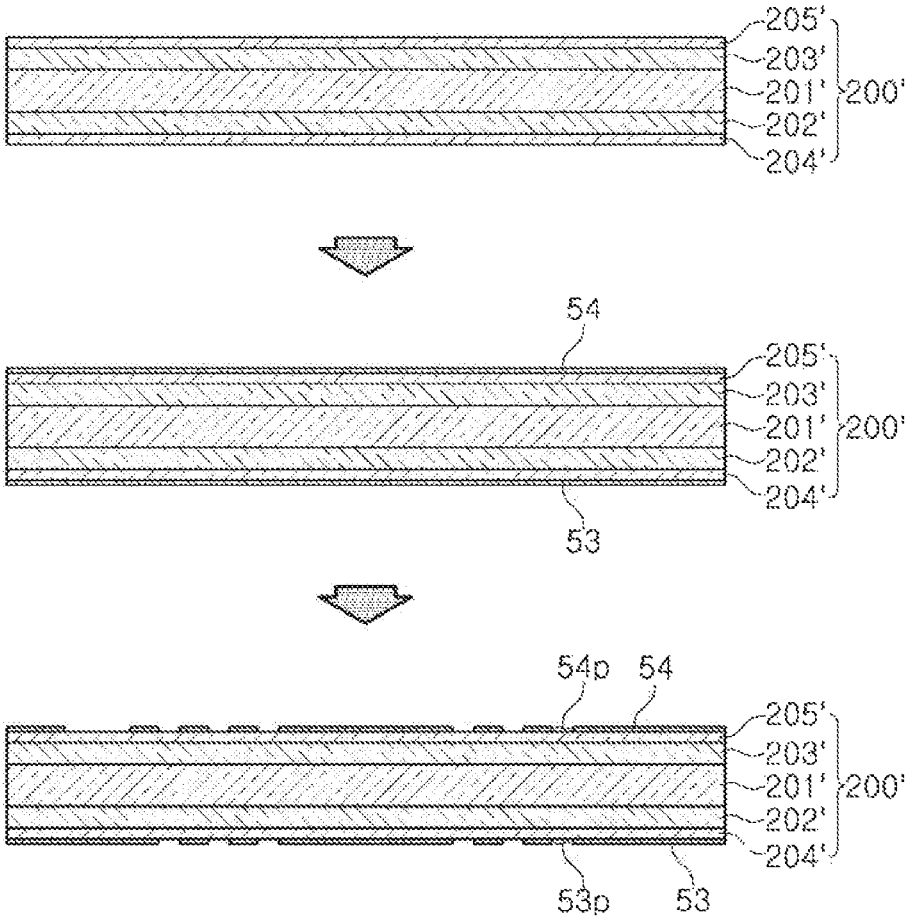

Referring to FIG. 32, a substrate 200' may be prepared. Next, third and fourth insulating layers 53 and 54 may be formed, respectively, on second metal layers 204' and 205' disposed on first plating layers 202' and 203' on both sides of a support member 201' of the substrate 200'. The third and fourth insulating layers 53 and 54 may be formed by a method of laminating the above-mentioned insulating material such as the photoimageable dielectric (PID) at a predetermined thickness such as about 10 μm to 20 μm. Next, patterns 53P and 54P having a planar spiral shape may be formed on the third and fourth insulating layers 53 and 54, respectively. In a case in which the materials of the third and fourth insulating layers 53 and 54 are the photoimageable dielectric (PID), the patterns 53P and 54P having the planar spiral shape may be formed by a known photolithography method, that is, processes such as exposure, development, drying, and the like. When the patterns 53P and 54P having the planar spiral shape are formed, the second metal layers 204' and 205' disposed on both sides of the substrate 200' may be externally exposed so as to be used as seed layers in a plating process, the subsequent process.

Figure 33:
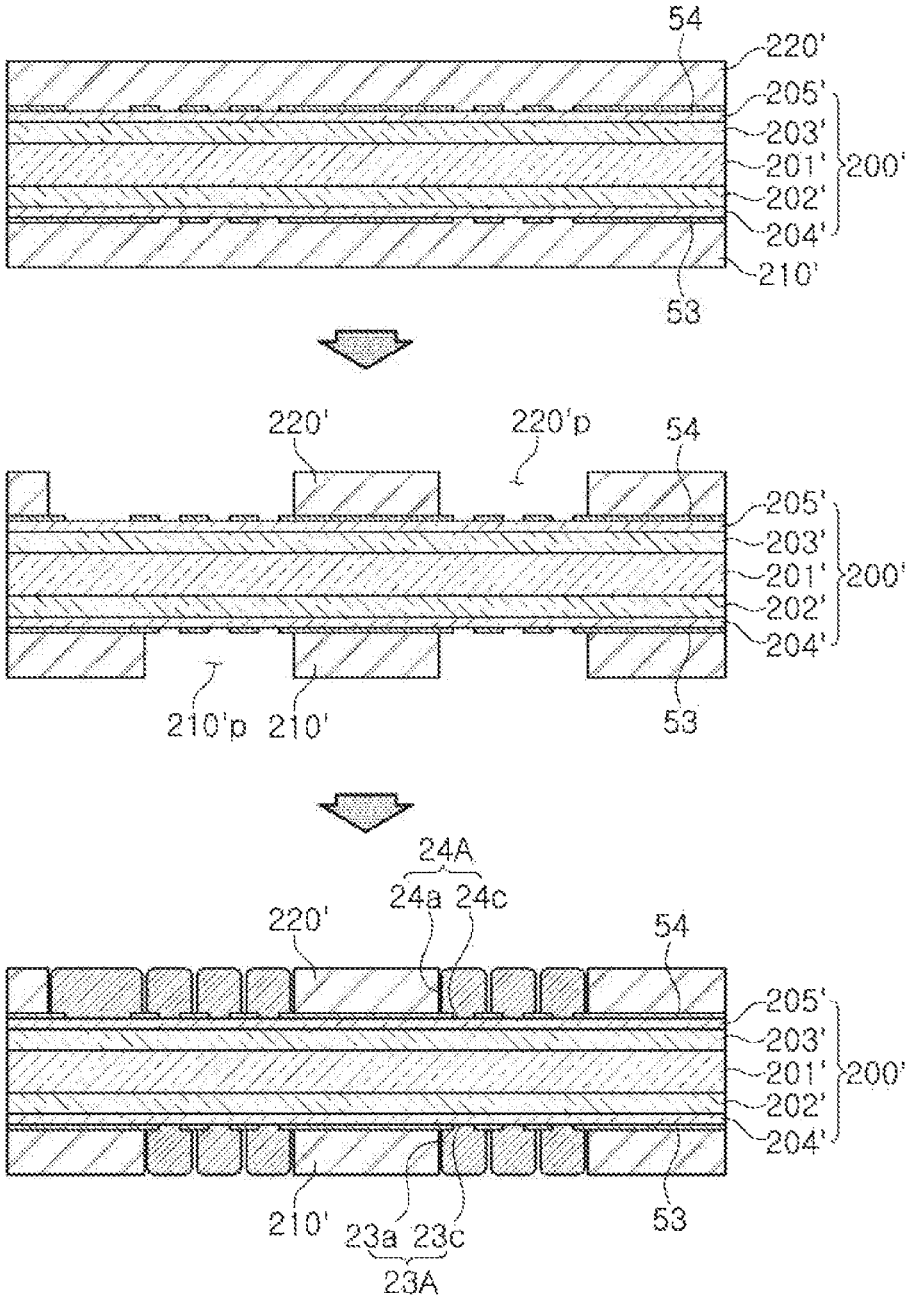

Referring to FIG. 33, dry films 210' and 220' may be formed on the third and fourth insulating layers 53 and 54, respectively. Next, dams 210'P and 220'P for a plating process, the subsequent process, may be formed in the dry films 210' and 220', respectively, by a known photolithography method. Next, first plating layers 23A and 24A may be formed, respectively, on the second metal layers 204' and 205' exposed through patterns formed on the third and fourth insulating layers 53 and 54 and having a planar spiral shape and disposed on both sides of the substrate 200'. The first plating layers 23A and 24A may be formed by a known plating method such as anisotropic electroplating using the exposed second metal layers 204' and 205' as seed layers. The first plating layers 23A and 24A may include the third conductors 23*c* and 24*c* filling the patterns formed on the third and fourth insulating layers 53 and 54 and having the planar spiral shape and the first conductors 23*a* and 24*a* formed on the third conductors 23*c* and 24*c*, respectively, and a boundary may not be particularly present between the first conductors 23*a* and 24*a* and the third conductors 23*c* and 24*c*. Line widths of the first conductors 23*a* and 24*a* of the first plating layers 23A and 24A may be approximately 80 μm to 120 μm, thicknesses of the first conductors 23*a* and 24*a* of the first plating layers 23A and 24A may be approximately 80 μm to 120 μm, intervals between lines of the first conductors 23*a* and 24*a* of the first plating layers 23A and 24A may be approximately 2 μm to 5 μm, and aspect ratios of patterns of the first conductors 23*a* and 24*a* of the first plating layers 23A and 24A may be about 0.8 to 1.5, but are not limited thereto.

Figure 34:
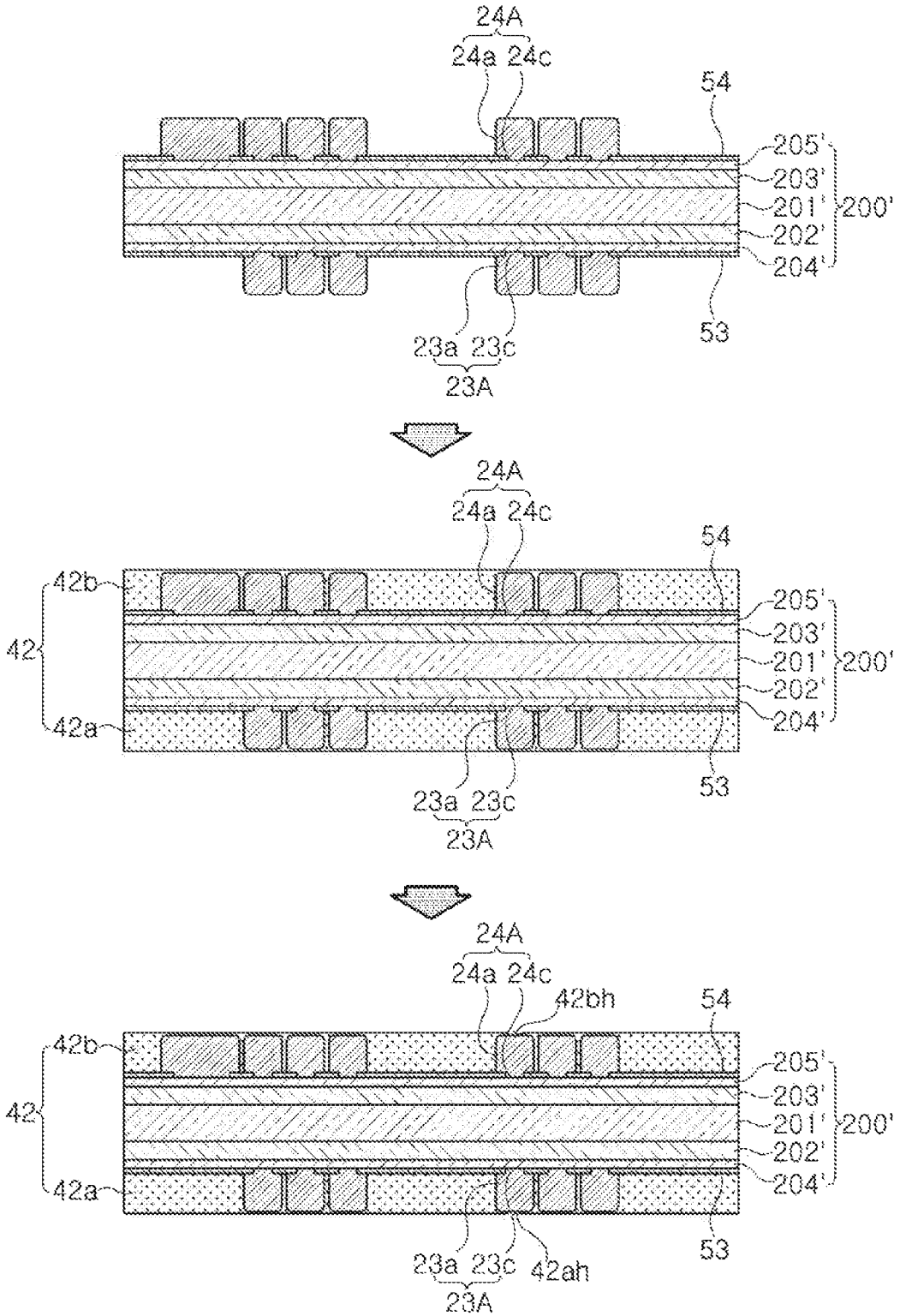

Referring to FIG. 34, the dry films 210' and 220' may be stripped. Next, resin layers 42*a* and 42*b* may be formed on the first plating layers 23A and 24A, respectively. The resin layers 42*a* and 42*b* may embed the first conductors 23*a* and 24*a* of the first plating layers 23A and 24A, respectively, therein. The resin layers 42*a* and 42*b* may also be formed by a method of laminating an insulating material such as a photoimageable dielectric (PID) at a predetermined thickness such as about 80 μm to 150 μm. Alternatively, the resin layers 42*a* and 42*b* may also be formed by a method of laminating a magnetic film having a predetermined thickness such as about 80 μm to 150 μm, for example, a curable film containing a magnetic filler. Next, vias 42*ah* and 42*bh* connected to the first plating layers 23A and 24A may be formed in the resin layers 42*a* and 42*b*, respectively. The vias 42*ah* and 42*bh* may be formed by a known photolithography method in a case in which the resin layers 42*a* and 42*b* include the photoimageable dielectric (PID), and may be formed by a known laser drilling method, or the like, in a case in which the resin layers 42*a* and 42*b* include a curable insulating material.

Figure 35:
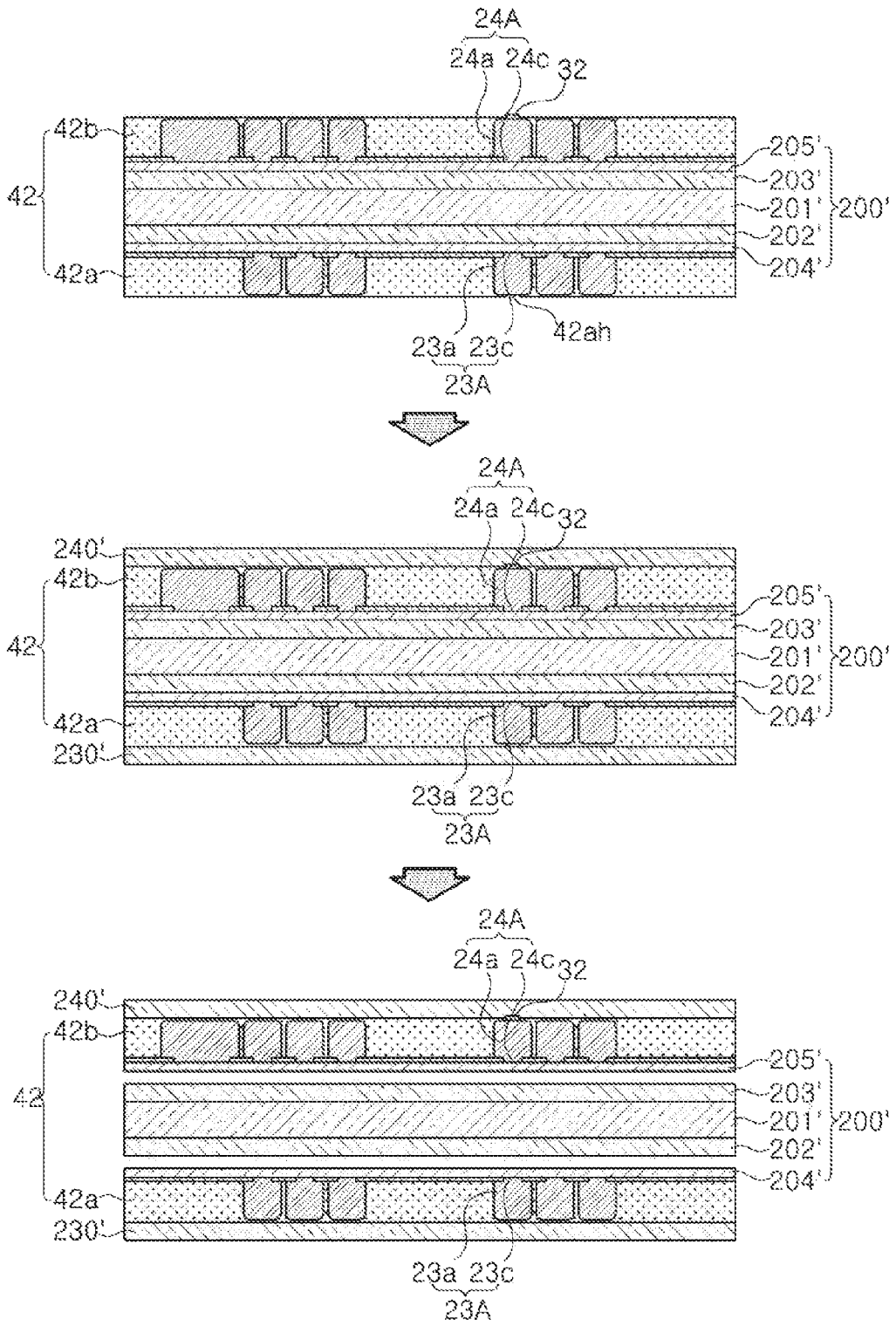

Referring to FIG. 35, the second bump 32 may be formed in at least one of the vias 42*ah* and 42*bh* formed in the resin layers 42*a* and 42*b*. The second bump 32 may be formed by a known method such as electroplating, paste printing, or the like. Meanwhile, the second bump 32 may protrude from a surface of the resin layer 42*a* or 42*b*, and a thickness of the second bump 32 protruding from the surface of the resin layer 42*a* or 42*b* may be approximately 5 μm to 10 μm. Next, black masks 230' and 240' may be formed on the resin layers 42*a* and 42*b*, respectively, in order to protect the second bump 32. Next, the second metal layers 204' and 205' may be separated from the support member 201'.

Figure 36:
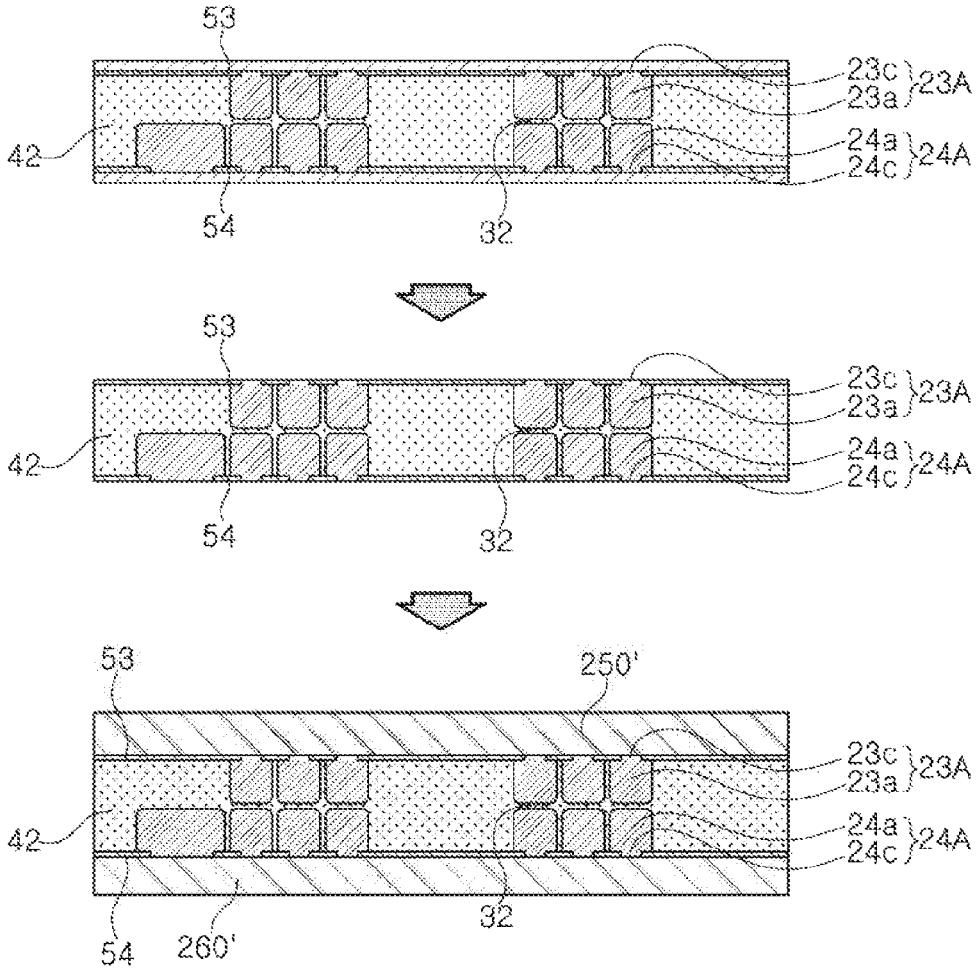

Referring to FIG. 36, the respective resin layers 42*a* and 42*b* may be matched with each other and stacked so that the vias 42*ah* and 42*bh* formed in the respective resin layers 42*a* and 42*b* are connected to each other. In this case, the second bump 32 formed in any one of the vias 42*ah* and 42*bh* may also be disposed in the other of the vias 42*ah* and 42*bh*, such that the respective first plating layers 23A and 24A may be electrically connected to each other through the second bump 32. The respective resin layers 42*a* and 42*b* may adhere to each other by high-temperature compression to form the second resin layer 42. In this case, the intermetallic compound (IMC) may be formed between the second bump 32 and the first plating layers 23A and 24A. As a result, interlayer connection strength may be increased, and conduction resistance may be reduced, thereby enabling a smooth flow of electrons. Next, the second metal layers 204' and 205' remaining on the third and fourth insulating layers 53 and 54 may be removed. Next, dry films 250' and 260' may be formed on portions from which the second metal layers 204' and 205' have been removed.

Figure 37:
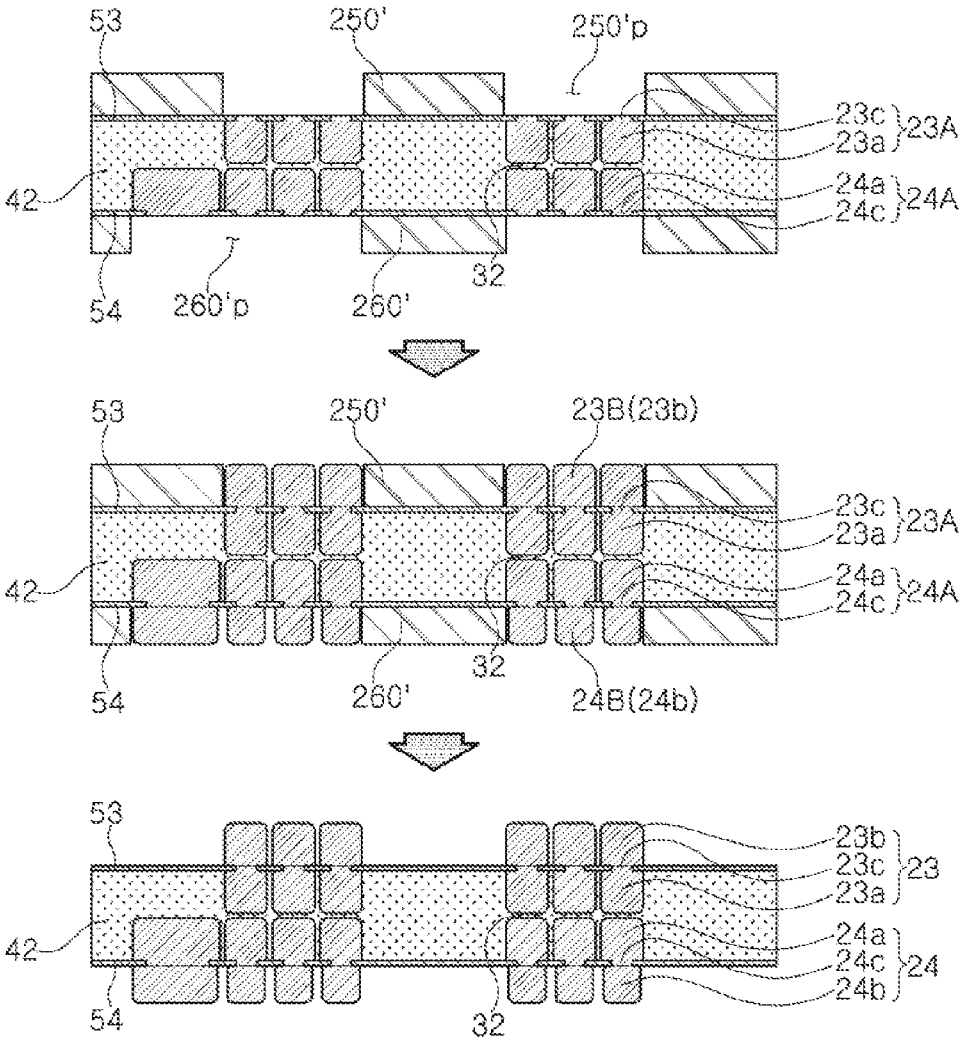

Referring to FIG. 37, dams 250'P and 260'P for a plating process, the subsequent process, may be formed in the dry films 250' and 260', respectively, by a known photolithography method. Next, second plating layers 23B and 24B may be formed, respectively, on the third conductors 23*c* and 24*c* of the first plating layers 23A and 24A exposed through the dams 250'P and 260'P. The second plating layers 23B and 24B may be formed by a known plating method such as anisotropic electroplating using the exposed third conductors 23*c* and 24*c* of the first plating layers 23A and 24A as seed layers. The second plating layers 23B and 24B may include the second conductors 23*b* and 24*b*, respectively, and a boundary may also be present between the second conductors 23*b* and 24*b* and the third conductors 23*c* and 24*c*. Line widths of the second conductors 23*b* and 24*b* of the second plating layers 23B and 24B may be approximately 80 μm to 120 μm, thicknesses of the second conductors 23*b* and 24*b* of the second plating layers 23B and 24B may be approximately 80 μm to 120 μm, intervals between lines of the second conductors 23*b* and 24*b* of the second plating layers 23B and 24B may be approximately 2 μm to 5 μm, and aspect ratios of patterns of the second conductors 23*b* and 24*b* of the second plating layers 23B and 24B may be about 0.8 to 1.5, but are not limited thereto. The first and second plating layers 23A, 24A, 23B, and 24B may be connected to each other to form the third and fourth coil layers 23 and 24, respectively. Next, the dry films 250' and 260' may be stripped.

Figure 38:
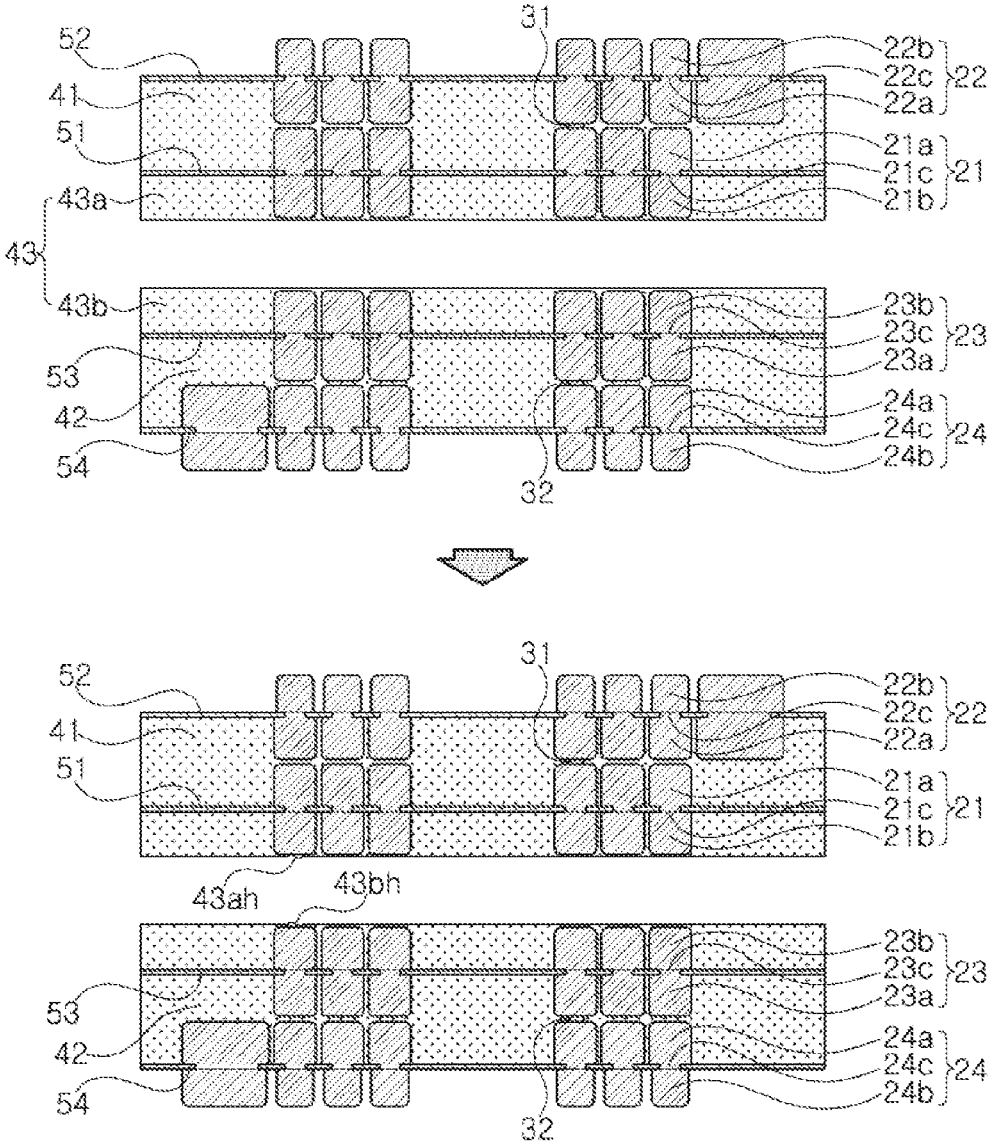

Referring to FIG. 38, a resin layer 43*a* embedding the second conductor 21*b* of the first coil layer 21 therein may be formed on the first insulating layer 51. In addition, a resin layer 43*b* embedding the second conductor 23*b* of the third coil layer 23 therein may be formed on the third insulating layer 53. The resin layers 43*a* and 43*b* may also be formed by a method of laminating an insulating material such as a photoimageable dielectric (PID) at a predetermined thickness such as about 80 μm to 150 μm. Alternatively, the resin layers 43*a* and 43*b* may also be formed by a method of laminating a magnetic film having a predetermined thickness such as about 80 μm to 150 μm, for example, a curable film containing a magnetic filler. Next, vias 43*ah* and 43*bh* connected to the second plating layers 21B and 23B may be formed in the resin layers 43*a* and 43*b*, respectively. The vias 42*ah* and 42*bh* may be formed by a known photolithography method in a case in which the resin layers 43*a* and 43*b* include the photoimageable dielectric (PID), and be formed by a known laser drilling method, or the like, in a case in which the resin layers 43*a* and 43*b* include a curable insulating material.

Figure 39:
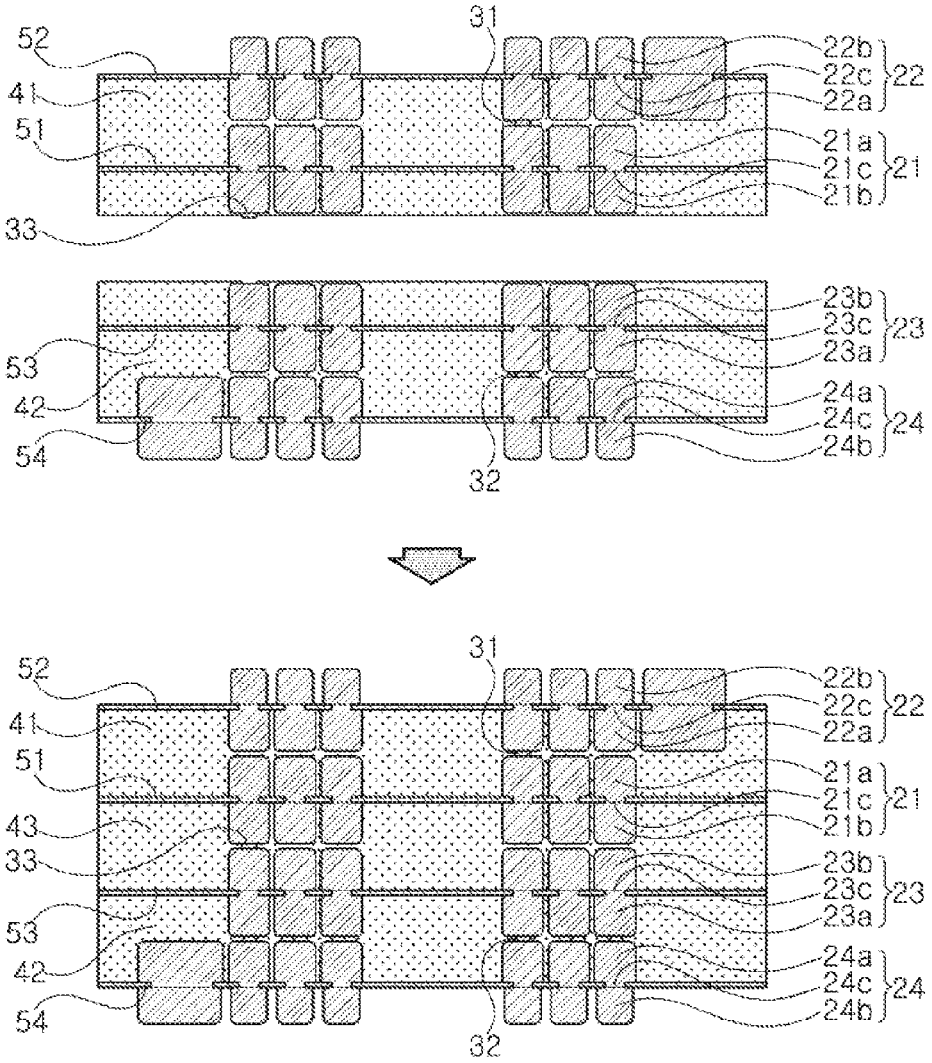

Referring to FIG. 39, a third bump 33 may be formed in at least one of the vias 43*ah* and 43*bh* formed in the resin layers 43*a* and 43*b*. The third bump 33 may be formed by a known method such as electroplating, paste printing, or the like. Meanwhile, the third bump 33 may protrude from a surface of the resin layer 43*a* or 43*b*, and a thickness of the third bump 33 protruding from the surface of the resin layer 43*a* or 43*b* may be approximately 5 μm to 10 μm. Next, the respective resin layers 43*a* and 43*b* may be matched with each other and stacked so that the vias 43*ah* and 43*bh* formed in the respective resin layers 43*a* and 43*b* are connected to each other. In this case, the third bump 33 formed in any one of the vias 43*ah* and 43*bh* may also be disposed in the other of the vias 43*ah* and 43*bh*, such that the respective second plating layers 21B and 23B may be electrically connected to each other through the third bump 33. The respective resin layers 43*a* and 43*b* may adhere to each other by high-temperature compression to form the third resin layer 43. In this case, the intermetallic compound (IMC) may be formed between the third bump 33 and the second plating layers 21B and 23B. As a result, interlayer connection strength may be increased, and conduction resistance may be reduced, thereby enabling a smooth flow of electrons.

Figure 40:
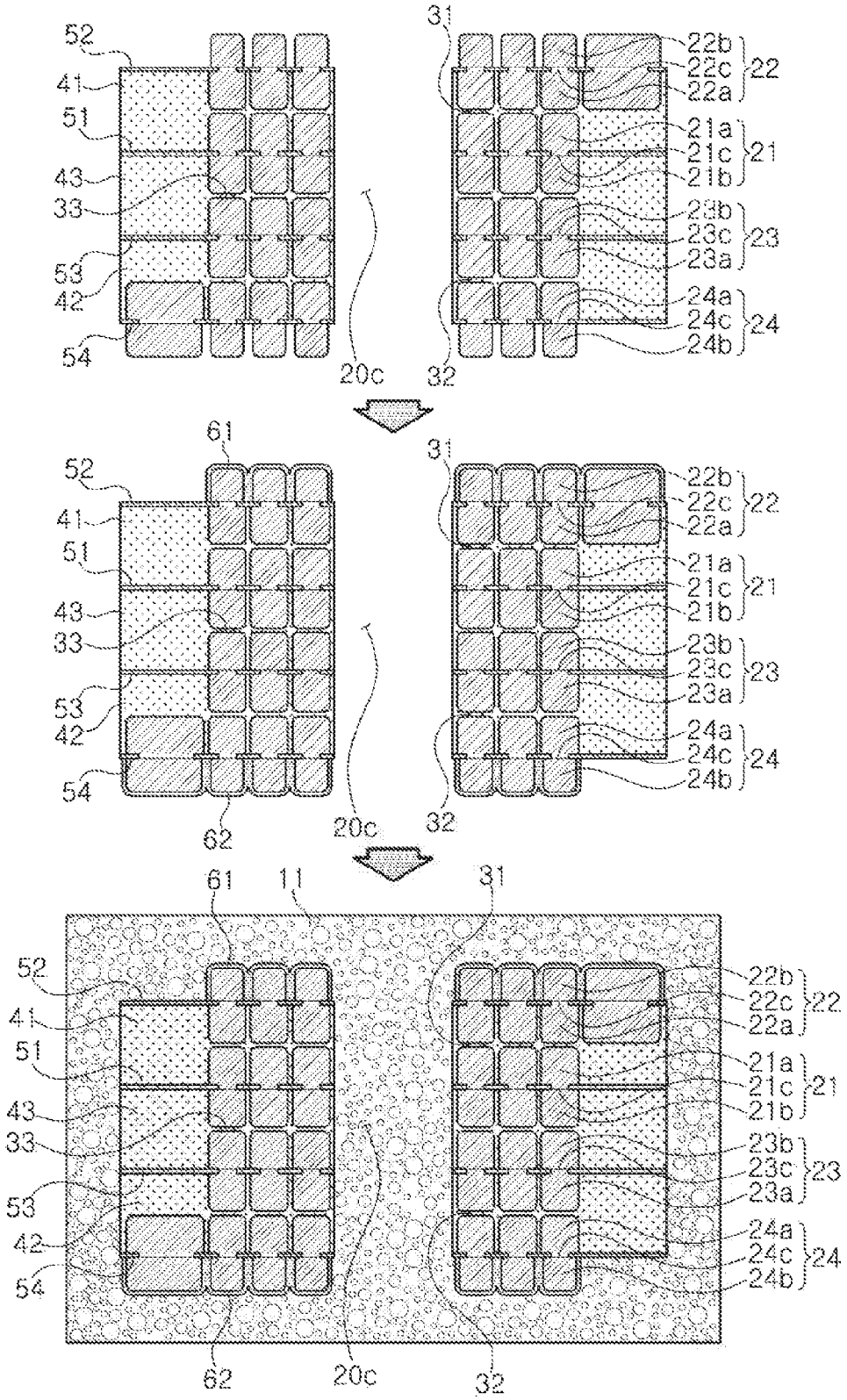

Referring to FIG. 40, a through-hole penetrating through central portions of the first to third resin layers 41 to 43 and the first to fourth insulating layers 51 to 54 may be formed. A region in which the through-hole is formed may be a core region 20*c* of the coil portion 20. Next, the first and second insulating films 61 and 62 covering, respectively, surfaces of the second conductors 22*b* and 24*b* of the second and fourth coil layers 22 and 24 may be formed. The first and second insulating films 61 and 62 may be formed by a known insulation coating method. The coil portion 20 may be formed through a series of processes. Next, the magnetic material 11 may cover the upper portion and the lower portion of the coil portion 20 and fill the through-hole formed in the central portion. The body portion 10 may be formed through a series of processes.

Figure 41:
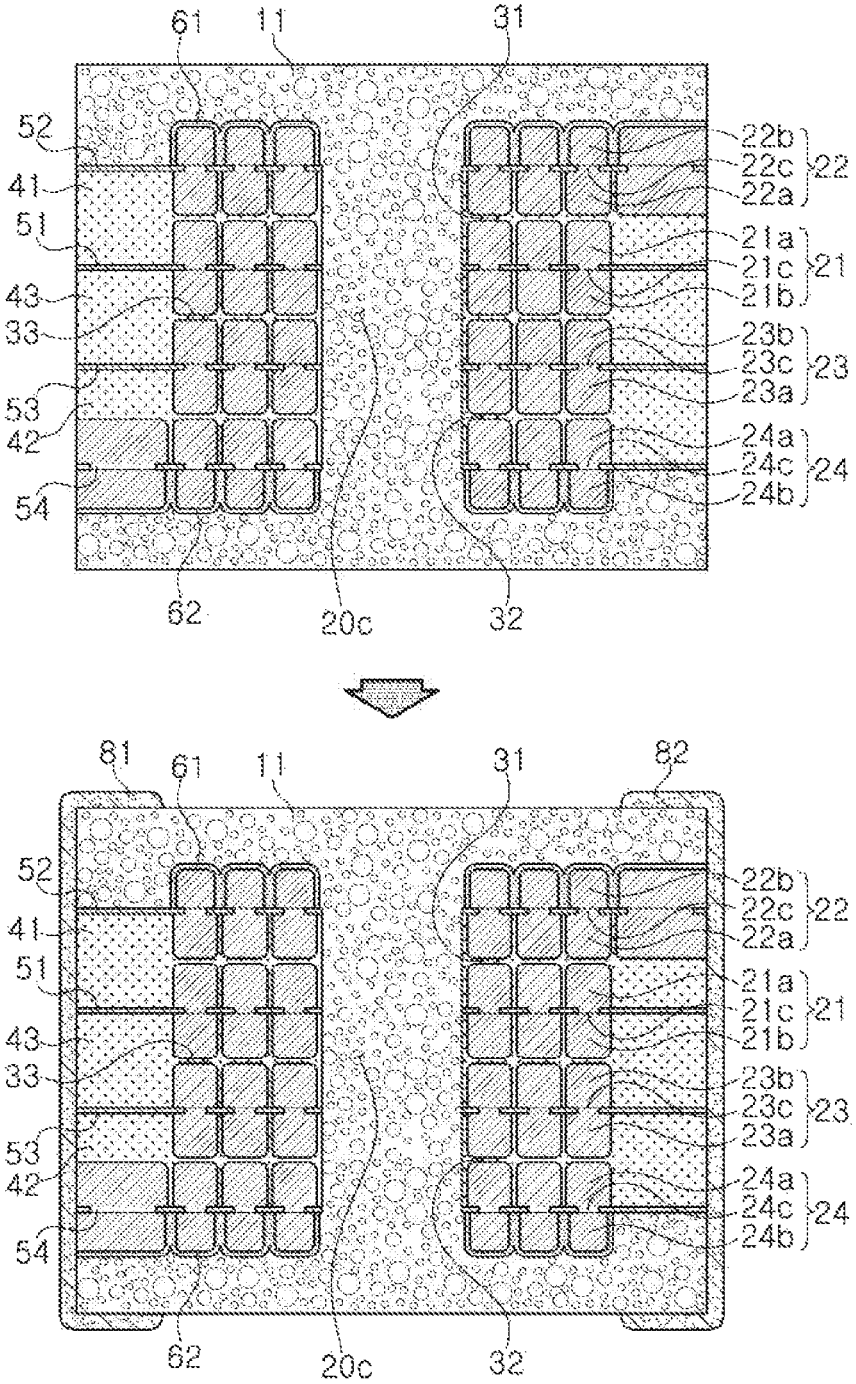

Referring to FIG. 41, the body portion 10 may be diced at a desired size and be polished. Next, the first and second electrodes 81 and 82 covering at least the first and second surfaces of the body portion 10 so as to be connected, respectively, to the first and second lead terminals (not denoted by reference numerals) of the coil portion 20 may be formed. The electrode portion 80 may be formed through a series of processes.

Figure 42:
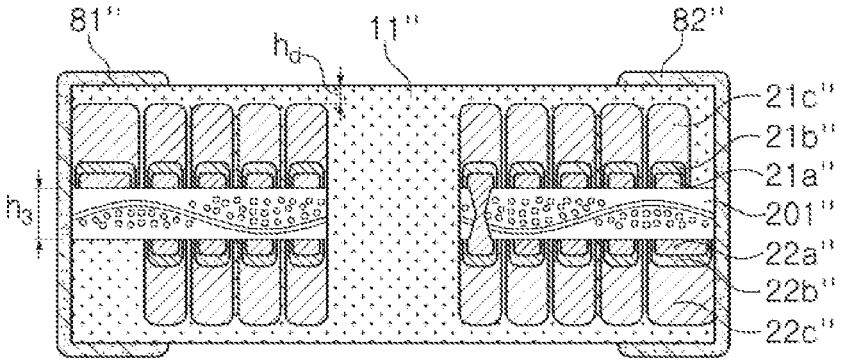
FIG. 42 is a schematic view illustrating an example of a coil component to which anisotropic plating technology is applied.

FIG. 42 is a schematic view illustrating an example of a coil component to which anisotropic plating technology is applied.

Referring to the drawing, a coil component to which anisotropic plating technology is applied may be manufactured by forming patterns 21*a*", 21*b*", 21*c*", 22*a*", 22*b*", and 22*c*" having a planar spiral shape on both surfaces of a support member 201" and through-vias (not denoted by reference numerals) in the support member 201" by the anisotropic plating technology, embedding the patterns 21*a*", 21*b*", 21*c*", 22*a*", 22*b*", and 22*c*" and the through-vias using a magnetic material to form a body 10", and forming external electrodes 81" and 82" electrically connected to the patterns 21*a*", 21*b*", 21*c*", 22*a*", 22*b*", and 22*c*" on outer surfaces of the body 10". However, in a case of applying the anisotropic plating technology, a high aspect ratio may be implemented, but uniformity of plating growth may be decreased due to an increase in an aspect ratio, and a dispersion of a plating thickness is wide, such that a short-circuit between patterns may easily occur. In addition, it may be appreciated that a thickness $h_3$ of the support member 201" is significant, such that there is a restriction in a thickness $h_d$ of magnetic materials disposed on and beneath the patterns 21*a*", 21*b*", 21*c*", 22*a*", 22*b*", and 22*c*".

As set forth above, according to the exemplary embodiments in the present disclosure, a new coil component in which a problem such as a short-circuit, or the like, occurring at the time of applying anisotropic plating technology according to the related art may be improved, a thickness of a magnetic material covering a coil may be sufficiently secure, and a pattern having a high aspect ratio (AR) may be implemented, and a method of manufacturing the same may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body portion including a magnetic material;

a coil portion disposed in the body portion; and an electrode portion disposed on the body portion and electrically connected to the coil portion, wherein the coil portion includes:

a first coil layer in which a plurality of conductors having a planar spiral shape are stacked;

a second coil layer in which a plurality of conductors having a planar spiral shape are stacked; and a first bump disposed between the first and second coil layers to electrically connect the first and second coil layers to each other, and the first coil layer and the second coil layer are electrically connected to each other through the first bump to form a single coil having coil turns adjacent to each other in horizontal and vertical directions.

2. The coil component of claim 1, wherein the first coil layer and the second coil layer include respective first conductors, second conductors, and third conductors disposed between the respective first conductors and the respective second conductors to connect the respective first conductors and the respective second conductors to each other, respectively, and line widths of the first conductors and the second conductors are wider than those of the third conductors.

3. The coil component of claim 2, wherein each of the first conductors, second conductors, and third conductors of the first coil layer and the second coil layer have a planar spiral shape.

4. The coil component of claim 2, wherein the coil portion further includes:

a first resin layer in which the first conductor of the first coil layer and the first conductor of the second coil layer are embedded;

a first insulating layer disposed between the first conductor and the second conductor of the first coil layer; and a second insulating layer disposed between the first conductor and the second conductor of the second coil layer, the first bump extends through the first resin layer between the first conductor of the first coil layer and the first conductor of the second coil layer, the third conductor of the first coil layer extends through the first insulating layer, and the third conductor of the second coil layer extends through the second insulating layer.

5. The coil component of claim 4, wherein the first resin layer has a thickness greater than thicknesses of the first insulating layer and the second insulating layer.

6. The coil component of claim 4, wherein the first resin layer includes a photoimageable dielectric (PID) or a curable insulating material containing a magnetic filler.

7. The coil component of claim 4, wherein the first insulating layer and the second insulating layer both include photoimageable dielectrics (PIDs).

8. The coil component of claim 4, wherein the first bump includes an intermetallic compound (IMC).

9. The coil component of claim 1, wherein the first coil layer and the second coil layer include respective first conductors, second conductors, third conductors disposed between the respective first conductors and the respective second conductors to connect the respective first conductors and the respective second conductors to each other, and fourth conductors disposed on the respective second conductors and directly connected to the second conductors, respectively, and line widths of the first conductors and the second conductors are wider than line widths of the third conductors.

10. The coil component of claim 9, wherein the coil portion further includes:

a first resin layer in which the first conductor of the first coil layer and the first conductor of the second coil layer are embedded;

a second resin layer in which the second conductor of the first coil layer is embedded;

a third resin layer in which the second conductor of the second coil layer is embedded;

a first insulating layer disposed between the first resin layer and the second resin layer; and a second insulating layer disposed between the first resin layer and the third resin layer, the first bump extends through the first resin layer between the first conductor of the first coil layer and the first conductor of the second coil layer, the third conductor of the first coil layer extends through the first insulating layer, and the third conductor of the second coil layer extends through the second insulating layer.

11. The coil component of claim 1, wherein the coil portion further includes:

a third coil layer in which a plurality of conductors having a planar spiral shape are stacked;

a fourth coil layer in which a plurality of conductors having a planar spiral shape are stacked;

a second bump disposed between the third coil layer and the fourth coil layer to electrically connect the third coil layer and the fourth coil layer to each other; and a third bump disposed between the first coil layer and the third coil layer to electrically connect the first coil layer and the third coil layer to each other, and the first to fourth coil layers are electrically connected to each other through the first to third bumps to form a single coil having coil turns adjacent to each other in the horizontal and vertical directions.

12. The coil component of claim 11, wherein the first to fourth coil layers include respective first conductors, second conductors, and third conductors disposed between the respective first conductors and the respective second conductors to connect the respective first conductors and the respective second conductors to each other, respectively, and line widths of the first conductors and the second conductors are wider than line widths of the third conductors.

13. The coil component of claim 12, wherein the coil portion further includes:

a first resin layer in which the first conductor of the first coil layer and the first conductor of the second coil layer are embedded;

a second resin layer in which the first conductor of the third coil layer and the first conductor of the fourth coil layer are embedded;

a third resin layer in which the second conductor of the first coil layer and the second conductor of the third coil layer are embedded;

a first insulating layer disposed between the first conductor and the second conductor of the first coil layer;

a second insulating layer disposed between the first conductor and the second conductor of the second coil layer;

a third insulating layer disposed between the first conductor and the second conductor of the third coil layer; and a fourth insulating layer disposed between the first conductor and the second conductor of the fourth coil layer, the first bump extends through the first resin layer between the first conductor of the first coil layer and the first conductor of the second coil layer, the second bump extends through the second resin layer between the first conductor of the third coil layer and the first conductor of the fourth coil layer, the third bump extends through the third resin layer between the second conductor of the first coil layer and the second conductor of the third coil layer, the third conductor of the first coil layer extends through the first insulating layer, the third conductor of the second coil layer extends through the second insulating layer, the third conductor of the third coil layer extends through the third insulating layer, and the third conductor of the fourth coil layer extends through the fourth insulating layer.

14. The coil component of claim 1, wherein the magnetic material of the body portion covers an upper portion and a lower portion of the coil portion and fills a through-hole formed in a central portion of the coil portion.

15. The coil component of claim 1, wherein the electrode portion includes:

a first electrode covering at least a first surface of the body portion and electrically connected to a first lead terminal of the coil portion on the first surface; and a second electrode covering at least a second surface of the body portion and electrically connected to a second lead terminal of the coil portion on the second surface, and the first surface and the second surface are disposed opposite to each other.

16. A method of manufacturing a coil component, comprising:

forming a coil portion in a body portion including a magnetic material; and forming an electrode portion on the body portion, the electrode portion being electrically connected to the coil portion, wherein the forming of the coil portion includes:

preparing a substrate including a support member and one or more metal layers disposed on opposing surfaces of the support member;

forming insulating layers on the metal layers on each of the opposing surfaces of the support member;

forming patterns in the insulating layers, the patterns having a planar spiral shape;

forming first plating layers on the metal layers exposed through the patterns formed in the insulating layers and having the planar spiral shape on each of the opposing surfaces of the support member;

forming resin layers on the first plating layers, respectively;

forming vias in the resin layers, the vias being connected to the first plating layers;

forming a bump in at least one of the vias;

separating at least one of the metal layers from the support member;

electrically connecting the respective first plating layers to each other through the bump by contacting the resin layers to each other and stacking the resin layers so that the respective vias are connected to each other;

removing the metal layers remaining on the respective insulating layers; and forming second plating layers, respectively, on the first plating layers exposed due to the removal of the metal layers, and wherein the respective first plating layers connected to each other through the bump and the respective second plating layers formed on the respective first plating layers are electrically connected to each other to form a single coil having coil turns adjacent to each other in horizontal and vertical directions.

17. The method of manufacturing a coil component of claim 16, wherein each respective first plating layer is formed to include first and third conductors having line widths different from each other, each respective second plating layer is formed to include second conductors connected to the third conductors, and line widths of the first and second conductors are wider than line widths of the third conductors.

18. A coil component comprising:

a body portion including a magnetic material;

a coil portion disposed in the body portion; and an electrode portion disposed on the body portion and electrically connected to the coil portion, wherein the coil portion includes:

a first coil layer in which first and second conductors are stacked in a stacking direction, wherein each of the first and second conductors of the first coil layer has a planar spiral shape and an aspect ratio of 0.8 to 1.5; and a second coil layer in which first and second conductors are stacked in the stacking direction, wherein each of the first and second conductors of the second coil layer has a planar spiral shape and an aspect ratio of 0.8 to 1.5, and the first and second coil layers are stacked in the stacking direction.

19. The coil component of claim 18, wherein an end of the planar spiral shape pattern of the first coil layer is electrically connected to an end of the planar spiral shape pattern of the second coil layer to form a single coil.

20. The coil component of claim 18, wherein the coil portion comprises:

a resin layer in which the first conductors of the first and second coil layers are embedded, wherein the second conductors of the first and second coil layers each extend above an upper surface or below a lower surface of the resin layer in the stacking direction.

21. The coil component of claim 20, wherein the coil portion further comprises:

insulating films disposed on surfaces of the second conductors of the first and second coil layers.

22. The coil component of claim 18, wherein the first coil layer further includes a third conductor stacked on the second conductor of the first coil layer in the stacking direction, wherein the third conductor of the first coil layer has a planar spiral shape and an aspect ratio of 0.8 to 1.5, and the second coil layer further includes a third conductor stacked on the second conductor of the second coil layer in the stacking direction, wherein the third conductor of the second coil layer has a planar spiral shape and an aspect ratio of 0.8 to 1.5.

23. The coil component of claim 22, wherein the coil portion comprises:

one or more resin layers in which the first and second conductors of the first and second coil layers are embedded, wherein the third conductors of the first and second coil layers each extend above an upper surface or below a lower surface of the one or more resin layers in the stacking direction.

24. A coil component comprising:

a body portion including a magnetic material;

a coil portion disposed in the body portion; and an electrode portion disposed on the body portion and electrically connected to the coil portion, wherein the coil portion includes:

a first coil layer in which first, second, and third conductors are stacked in a stacking direction, an insulating layer of the first coil layer is disposed between portions of the first and second conductors, and the third conductor of the first coil layer extends through the insulating layer to electrically connect the first and second conductors;

a second coil layer in which first, second, and third conductors are stacked in a stacking direction, an insulating layer of the second coil layer is disposed between portions of the first and second conductors, and the third conductor of the second coil layer extends through the insulating layer to electrically connect the first and second conductors; and insulating films are provided between the second conductors of the first and second coil layers and the body portion.

25. The coil component of claim 24, wherein each of the first, second, and third conductors of the first coil layer has a planar spiral shape, and each of the first, second, and third conductors of the second coil layer has a planar spiral shape.

26. The coil component of claim 24, wherein each insulating film is disposed to contact the body portion including the magnetic material on one side thereof, and to contact the second conductor of one of the first and second coil layers on another side thereof.

27. The coil component of claim 24, wherein the third conductor of the first coil layer extends through a planar spiral shaped opening in the insulating layer of the first coil layer, and the third conductor of the second coil layer extends through a planar spiral shaped opening in the insulating layer of the second coil layer.

28. The coil component of claim 24, wherein the second conductor of each of the first and second coil layers has a planar spiral shape, and the insulating films extend between adjacent windings of the second conductors of the first and second coil layers having the spiral shapes.

29. The coil component of claim 28, wherein the first conductor of each of the first and second coil layers has a planar spiral shape, and resin layer layers extend between adjacent windings of the first conductors of the first and second coil layers having the spiral shapes.

* * * * *